US011707646B2

(12) United States Patent
Rubin et al.

(10) Patent No.: US 11,707,646 B2
(45) Date of Patent: Jul. 25, 2023

(54) STRENGTH TRAINING AND EXERCISE PLATFORM

(71) Applicant: Arena Innovation Corp., New York, NY (US)

(72) Inventors: Zachary M. Rubin, Calabasas, CA (US); Matthew Brown, El Segundo, CA (US); Nicholas Buckles, Santa Monica, CA (US)

(73) Assignee: Arena Innovation Corp., New York, NY (US)

( * ) Notice: Subject to any disclaimer, the term of this patent is extended or adjusted under 35 U.S.C. 154(b) by 113 days.

(21) Appl. No.: 17/476,390

(22) Filed: Sep. 15, 2021

(65) Prior Publication Data

US 2022/0001240 A1 Jan. 6, 2022

Related U.S. Application Data

(63) Continuation of application No. 16/410,971, filed on May 13, 2019, now Pat. No. 11,123,609.

(Continued)

(51) Int. Cl.
*A63B 21/00* (2006.01)
*A63B 21/005* (2006.01)

(Continued)

(52) U.S. Cl.
CPC ..... *A63B 24/0087* (2013.01); *A63B 21/0058* (2013.01); *A63B 21/153* (2013.01);

(Continued)

(58) Field of Classification Search
CPC ..... A63B 5/00; A63B 5/16; A63B 21/00058; A63B 21/00069; A63B 21/00076; A63B 21/00178; A63B 21/00181; A63B 21/002; A63B 21/0023; A63B 21/005; A63B 21/0053; A63B 21/0054; A63B 21/0055; A63B 21/0058; A63B 21/078; A63B 21/15; A63B 21/151; A63B 21/152; A63B 21/153; A63B 21/154; A63B 21/156; A63B 21/22; A63B 21/4027; A63B 21/4033;

(Continued)

(56) References Cited

U.S. PATENT DOCUMENTS 2,778,053 A * 1/1957 Hess ..... E05D 7/1061 248/666
4,235,437 A * 11/1980 Ruis ..... B25J 9/046 482/901

(Continued)

*Primary Examiner* — Gary D Urbiel Goldner
(74) *Attorney, Agent, or Firm* — Polsinelli PC

(57) ABSTRACT

An exercise device includes a base defining an inner volume and a top supported by the base, the top defining an aperture. The exercise device further includes a force sensor configured to measure force on the top and a motor disposed within the base and below the top, the motor including a cable extendable through the aperture. The exercise deice further includes a controller communicatively coupled to each of the force sensor and the motor. The controller is adapted to actuate the motor in response to forces applied to the top as measured by the force sensor. The controller may also actuate the motor in response to one or more additional parameters related to the speed or force with which the cable is manipulated (e.g., pulled by a user).

20 Claims, 31 Drawing Sheets

Related U.S. Application Data

(60) Provisional application No. 62/762,676, filed on May 14, 2018.

(51) Int. Cl.
*A63B 69/00* (2006.01)
*A63B 24/00* (2006.01)
*A63B 71/06* (2006.01)

(52) U.S. Cl.
CPC ..... *A63B 21/4033* (2015.10); *A63B 24/0062* (2013.01); *A63B 69/0053* (2013.01); *A63B 69/0057* (2013.01); *A63B 71/0622* (2013.01); *A63B 2024/0093* (2013.01); *A63B 2220/30* (2013.01); *A63B 2220/51* (2013.01); *A63B 2220/58* (2013.01); *A63B 2220/833* (2013.01); *A63B 2225/52* (2013.01)

(58) Field of Classification Search
CPC ..... A63B 21/4035; A63B 21/4047; A63B 21/4049; A63B 22/0076; A63B 22/0087; A63B 2022/0079; A63B 24/0062; A63B 24/0075; A63B 24/0084; A63B 24/0087; A63B 2024/0065; A63B 2024/0081; A63B 2024/0093; A63B 2024/0096; A63B 69/0053; A63B 69/0057; A63B 69/06; A63B 2069/062; A63B 71/0054; A63B 71/023; A63B 71/0619; A63B 71/0622; A63B 71/0686; A63B 71/0697; A63B 2071/0063; A63B 2071/0072; A63B 2071/0081; A63B 2071/009; A63B 2071/026; A63B 2071/027; A63B 2071/0625; A63B 2071/0627; A63B 2071/063; A63B 2071/065; A63B 2071/0652; A63B 2071/0655; A63B 2071/0675; A63B 2071/0677; A63B 2071/068; A63B 2071/0683; A63B 2220/10; A63B 2220/17; A63B 2220/20; A63B 2220/30; A63B 2220/40; A63B 2220/50; A63B 2220/51; A63B 2220/52; A63B 2220/56; A63B 2220/58; A63B 2220/62; A63B 2220/80; A63B 2220/801; A63B 2220/805; A63B 2220/83; A63B 2220/833; A63B 2220/89; A63B 2225/09; A63B 2225/096; A63B 2225/20; A63B 2225/50; A63B 2225/52; A63B 2230/01; A63B 2230/015

See application file for complete search history.

(56) References Cited

U.S. PATENT DOCUMENTS 4,848,152 A * 7/1989 Pratt, Jr. ..... A63B 21/4005 482/901
6,612,170 B2 * 9/2003 Brown ..... A63B 21/4043 73/379.06
7,470,216 B2 * 12/2008 Farinelli ..... A63B 23/0244 482/3
8,353,388 B2 * 1/2013 Rice ..... B66F 9/20 177/139
8,845,499 B1 * 9/2014 Boatwright ..... A63B 24/0062 482/116
9,144,709 B2 * 9/2015 Reich ..... A63B 21/00178
9,168,420 B1 * 10/2015 Berme ..... A61B 5/1036
9,526,451 B1 * 12/2016 Berme ..... A63B 71/0622
9,586,091 B2 * 3/2017 Reich ..... A63B 21/00076
9,700,753 B1 * 7/2017 Boatwright ..... A63B 24/0062
11,123,609 B2 * 9/2021 Rubin ..... A63B 24/0062
2007/0155587 A1 * 7/2007 Huang ..... A63B 23/12 482/148
2010/0125026 A1 * 5/2010 Zavadsky ..... A63F 13/80 482/5
2010/0126543 A1 * 5/2010 Cutler ..... E04F 10/0644 135/117
2010/0151994 A1 * 6/2010 Yeh ..... A63B 22/00 482/4
2010/0216600 A1 * 8/2010 Noffsinger ..... A63B 23/12 482/5
2010/0331144 A1 * 12/2010 Rindfleisch ..... A63B 21/00178 482/4
2011/0165995 A1 * 7/2011 Paulus ..... A63B 21/153 482/5
2011/0172058 A1 * 7/2011 Deaconu ..... A63B 24/0087 482/5
2011/0251021 A1 * 10/2011 Zavadsky ..... A63F 13/211 482/5
2012/0053014 A1 * 3/2012 Zhu ..... A63B 21/4035 482/5
2012/0058859 A1 * 3/2012 Elsom-Cook .... A63B 21/00181 482/4
2012/0190502 A1 * 7/2012 Paulus ..... A63B 24/0062 482/5
2012/0228062 A1 * 9/2012 Taylor ..... A63B 69/0064 182/231
2012/0231929 A1 * 9/2012 Hsieh ..... A63B 21/4047 482/5
2013/0267384 A1 * 10/2013 Eldridge ..... A63B 24/0062 482/5
2013/0310230 A1 * 11/2013 Norris ..... A63B 21/4035 482/115
2014/0038777 A1 * 2/2014 Bird ..... A63B 23/03525 482/5
2014/0097040 A1 * 4/2014 Chang ..... A62B 35/0075 182/100
2014/0194251 A1 * 7/2014 Reich ..... A63B 21/00178 482/6
2014/0287876 A1 * 9/2014 Etter ..... A63B 24/0087 482/5
2014/0315689 A1 * 10/2014 Vauquelin ..... A63B 22/0235 482/8
2014/0342878 A1 * 11/2014 Hashish ..... A63B 21/045 482/8
2015/0031505 A1 * 1/2015 Hsieh ..... A63B 24/0087 482/5
2015/0165272 A1 * 6/2015 Bird ..... A63B 21/4043 482/5
2015/0375028 A1 * 12/2015 Oteman ..... F03G 1/02 482/2
2016/0101322 A1 * 4/2016 Potter ..... A63B 21/153 482/6
2016/0151675 A1 * 6/2016 Chazalon ..... A63B 24/0087 482/5
2016/0332019 A1 * 11/2016 Rollins ..... A63B 23/129
2016/0354638 A1 * 12/2016 Carr ..... A63B 21/4043
2017/0080289 A1 * 3/2017 Hashish ..... A63B 21/045
2017/0333756 A1 * 11/2017 Bird ..... A63B 21/005
2018/0001128 A1 * 1/2018 Norris ..... A63B 21/4035
2018/0021616 A1 * 1/2018 Orady ..... G01L 5/04 482/5
2018/0214729 A1 * 8/2018 Rubin ..... A63B 24/0087
2018/0353813 A9 * 12/2018 Bird ..... G16H 20/30
2019/0151716 A1 * 5/2019 Bird ..... A63B 21/4043
2019/0344123 A1 * 11/2019 Rubin ..... A63B 24/0062

* cited by examiner

STRENGTH TRAINING AND EXERCISE PLATFORM

CROSS REFERENCE TO RELATED APPLICATIONS

This application is a continuation of and claims priority to U.S. nonprovisional patent application Ser. No. 16/410,971, filed May 13, 2019 and titled "Strength Training and Exercise Platform", which claims priority under 35 U.S.C. § 119 to U.S. provisional patent application No. 62/762,676 which was filed May 14, 2018 entitled "Modular Platform for Strength Training," all of which are fully incorporated by reference herein for all purposes.

TECHNICAL FIELD

Aspects of the present invention are directed to an intelligent exercise apparatus and, in particular, to a network-enabled exercise platform capable of providing dynamic resistance for various exercises.

BACKGROUND

Maintaining a successful exercise regimen is a significant challenge to many individuals with busy schedules who may lack training and knowledge regarding the benefits of different types of exercise and how to perform those exercises. Moreover, with time constraints and a lack of knowledge, it may be challenging to properly track and analyze performance and progress. As a result, there is an ongoing need to develop efficient exercise devices, and it is important to provide ways to easily perform exercises correctly and with an optimal resistance to maximize their results during the limited time available. Variety and cross-training is also very important to maintaining interest, improving motivation, and avoiding injury.

It is with these issues in mind, among others, that aspects of the present disclosure were conceived.

SUMMARY

In one aspect of the present disclosure an exercise device is provided. The exercise device includes a base defining an inner volume and a top supported by the base, the top defining an aperture. The exercise device further includes a force sensor configured to measure force on the top and a motor disposed within the base and below the top, the motor including a cable extendable through the aperture. The exercise deice further includes a controller communicatively coupled to each of the force sensor and the motor. The controller is adapted to actuate the motor in response to forces applied to the top as measured by the force sensor.

In one implementation, the force sensor is a load cell disposed between the base and the top.

In other implementations the exercise device comprises a plurality of force sensors including the force sensor to measure forces applied to the top and the controller is further adapted to actuate the motor in response to forces on the top as measured by the plurality of load cells. In one implementation, the plurality of force sensors is distributed between the base and the top such that the top is supported by the plurality of force sensors. In another implementation, the top includes a first plate and a second plate and the plurality of force sensors includes each of a first set of force sensors and a second set of force sensors. The first set of force sensors is configured to measure a force distribution on the first plate, with each of the first set of force sensors positioned at a respective corner of the first plate to measure forces at the respective corner of the first plate. Similarly, the second set of force sensors is configured to measure a force distribution on the second plate, with each of the second set of force sensors positioned at a respective corner of the second plate to measure forces at the respective corner of the second plate.

In yet another implementation, the controller is further adapted to actuate the motor in response to at least one of force produced by the motor on the cable, one or more user settings, one or more forces measured on a structural element of the exercise platform, or one or more motor parameter measurements.

In other implementations the top includes an omnidirectional fairlead having a plurality of rollers for guiding the cable, the omnidirectional fairlead defining the aperture.

In still other implementations, the exercise device further includes a battery electrically coupled to the motor and the controller is further to selectively operate the motor in a power generation mode during which power is generated at the motor as the user extends the cable and transmitted to the battery.

In other implementations the exercise device further includes a force multiplying feature accessible from the top. The force multiplying feature is adapted to fix or route a portion of the cable such that a handle may be coupled to an intermediate portion of the cable disposed between the aperture and the force multiplying feature.

In another aspect of the present disclosure a method of operating an exercise device is provided. The method includes receiving, at a controller, a force measurement from a force sensor communicatively coupled to the controller, the force measurement corresponding to a force applied to a top supported by a base. The method further includes actuating, using the controller, a motor disposed within the base in response to the force measurement, the motor being coupled to a cable extending out of the base such that actuating the motor in response to the force applies force to the cable.

In one implementation, actuating the motor is further in response to an exercise parameter, the exercise parameter corresponding to at least one of an amount of force to be applied to the cable or a movement speed of the cable.

In other implementations the force sensor is one of a plurality of force sensors communicatively coupled to the controller. In such implementations, the method further includes receiving, at the controller, force measurements from each of the plurality of force sensors, and actuating the motor in further response to each of the plurality of force measurements. In such implementations, the top may include a first plate and a second plate The plurality of force sensors may include a first set of force sensors, with each of the first set of force sensors positioned at a respective corner of the first plate, and a second set of force sensors, with each of the second set of force sensors positioned at a respective corner of the second plate. In such implementations, the method may further include measuring forces from at least one of the first set of force sensors and the second set of force sensors to determine a force distribution on at least one of the first plate and the second plate, respectively.

In still other implementations the method further includes measuring, at the controller, one or more sensed parameters comprising a load on the motor, a cable speed, a force direction, a user position, and time. In such methods, actuating the motor is further in response to the sensed parameter. Such methods may further include transmitting, from the controller to a remote computing device, exercise data based, at least in part, on the sensed parameter.

In yet another aspect of the present disclosure an exercise system is provided. The exercise system includes an elevated platform, a motor disposed under the elevated platform, and a cable coupled to the motor. The system further includes one or more sensors configured to measure one or more sensed parameters including forces applied to the elevated platform resulting from a user manipulating the cable while in contact with the elevated platform. The system also includes a controller communicatively coupled to each of the motor and the one or more sensors to actuate the motor to vary force on the cable provided by the motor in response to the sensed parameters.

In certain implementations, the controller is configured to transmit exercise data based at least in part on the sensed parameters to a display device communicatively coupled to the controller.

In other implementations the controller may be further configured to actuate the motor to vary the force on the cable based on an exercise parameter. For example, the controller may be configured to be communicatively coupled to a computing device and to receive the exercise parameter from the computing device.

In still other implementations the controller is further configured to transmit exercise data corresponding to the one or more sensed parameters to a remote computing device.

BRIEF DESCRIPTION OF THE DRAWINGS

Example embodiments are illustrated in referenced figures of the drawings. It is intended that the embodiments and figures disclosed herein are to be considered illustrative rather than limiting.

DETAILED DESCRIPTION

Figure 1A:
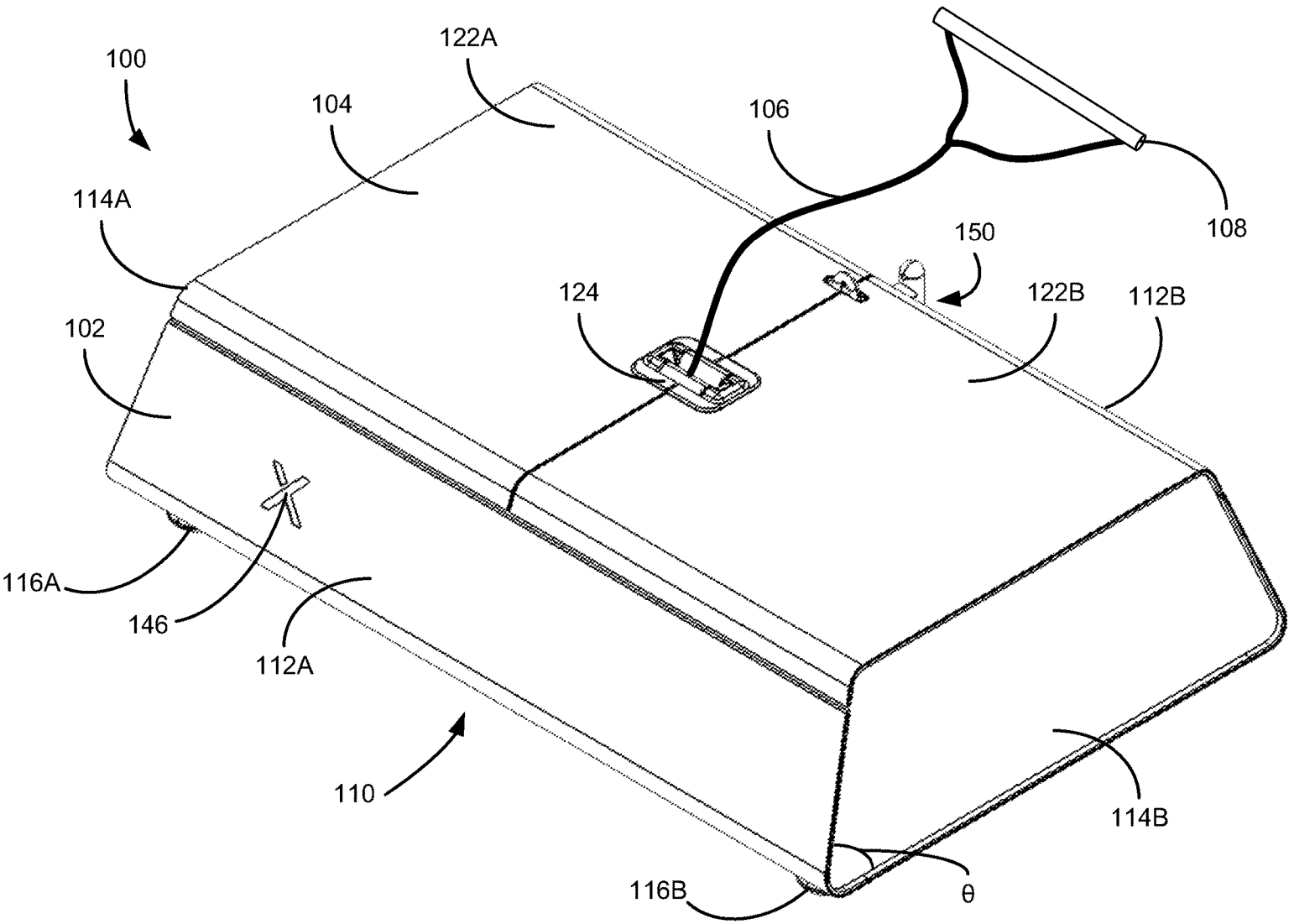
FIG. 1A is a front perspective view of an exercise platform according to the present disclosure.

The present disclosure is directed to exercise platforms for use in performing various resistance-based exercises. In implementations of the present disclosure, resistance is provided by a dynamic force module disposed within the exercise platform. A cable ending in a grip or similar handle is coupled to the dynamic force module and extends through a top surface of the exercise platform. During operation, an actuator (e.g., a motor) of the dynamic force module is used to control the rate at which the cable is extended or retracted against movement of a user, thereby creating the resistance for the given exercise. So, for example, in an exercise including a concentric phase in which the cable is extended, the motor of the dynamic force module will actively retract the cable at some rate that the user must overcome in order to extend the cable out. The eccentric phase of the same exercise may require the cable to be retracted. Accordingly, during the eccentric phase, the user must generally resist retraction of the cable to slow the retraction of the cable. Moreover, the module may be controlled dynamically to provide variations in the force while the cable is being pulled by the user or the cable is being retracted against the force of the user. Accordingly, the dynamic force module replaces and enhances the functionality of weights, bands, and other conventional resistance elements in exercise equipment.

Although exercise platforms according to the present disclosure may be used as a replacement for more conventional resistance and weight devices, the dynamic force module may be actively controlled to provide greater variety and flexibility with respect to a user's workout. For example, the dynamic force module may execute a force profile that varies resistance over a given range of motion (e.g., applying a different resistance during the concentric versus eccentric phase of an exercise). Moreover, the platform and module may be integrated with or otherwise used in conjunction with other devices to extend the types of exercises that may be performed.

Exercise platforms in accordance with the present disclosure generally include a base within which the dynamic force module is disposed and a top through which a cable coupled to the dynamic force module extends. The exercise platforms further include one or more sensors for measuring a force applied to the top of the exercise platform during performance of an exercise. In one specific implementation, multiple compression-type load cells are disposed between the top and the base such that as a user performs an exercise while at least partially supported by the exercise platform, the load cells measure the resulting force. The measured force is then used as feedback to control the dynamic force module.

In addition to providing feedback to control the dynamic force module, the exercise platform may also be used for other purposes including, without limitation: (a) monitoring changes to the center of pressure during an exercise to monitor and/or provide feedback on a user's form; (b) weighing the user; (c) counting and quantify calisthenics, plyometric, or similar exercises such as pushups, box jumps, bodyweight squats, running in place, etc. that may be performed while at least partially supported by the exercise platform; (d) acting as a form of input or controller for gamified workout programming; (e) monitoring a user's balance during balance-based exercises (e.g., yoga, physiotherapy exercises, etc.); (f) acting as a force plate for medical or other diagnostic purposes; and (g) observing a user's foot positioning during exercises.

The exercise platform may include or be communicably coupled with various devices for controlling the exercise platform and providing feedback to a user. For example, the exercise platform force module may be communicatively coupled to a computing device, such as a smartphone, tablet, laptop, smart television, and the like to present information to the user and to enable the user to select a workout and/or exercise, adjust exercise parameters (e.g., a range of motion of the exercise, a speed of the exercise, a load, or any other similar parameter defining how an exercise is to be performed), view historical data, and the like. In certain implementations, such computing devices may also facilitate streaming of video or other multimedia content (e.g., classes) to guide a user's exercise. In still other implementations, the exercise platform may be used in conjunction with a gaming platform or other computing device capable of running games or similar interactive software. Such interactive software may be used to track a user's progress, compete against other users, and the like.

Exercise platforms in accordance with this disclosure may be communicatively coupled to each other and to other computing devices over a network, such as the Internet. In one implementation, a cloud-based computing platform may interact with dynamic force modules and user computing devices to, among other things, distribute force profiles, store and update user information, and present tracking information to users and personnel such as gym facility managers, personal trainers, physiotherapists, and others who may be working with a user. The cloud-based computing platform further enables the generation, updating, and storage of content for use with dynamic force modules including, but not limited to, force profiles, workout plans, multimedia content, and the like.

The foregoing discussion merely introduces some of the broader concepts associated with exercise platforms in accordance with this disclosure and is merely intended to provide introductory context for the remainder of this disclosure. In general, this disclosure provides a description of the construction of exercise platforms and various mechanical components and features of such exercise platforms. The electrical and control aspects of such exercise platforms are then provided. The disclosure further provides a description of a broader network-based computing system for managing, operating, and providing enhanced features of the exercise platforms.

Figure 1B:
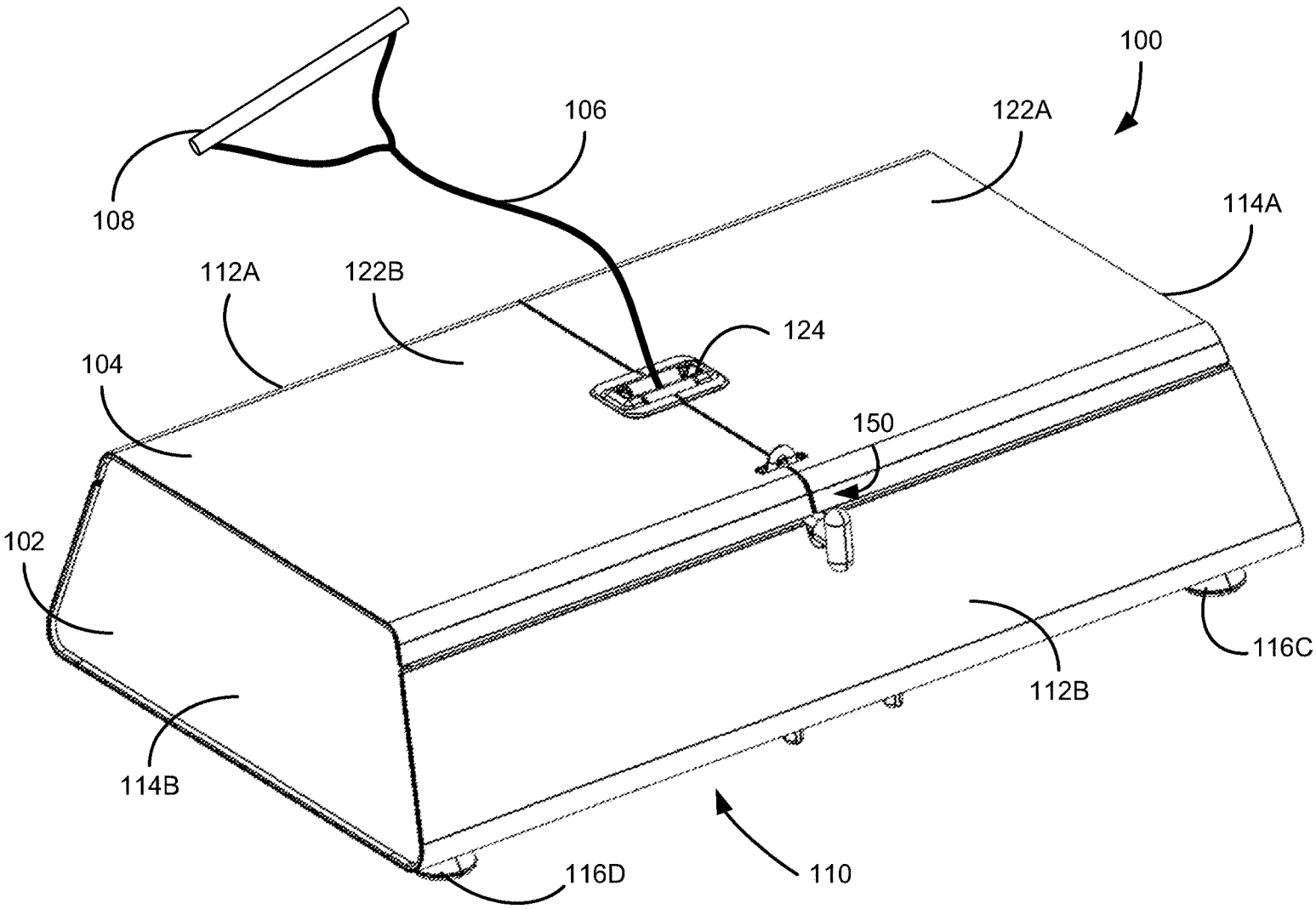
FIG. 1B is a rear perspective view of the exercise platform of FIG. 1A.
Figure 1C:
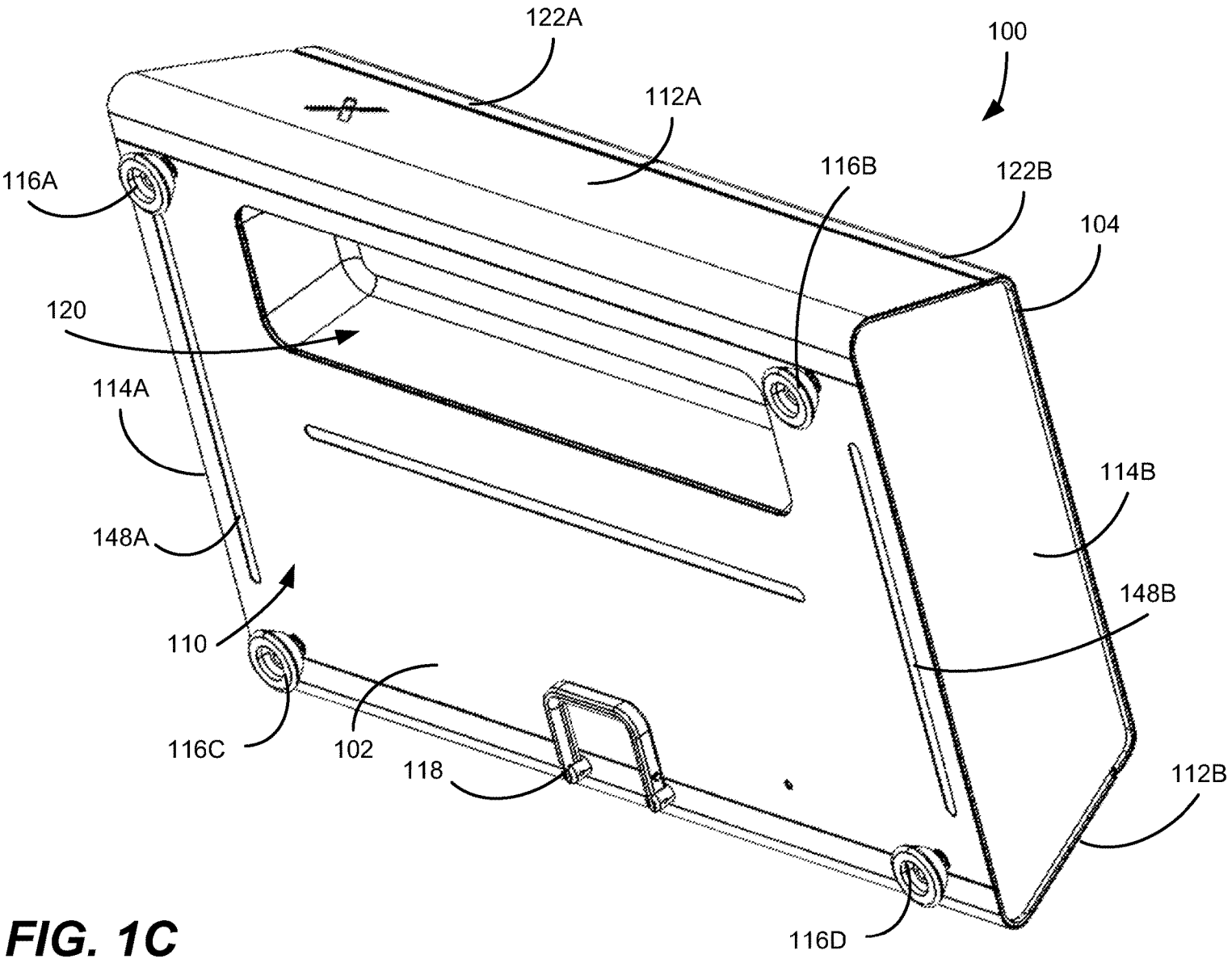
FIG. 1C is a bottom perspective view of the exercise platform of FIG. 1A.

FIGS. 1A-1C are schematic illustrations of an exercise platform 100 according to the present disclosure. As illustrated, the exercise platform 100 generally includes a base 102 having a top 104 through which a cable 106 extends. As illustrated in FIGS. 1A and 1B, the cable 106 may terminate in a handle 108; however, in other implementations, the cable 106 may terminate in any of a strap, grip, belt, or similar component. Moreover, the cable may be coupled with another device. Further reference in the following discussion is made to FIG. 2, which is a schematic illustration of the exercise platform 100 being used by a user 10, FIG. 3, which is a cross-sectional view of the exercise platform 100.

Figure 2:
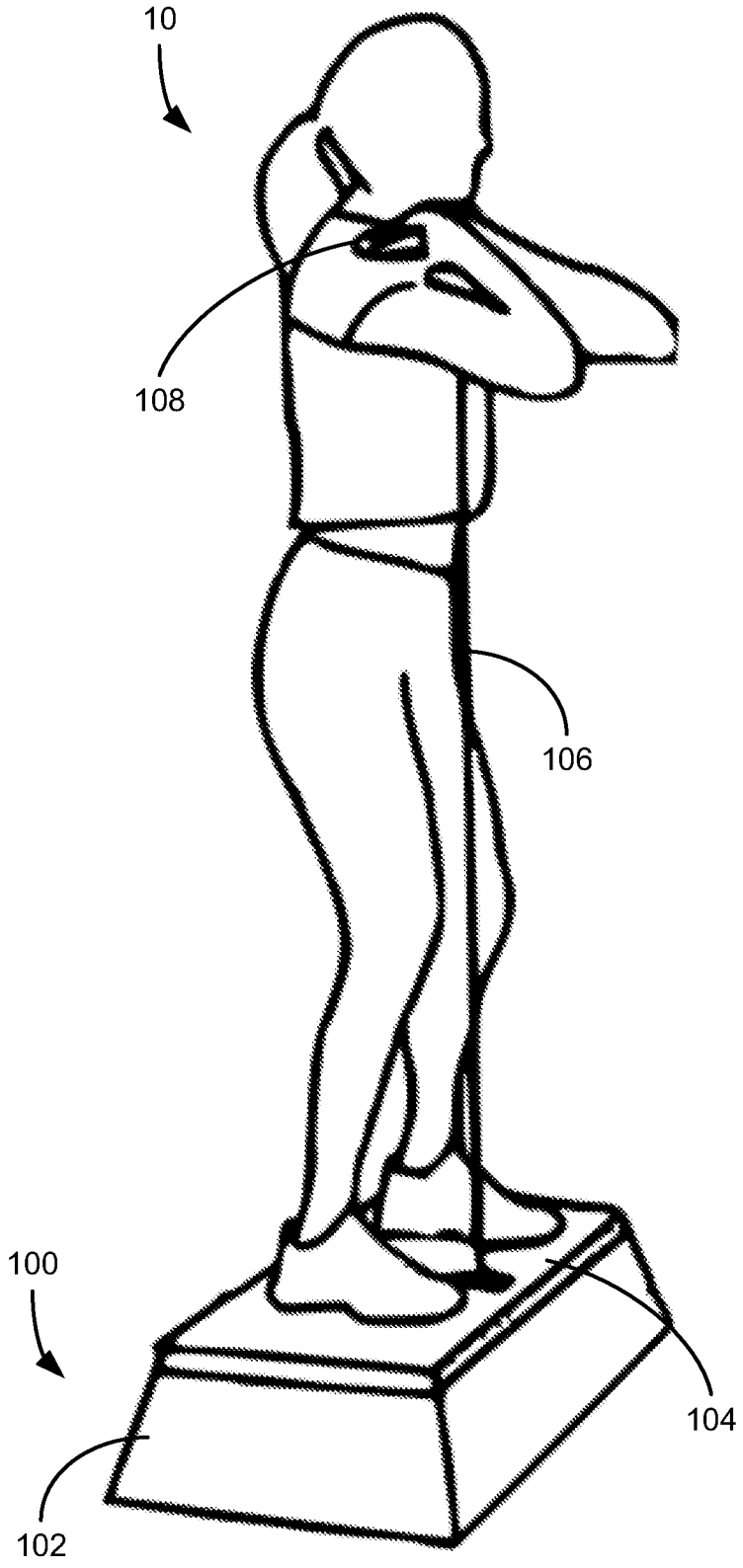
FIG. 2 is an environmental view of an exercise platform in accordance with the present disclosure during performance of an exercise by a user.
Figure 3:
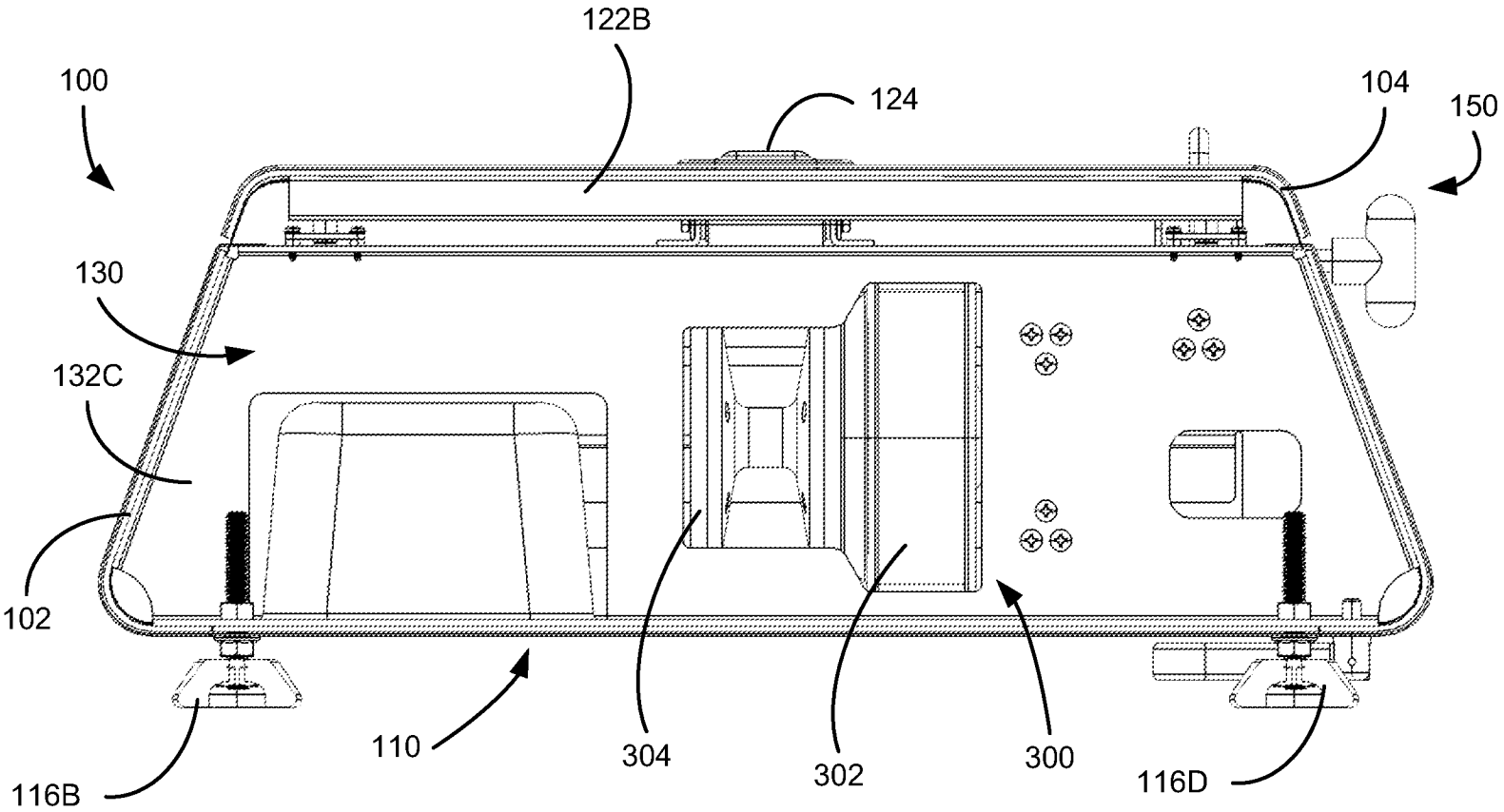
FIG. 3 is a cross-sectional view of the exercise platform of FIG. 1A.

As shown in FIG. 2, during operation a user 10 may grasp the handle 108 to perform various exercises. In general, a given exercise includes pulling the cable, e.g., by pulling on the handle, against the force from the motor or countering the force of the cable being retracted. As discussed below in further detail, such force is provided by a dynamic force module 300 (shown in FIG. 3) disposed within the exercise platform 100 to which the cable 106 is coupled. The dynamic force module 300 generally includes a computer controller actuator, such as a motor 302, coupled to a spool 304 about which the cable 106 is wrapped. During operation, the motor 302 may be actuated to selectively spool or unspool the cable 106 to provide static (e.g., a constant force through the stroke of movement) and/or dynamic (e.g., a varying force through the stroke of movement) force for use in performing different exercises. In other words, the dynamic force module 300 generally provides force by either resisting extension of the cable 106 by the user 10 (e.g., during the concentric portion of a bicep curl), retracting the cable 106 against the user 10 (e.g., during the eccentric portion of a bicep curl), or maintaining a particular tension on the cable 106 (e.g., during an isometric hold). In any given exercise, the dynamic force module 300 may provide force in one or more of these ways. Moreover, as further discussed below, the amount of force provided during a given motion of the exercise may also vary dynamically over the course of the motion.

FIG. 2 shows the user 10 standing on the top 104 of the exercise platform 100 while performing an exercise. As discussed below in further detail, the exercise platform 100 generally includes force sensors for measuring force applied to the top 104. Such forces are then used to provide feedback to and control the dynamic force module, among other things. For example, the force measurements obtained from the sensors may be used to determine a total force/weight applied to the top 104 such that by subtracting the weight of the user 10 and accounting for any directionality in the applied force, a tension/resistance on the cable 106 may be determined. In certain implementations, to determine the direction of the applied force the exercise platform 100 includes multiple force sensors distributed across plates (e.g., a left plate and a right plate) of the top 104 such that a direction of the applied force may also be determined. Alternatively, tension/resistance on the cable 106 may be determined, at least in part, through calibration of the motor and measurement of various motor parameters during use.

Referring back to FIGS. 1A-1C, in at least certain implementations, the exercise platform 100 is in the form of a step having an overall trapezoidal shape. More specifically, the exercise platform 100 includes a lower portion 110 of the base 102 having a larger area than the area of the top 104, the lower portion 110 providing overall stability for the exercise platform 100. The exercise platform 100 may further include each of front and back walls 112A, 112B and lateral sidewalls 114A, 114B. Because of the difference in area of the lower portion 110 and top 104, the front and back walls 112A, 112B may be angled. The angle (θ, shown in FIG. 1A) of the sidewalls 114A, 114B may vary, however, in at least certain implementations, θ may be from and including about 45 degrees to and including about 80 degrees to facilitate rowing exercises. In certain other implementations, θ may be up to and including about 90 degrees such that the exercise platform 100 may sit flush with or integrate with other equipment or exercise platforms. The overall height of the exercise platform 100 may also vary; however, in at least certain implementations, the overall height of the exercise platform 100 is from and including about 6 inches to and including about 10 inches, including about 8 inches. As most clearly visible in FIG. 1C, the exercise platform 100 may also include multiple adjustable feet 116A-116D that may be used to adjust the overall height of the exercise platform 100 or to fine tune the height of different portions of the exercise platform 100 to enhance stability depending on the floor surface. The feet 116A-116D may also include features for rigidly mounting the exercise platform 100 to the wall or floors. Such mounting may, for example, enable the exercise platform 100 to be used for exercises during which the user is not standing on or otherwise applying downward force on the exercise platform 100.

The exercise platform 100 may further include one or more handles to facilitate movement of the exercise platform 100. For example, as shown in FIG. 1C, in at least certain implementations a movable handle 118 may be disposed on an underside of the exercise platform 100 and may be movable between a first position in which the handle 118 is substantially tucked under the exercise platform 100 and a second position in which the handle 118 protrudes from the bottom of the exercise platform 100, enabling carrying of the exercise platform 100 in a suitcase-like fashion. In other implementations, one or both of the lateral sidewalls 114A, 114B may include handles (e.g., pivotally connected the sidewalls, telescoping form the sidewalls, or integrated recesses in the sidewall) to enable lifting of their respective end of the exercise platform 100. In such implementations, the underside of the exercise platform 100 may include rollers instead of the adjustable feet 116A-D (or positioned adjacent the adjustable feet 116A-D) opposite the sidewall 114A, 114B including the handle.

As further illustrated in FIG. 1C, the bottom of the exercise platform 100 may include a storage area 120. The storage area 120 is a defined volume within the base 102 of the exercise platform 100 within which items may be placed. In certain implementations, a separate container may be inserted into the storage area 120. In others, the storage area 120 may be covered by a cap or lid to form a container. It should be appreciated, however, that the storage area 120 illustrated in FIG. 1C is one example of a storage area that may be included. More generally, any suitable accessible volume within the exercise platform 100 may be used for storage.

Referring back to FIGS. 1A and 1B, the top 104 of the exercise platform 100 may be divided into multiple plates or panels. For example, while any number of independent force plates may be used, the exercise platform 100 includes two top plates 122A, 122B, which generally correspond to a left top plate and a right top plate with forces applied to each plate being independently measureable. Such multiple plate configurations may be used, for example, to independently measure forces applied by the left foot and the right foot of the user. Each top plate 122A, 122B may also include force sensors configured to measure a distribution of forces on the top plates 122A, 122B. For example, each top plate 122A, 122B may include or be coupled to multiple force sensors configured to measure not only the total force applied to each plate but also fore/aft and/or lateral force distributions. Such additional force measurements enable the exercise platform 100 to determine, among other things, whether a user is imbalanced, whether a user is favoring one side of their body, whether a user is performing unilateral exercises correctly, whether a user is applying proper weight to the heel versus toe, etc. The force sensors may also provide signals that may be used to count repetitions of various possible movements.

Figure 4:
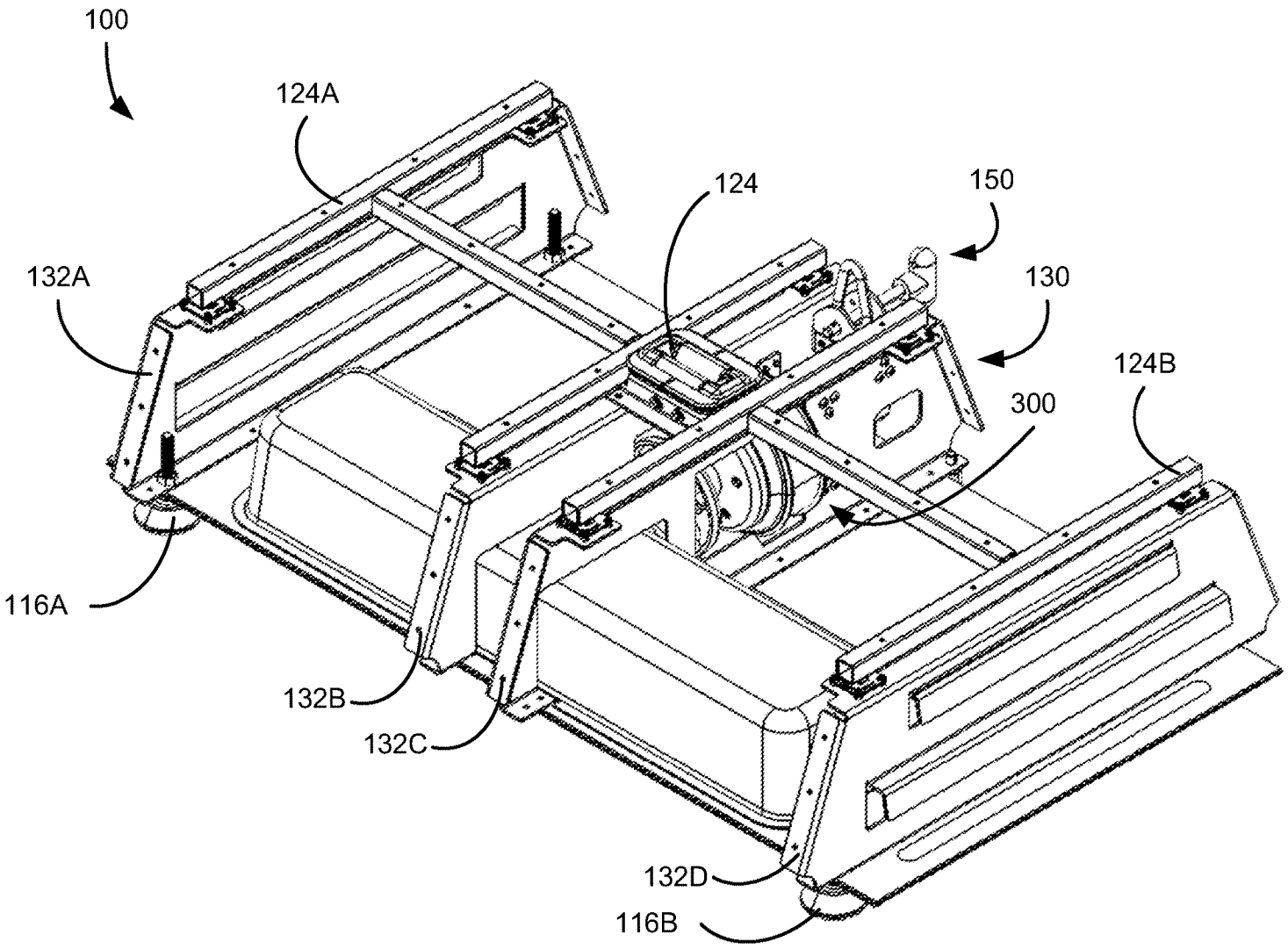
FIG. 4 is a perspective view of the exercise platform of FIG. 1A with its outer covering removed.
Figure 5:
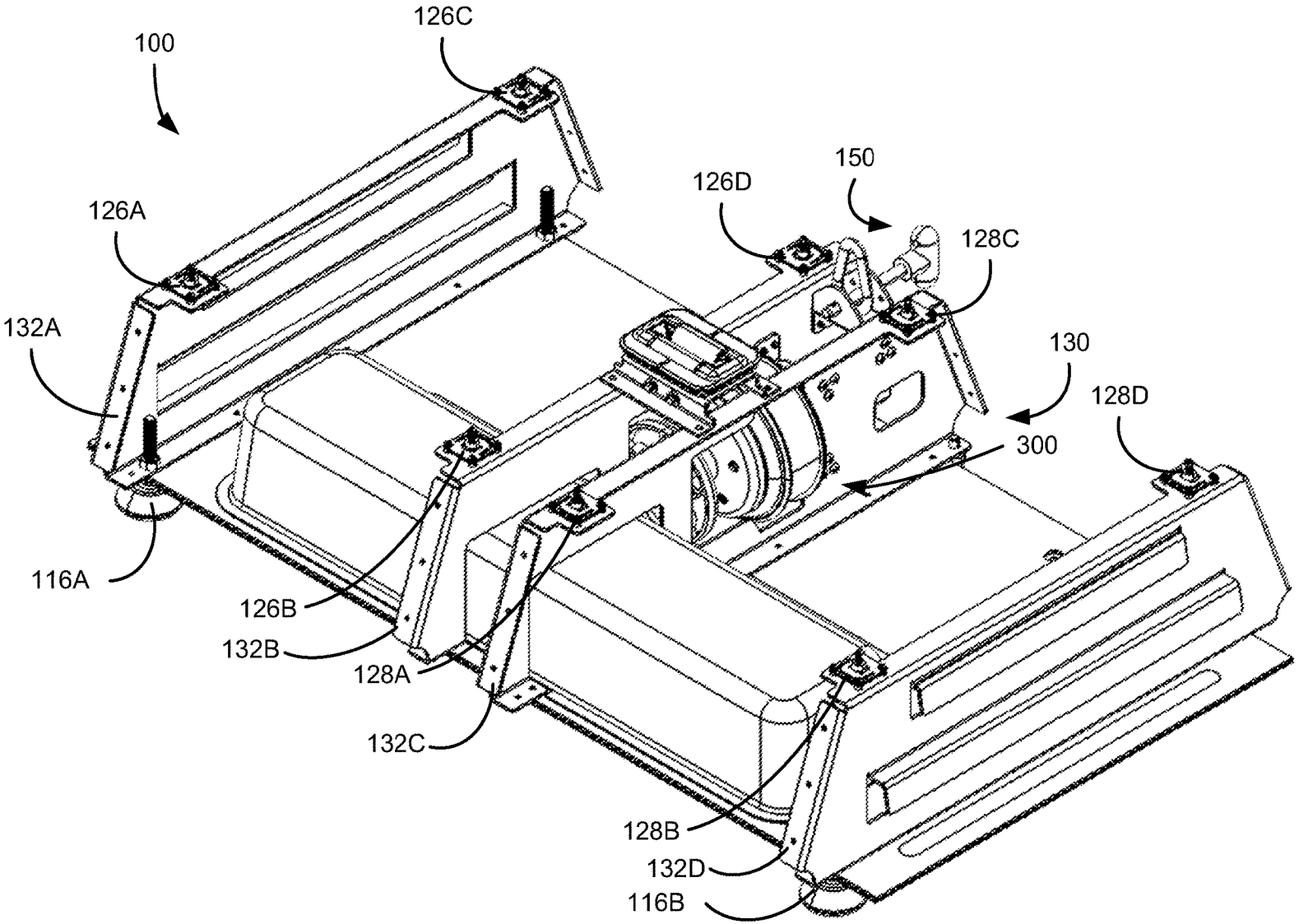
FIG. 5 is a perspective view of the exercise platform of FIG. 1A with both its outer covering and select internal structures removed.

FIGS. 4 and 5 are isometric views of the exercise platform 100 of FIG. 1 with the outer covering/shell removed to better illustrate one implementation of the internal structure of the exercise platform 100. As shown in FIG. 4, each of the top plates 122A, 122B includes a respective frame 124A, 124B. Each frame 124A, 124B is in turn supported by/floats on respective sets of force sensors. For example, as illustrated in FIGS. 4 and 5, each top panel 122A, 122B is supported by a respective H-shaped frame 124A, 124B that rests on respective sets of four compressive load sensors 126A-D, 128A-D (shown in FIG. 5) distributed such that each load cell is located at a respective corner of the frames 124A, 124B. Such configurations enable measurement of not only the total force applied to each of the top plates 122A, 122B but also force distributions in both the fore/aft and lateral directions on each plate.

Each of the compressive load sensors 126A-D, 128A-D may in turn be coupled to and supported by an internal support structure disposed within the base 102 of the exercise platform 100, which further provides overall strength to the exercise platform 100. For example, each of FIGS. 4 and 5 depict an internal support structure 130 (or frame) that includes multiple web structures 132A-D, each of which supports a respective pair of the compressive load sensors 126A-D, 128A-D. A pair of web structures (e.g., 132A and 132B) form opposing sidewalls supporting one of the plates (e.g., 122A), which spans between each member of the pair.

Figure 6:
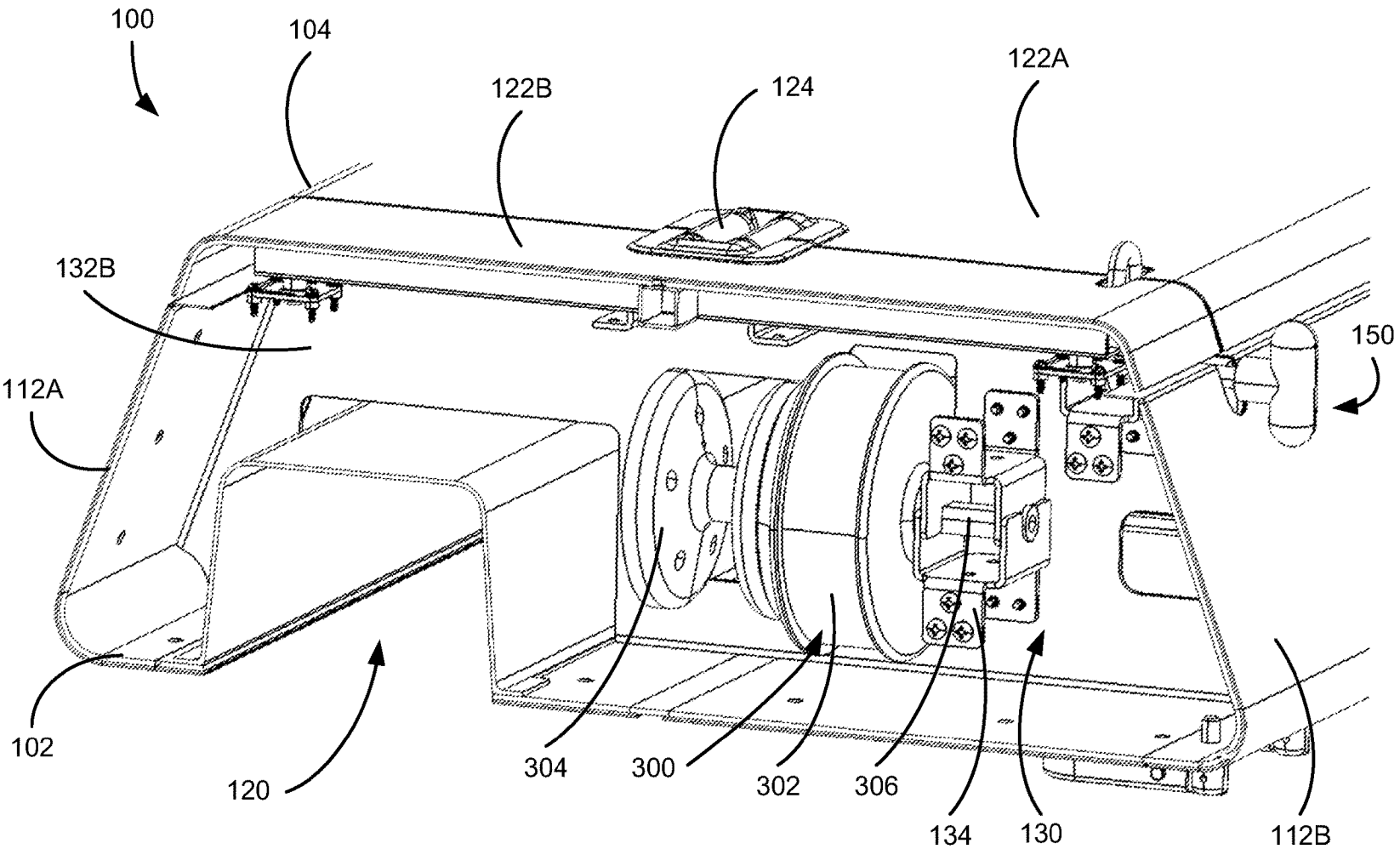
FIG. 6 is a perspective cross-sectional view of the exercise platform of FIG. 1A illustrating mounting of a dynamic force module therein.

In the illustrated implementation, the dynamic force module is coupled with the frame and positioned between the innermost webs 132B, 132C, supporting the adjacent inside edges of each respective plate. FIG. 6 is a cross-sectional perspective view of the exercise platform 100 with the web 132C removed. As shown, the dynamic force module 300 is supported within the base 102 by a support bracket 134 extending between and coupled to each of the webs 132B, 132C. Although other arrangements are possible, in the specific mounting arrangement illustrated in FIG. 6 a support post 306 extends from the motor 302 and is received by the support bracket 134 such that the motor 302 and the spool 304 are cantilevered. In such an arrangement, sensors (e.g., strain gauges, not shown) may also be applied to any of the support post 306 and the support bracket 134 to provide an additional indication of force applied by a user during operation of the exercise platform 100. In other implementations, the motor 302 and the spool 304 may be coupled to the support bracket 134 in a non-cantilevered manner.

During operation, the dynamic force module 300 is controlled based, at least in part, on force measurements obtained from the various sensors of the exercise platform 100. For example, as mentioned above, such force measurements may be obtained from the compressive load sensors 126A-D, 128A-D coupled to the plates 122A, 122B. The force measurements obtained from the compressive load sensors 126A-D, 128A-D may be supplemented by force measurements obtained from the motor 302, such as from a current sensor of the motor.

Figure 7:
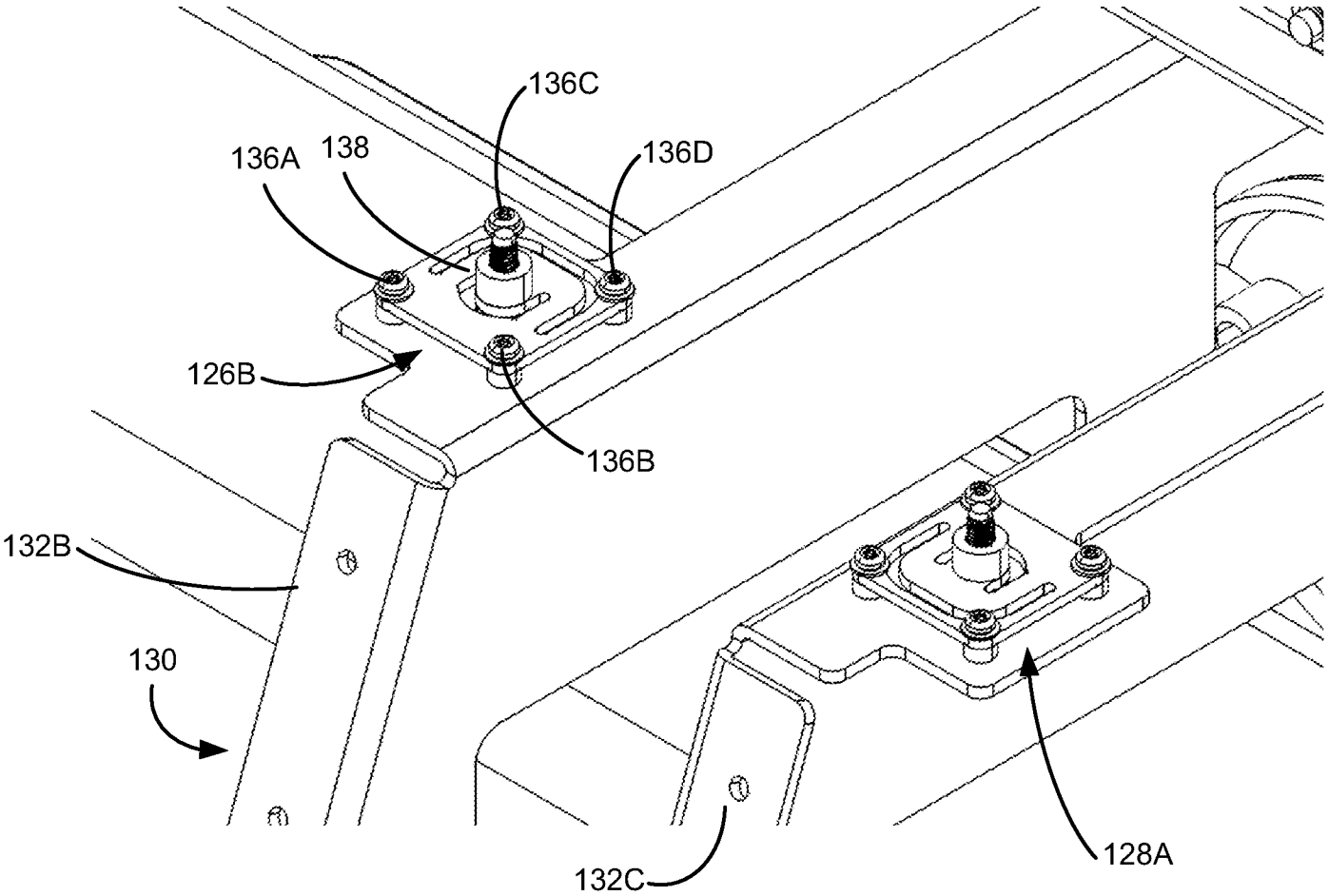
FIG. 7 is a detailed perspective of load cells of the exercise platform of FIG. 1A.

FIG. 7 is a detailed view of compressive load sensors 126B and 128A, which are disposed along a top flanged edge of web structures 132B and 132C, respectively, and positioned at respective corners to the respective plates. Referring to the compressive load sensor 126A as exemplary, the compressive load sensor 126A is fixed to the web 132B (e.g., by one or more bolts 136), but includes a flexible or floating member 138 that is coupled to the frame 124A and from which strain or force measurements may be obtained as the member 138 deflects under load. Alternatively, the compressive load sensor 126B may be arranged such that it is fixed to the frame 124A with the flexible member 138 instead coupled to the web 132B.

It should be appreciated the foregoing discussion regarding the general structure of the exercise platform 100 should be regarded as a non-limiting example implementation of the present disclosure and other implementations are contemplated herein. Among other things, the number, location, size, and arrangement of the top plates 122A, 122B and corresponding support structure may vary. For example, the exercise platform may include any suitable number of top plates (including only one), each of which may vary in size and shape. Similarly, the location and arrangement of the compressive load sensors 126A-D, 128A-D may also vary. For example, as few as one force sensor may be used to measure force applied to any given top plate although, as previously noted, multiple force sensors provide the advantage of being able to measure force distribution across a given plate.

As previously noted, the illustrated implementation includes two sets of compressive load sensors 126A-D and 128A-D, each of which is positioned at a respective corner of the plates 122A, 122B. Such an arrangement provides at least two advantages. First, because the plates 122A, 122B are independent of each other, the forces applied to each plate during an exercise may be measured independently. So, for example, a user may perform a squat with one foot on the left plate 122A and one foot on the right plate 122B or a pushup with one hand on the left plate 122A and one foot on the right plate 122B. During the course of either exercise, the exercise platform may measure the forces applied to each of the left plate 122A and one foot on the right plate 122B and provide feedback regarding whether the user is applying force equally to each plate 122A, 122B (i.e., with each of their legs and arms, respectively), or if the user is favoring one side or the other.

A second advantage to the force sensor arrangement of the illustrated implementation is that by distributing multiple force sensors about the plates 122A, 122B, a force distribution on each plate may be measured. For example, referring to the left side of the exercise platform 100, each of the compressive load sensors 126A-126D is positioned at a respective corner of the plate 122A. As a user performs an exercise, the force measurements obtained from each of the compressive load sensors 126A-126D will differ based on how the user is transferring force to the plate 122A. During a squat with the user's foot approximately centered on the plate 122A, for example, the force measurements obtained from the compressive load sensors 126A-126D will vary based on what part of the foot the user is using to push against the exercise platform 100. During the concentric phase, proper squat form generally requires that the heel remain in contact with the ground and that a significant portion of force be transferred through the heel. Accordingly, when a user is performing a squat, the exercise platform 100 can measure forces applied to each of the compressive load sensors 126A-126D to determine whether a user is executing the lift properly. For example, if the forces measured at the compressive load sensors 126A, 126B are below a certain threshold or are less than a predetermined proportion of the forces measured at the compressive load sensors 126C, 126D, the exercise platform may provide feedback to the user indicating that the user is lifting or otherwise improperly loading their heels. A similar approach may be used to determine whether the user is applying excessive force using the outside of their foot (e.g., as measured by compressive load sensors 126A and 126C) as compared to the inside of the foot (e.g., as measured by compressive load sensors 126B and 126D). It should be appreciated that this approach may be used to provide similar feedback regarding how forces are being generated and applied by the user during a wide range of exercises beyond squats.

Referring back to FIG. 1A, to facilitate movement of the cable 106, a fairlead 124 or similar guiding structure may be disposed in the top 104 of the exercise platform 100 with the cable 106 run through the fairlead 124. The fairlead may take various forms, however, in at least some implementations, the fairlead 124 is an omnidirectional fairlead specifically configured to reduce friction and guide the cable 106 regardless of which direction the cable 106 is pulled by the user 10 or retracted by the dynamic force module 300.

Figure 8A:
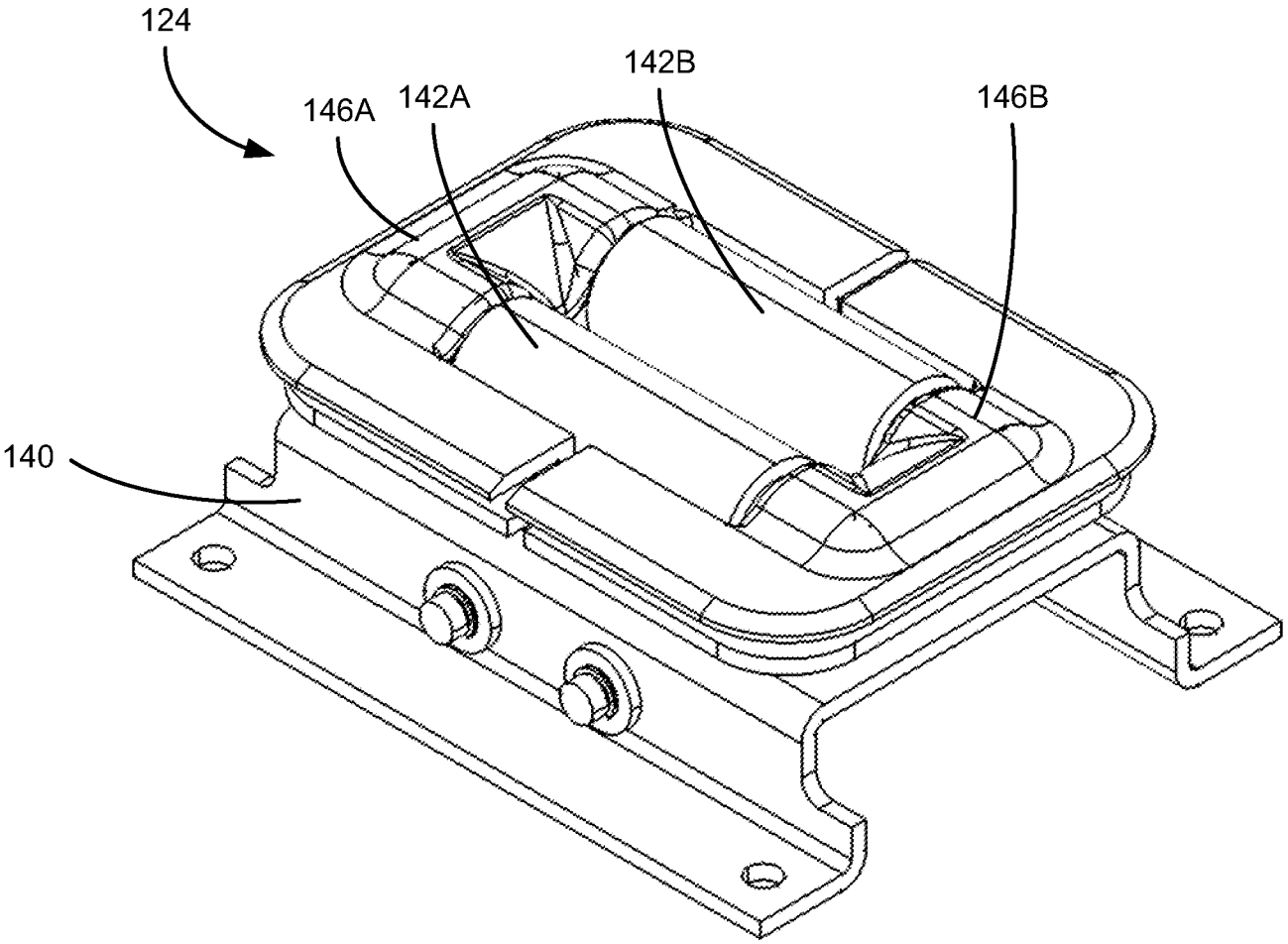
FIGS. 8A-8C are perspective, top, and bottom views, respectively of a fairlead of the exercise platform of FIG. 1A.
Figure 8B:
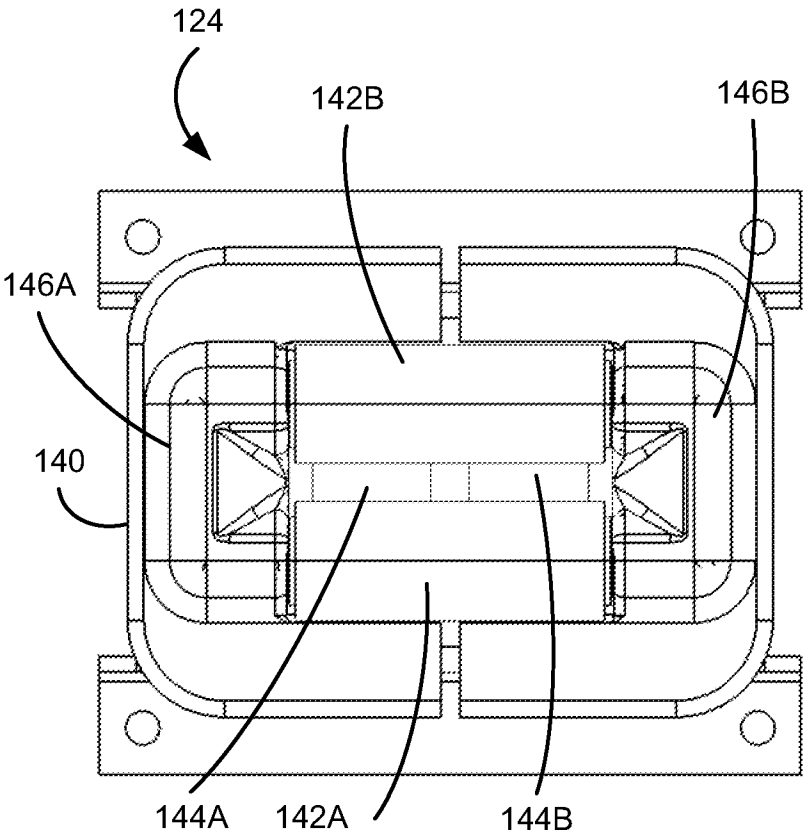
Figure 8C:
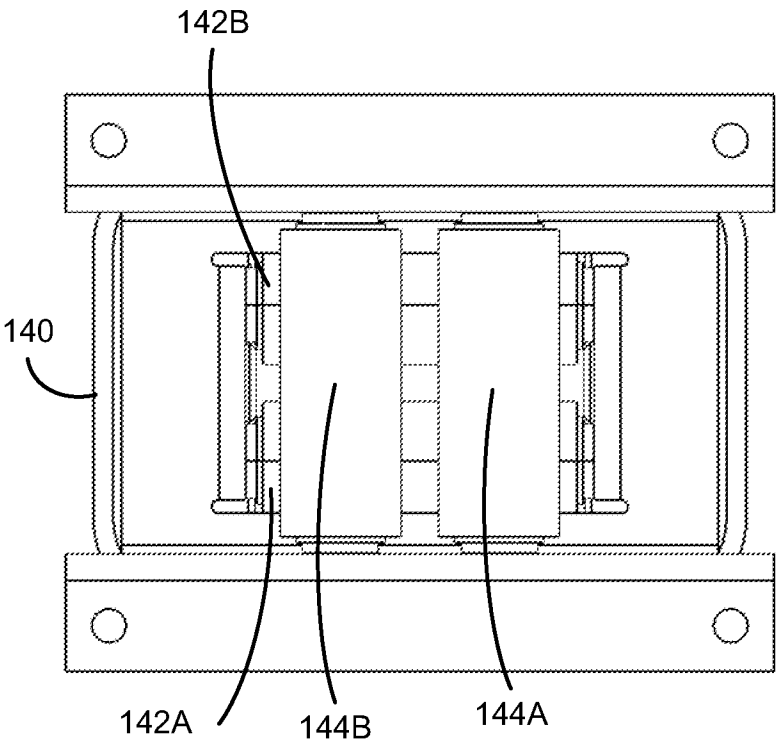

FIGS. 8A-8C are isometric, top, and bottom views, respectively, of the omnidirectional fairlead 124. As shown, the fairlead 124 generally includes a fairlead body 140 that supports bearings that direct and reduce friction of the cable 106 as the cable 106 is extended and retracted through the fairlead 124. In the specific implementation of FIGS. 8A-8C, the bearings are in the form of a first pair of rollers 142A, 142B and a second pair of rollers 144A, 144B disposed below and oriented perpendicular to the first pair of rollers 142A, 142B. Curved flanges or bezels 146A, 146B may also be disposed at opposite ends of the first pair of rollers 142A, 142B to provide a smooth surface against which the cable 106 may travel when pulled or retracted in a partially lateral direction. Each roller of each pair is spaced from the other roller of the pair to receive the cable therebetween, the perpendicular pairs defining a square shaped opening between the four rollers to receive the cable. It is possible to use fixed cylindrical members in place of the rollers or to define a conical opening through which the cable passes, or simply a smooth hole. The use of rollers, however, provide less friction force than non-roller alternatives particularly when the cable is being withdrawn at any angle outside of vertical and thus in contact with at least one of the rollers.

As illustrated in FIG. 5, the fairlead 124 may be coupled to the internal support structure 130 (more specifically to the webs 130B, 130C) above the spool 304 of the dynamic force module 300. As shown, the fairlead 124 is installed such that the first pair of rollers 142A, 142B extend laterally; however, in other implementations, the fairlead body 140 may instead be configured such that, when the fairlead 124 is coupled to the internal support structure 130, the first pair of rollers 142A, 142B extend in a fore/aft direction instead (i.e., 90 degrees offset from the orientation illustrated in FIG. 5). In certain implementations, the rollers 142A, 142B of the fairlead 124 are positioned and sized such that when the exercise platform 100 is assembled, the rollers 142A, 142B at least partially protrude from the top 104 (e.g., as visible in FIG. 3), thereby reducing contact between the cable 106 and the top surface during exercises.

Figure 9:
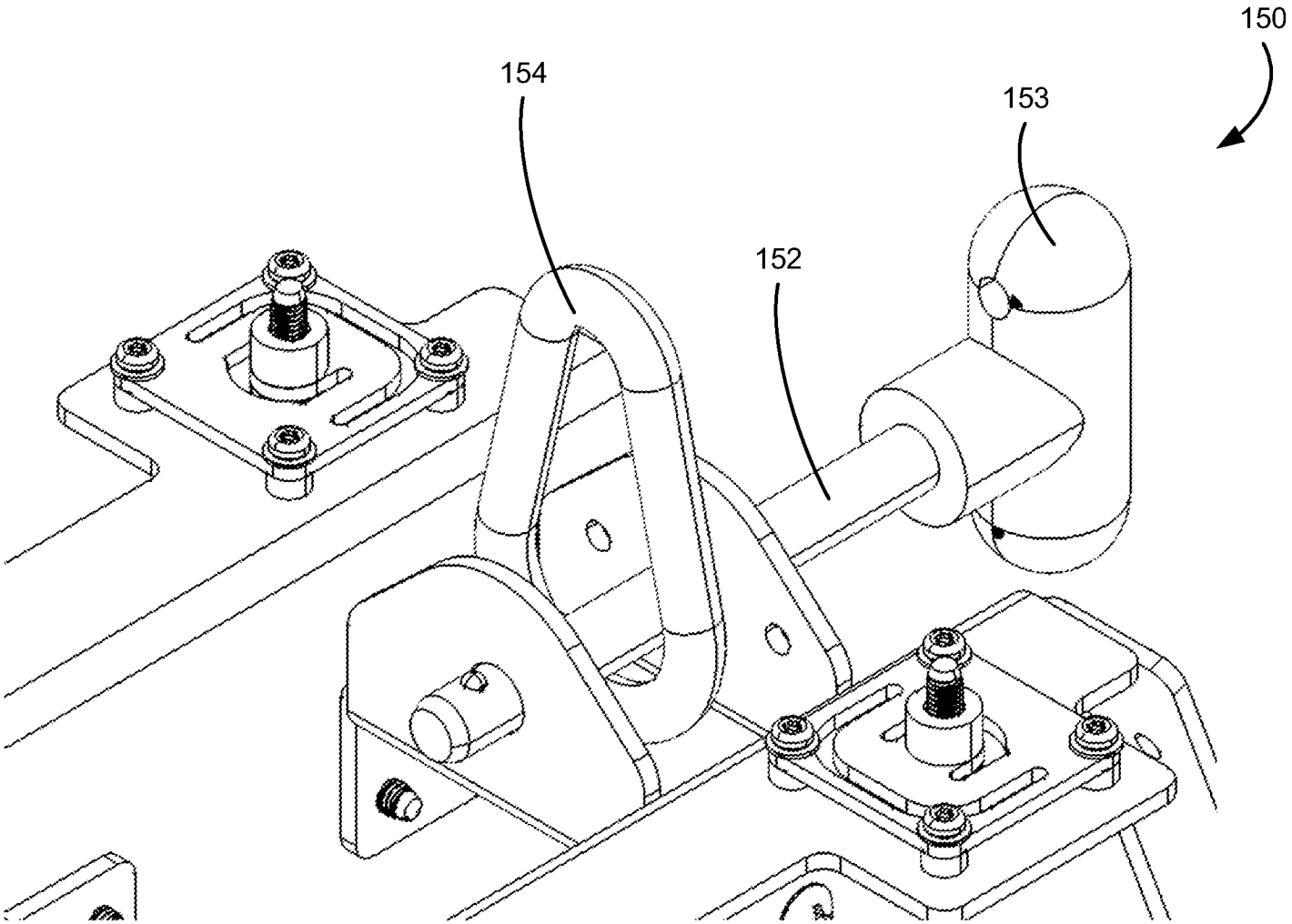
FIG. 9 is a detailed perspective view of a force multiplying structure of the exercise platform of FIG. 1A.
Figure 10:
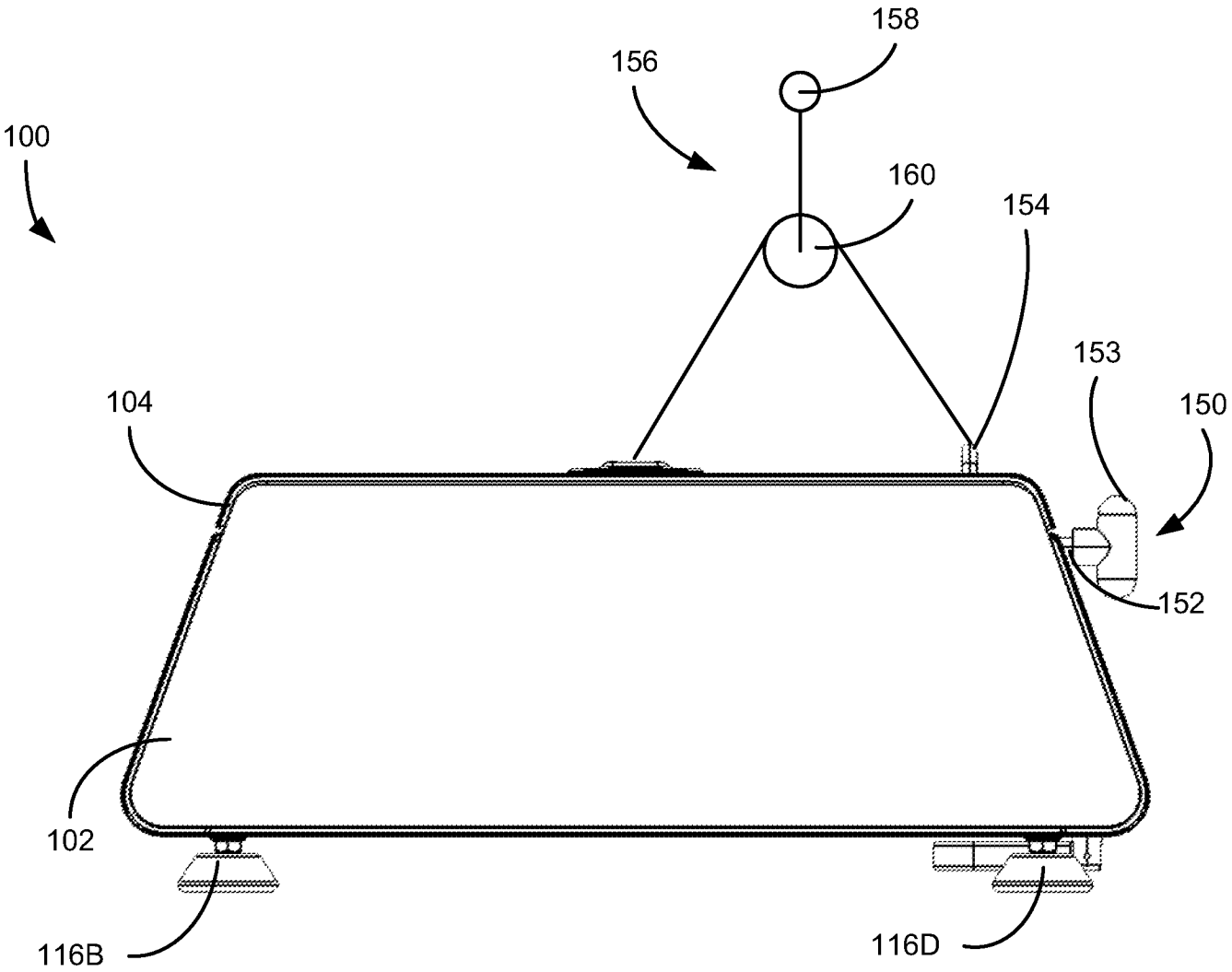
FIG. 10 is a side view of the exercise platform of FIG. 1A illustrating routing of a cable during use of the force multiplying structure illustrated in FIG. 9.

FIGS. 9 and 10 illustrate a force multiplying feature 150 configured to increase the maximum resistance that may be provided by the dynamic force module 300 during use of the exercise platform 100. Referring to FIG. 9, a detailed perspective view of the force multiplying feature is provided. In general, the force multiplying feature provides a location to which the cable 106 may be coupled or about which the cable 106 may be routed. As described below, such fixation allows a handle assembly to couple to or otherwise receive an intermediate portion of the cable disposed between the fairlead 124 and the force multiplying feature 150. As shown, the force multiplying feature 150 includes a pin 152 which may be inserted through or otherwise coupled to a clip 154. In certain implementations, the clip 154 may be disposed on or otherwise coupled to the end of the cable 106. Alternatively, the clip 154 may be coupleable to a corresponding clip or similar feature disposed on the end of the cable 106. As shown, the pin 152 includes a handle 153 and may be pushed into or pulled out of the base 102 to selectively retain the clip 154; however, in certain other implementations, the pin 152 may be fixed and the handle 153 may be omitted. In such implementations, the clip 154 may generally include a release mechanism adapted to disengage the clip 154 from the pin 152. In still other implementations, the force multiplying feature 150 may be in the form of a hook, eyebolt, or similar structure shaped to receive the cable 106.

FIG. 10 illustrates the force multiplying feature 150 in use. The force multiplying feature 150 is intended for use with a handle assembly 156 that includes a handle 158 coupled to a pulley 160, which in the current example is a single sheave pulley. When in use, the cable 106 is routed about the pulley 160 and coupled to the pin 152 (e.g., by the clip 154). In the configuration illustrated in FIG. 10, the pulley 160 of the handle assembly 158 functions as a movable pulley such that one unit of upward movement of the pulley 160 results in a lengthening of the cable 106 of approximately two units. Similarly, tension applied by the dynamic force module 300 to the cable 106 results in a force that is approximately double the tension on the cable 106 acting on the pulley 160. In light of the foregoing, the exercise platform 100 may be configured to operate in a force multiplying mode in which the dynamic force module 300 spools and unspools the cable 106 at a ratio relative to the movement of the user. In the example illustrated in FIG. 10, for example, the dynamic force module 300 spools and unspools the cable 106 at approximately a 2:1 ratio relative to the movement of the user.

It should be appreciated that the principles illustrated in FIG. 10 may be adapted for ruse with various pulley arrangements to achieve different force multiplying effects. For example, the single sheave pulley 160 of the handle assembly 156 may be replaced with a multi-sheave pulley and/or one or more additional fixed or movable pulleys may also be incorporated into the exercise platform 100 to further multiply the force applied to the handle assembly 156. In one specific example, the pulley 160 of the handle assembly 156 may be a dual-sheave pulley and the exercise platform 100 may include a second force multiplying feature or pulley accessory fixed to the top 104 of the exercise platform 100. By routing the cable 106 about a first of the pulley sheaves, followed by the pulley accessory coupled to the top 104 and the second pulley sheave, and then fixing the cable to pin 152, the force applied to the handle assembly 156 may be quadrupled relative to the tension applied by the dynamic force module 300. Notably, however, in such an arrangement, the dynamic force module 300 must spool or unspool the cable 106 at a ratio of approximately 4:1 relative to the movement of the handle assembly 158.

Referring back to FIGS. 1A and 1C, the exercise platform 100 may include various auxiliary systems for providing additional features. In at least certain implementations, the exercise platform 100 may include one or more lighting systems. The lighting system may be incorporated into any visible surface of the exercise platform 100. For example, as shown in FIGS. 1A and 1C, the lighting system may be integrated into a logo or design 146 disposed on one of the surfaces of the exercise platform 100. The lighting system may also include light sources disposed on the bottom of the exercise platform 100 to illuminate the floor around the exercise platform 100. For example, as shown in FIG. 1B, the exercise platform may include LED strips 148A, 148B disposed on its bottom. The LED strips may include various possible colored LEDS, which may be controlled individually or collectively.

During operation, the lighting system may be used for various purposes. For example, in one implementation, illumination of some or all of the lighting system may be used to indicate a state of the exercise platform (e.g., on/off/standby). In other implementations, the lighting system may be used to provide guidance or feedback to the user by varying the color, intensity, or other property of the lighting. Such feedback may be used to indicate whether an exercise is being performed correctly, a user's progress through a workout or set, to provide a cadence to the user, or to provide any other similar information. In one specific example, the intensity or color of light provided by the LED strips 148A, 148B (or similar lights associated with specific sides of the exercise platform 100) may be used to indicate whether a user is favoring one foot over the other or is otherwise imbalanced.

When implemented in an environment including multiple exercises, the lighting systems of exercise platforms within the environment may be synchronized or otherwise coordinated. Such coordinated lighting may be used for aesthetic or motivational purposes (e.g., to provide dynamic and colorful lighting to accompany music during a class) or to provide information to class participants including, without limitation, whether a particular exercise platform has been reserved for the class or highlighting particular participants during the class (e.g., the class leader).

While not illustrated, the exercise platform 100 may further include a speaker or other audio-based output system as well. Such an audio-based output system may be used, for example, to play music, instructional audio, or any other similar media during operation of the exercise platform 100.

Compressive load cells/sensors disposed between the top plates 122A, 122B and the base 102 are just one example approach to measuring forces applied to the exercise platform 100. In other implementations, such compressive load cells may be integrated in other locations to provide similar measurements. For example and without limitation, in at least one implementation one or more load cells may be integrated into the adjustable feet 116A-D (e.g., positioned between a foot and at outer lower end of a respective web. It should be further appreciated that compressive load cells are just one example load sensors that may be used to determine loading of the exercise platform 100. For example, in other implementations, loading of the exercise platform 100 may instead be determined based on a measured strain or deflection of the top 104. To do so, the compressive load cells may instead be substituted or supplemented with other force sensors including, without limitation, strain-sensing fabrics, capacitive strain sensors, adhesive strain sensors, or optical strain sensors, each of which are adapted to measure forces on the top 104 based on its deflection. To the extent such alternative sensors are implemented, they may be disposed on or within any suitable part of the top 104. For example, in one specific implementation, the exercise platform 100 may still include two separate top plates 122A, 122B, with each top plate including one or more strain gauges disposed at each corner in place of the compressive load cells illustrated in the foregoing examples. Accordingly, to the extent the current disclosure refers to a force sensor, it should be understood to encompass any sensor suitable for measuring a force applied to the top 104.

It should also be understood that exercise platforms according to the present disclosure are not limited to including force sensors for measuring forces in a substantially vertical direction. For example, as previously noted the sidewalls 114A, 114B may be slanted to enable a user to perform rowing exercises. In such implementations, force sensors may be integrated into the sidewalls 114A, 114B or between the sidewalls 114A, 114B and the underlying internal support structure 130 to measure forces applied by the user in a direction including horizontal components.

In at least certain implementations, the exercise platform 100 may be modular in that the top 104 is separable and independently operable from the base 102. In such implementations, the separable top 104 may include its own set of independently operable electronic components including, without limitation, its own processor, memory, wireless communication module (e.g., a Bluetooth communication module), power system (including a separate battery), and the like, such that the separable top 104 is usable when detached from the base 102.

When detached from the base 102, the separable top 104 may function as a balance board or similar device that measures forces applied to the separable top 104 using one or more force sensors integrated into the top 104. Such force sensors may include, for example, the compressive load sensors 126A-126D, 128A-128D, discussed above or may include strain gauges or other force sensors incorporated directly into the separable top 104. In the former case, the compressive load sensors 126A-126D, 128A-128D may be disposed in "feet" or similar structures of the separable top 104 that are positioned to be supported by the base 102 when the separable top 104 is coupled to the base 102. When detached from the base, the separable top 104 may be configured to remain in communication with the base 102 and may communicate with one or more other computing devices (e.g., smartphones, tablets, fitness trackers) through the base 102. Alternatively, the separable top 104 may pair directly with the computing devices over a connection separate from that between such devices and the base 102.

When attached to the base 102, one or more electrical connectors of the separable top 104 may electrically couple with corresponding connectors of the base 102. When so coupled, data and power may be exchanged between the base 102 and the separable top 104. For example, coupling the separable top 104 to the base 102 may cause the separable top 104 to download collected data to the base 102. When connected, the separable top 104 may also recharge via the power system of the base 102.

The separable top 104 may be mechanically coupled to the base 102 in various ways. For example and without limitation, the base may include grooves, recesses, or other such structures shape to receive corresponding protrusions extending from the bottom of the separable top 104. The separable top 104 may also include magnets or fasteners positioned to align with corresponding magnets or fasteners, respectively, of the base 102 when coupled. In still other implementations, a clip, latch, or similar mechanism coupled to one of the base 102 and the separable top 104 and configured to selectively engage and disengage the other component.

While the foregoing discussion provided various details regarding the mechanical aspects of exercise platforms according to the present disclosure, the following discussion will address electrical, control, and similar elements that may be included in exercise platforms according to the present disclosure. In general, however, the exercise platforms discussed herein include dynamic force modules that are adapted to provide dynamic reactive forces based on a force profile that dictates a relationship between an operational parameter of the dynamic force module and a measured parameter associated with an exercise being performed by a user. For example, in certain implementations, the reactive force provided by the dynamic force module may vary depending on the position, speed, or acceleration applied by the user as measured by various sensors, including those integrated in the motor. In another example, the dynamic force module may operate at a nominal reactive force but may then increase or decrease the reactive force in response to the user speeding up or slowing down movement, respectively, to encourage the user to perform an exercise at an optimal speed. Other possible control mechanisms are provided in more detail below.

As previously discussed, exercise platforms in accordance with this disclosure generally measure forces using load cells, strain gauges, or similar force sensors coupled to a frame of the exercise platform. Alternatively or in addition to such sensors, loading information may also be obtained from load cells, strain gauges, or similar sensors associated with the dynamic force module (e.g., coupled to a motor or motor support of the dynamic force module) and/or sensors for measuring performance of the dynamic force module (e.g., motor current sensors). Other sensors of the dynamic force module may include, without limitation, one or more of an encoder, a potentiometer, a Hall Effect sensor, or similar sensors for counting or otherwise measuring rotations of the motor. As illustrated in FIG. 6, the dynamic force module may also include inductive or other proximity sensors for measuring the presence of the cable on the drum of the dynamic force module. Such measurements may then be converted to determine the length of cable unspooled from the dynamic force module and, as a result, the position, and speed, and/or acceleration at which the user is pulling the cable or the cable is being retracted against a force of the user against the retraction of the cable. It should be noted however, that in certain implementations, such as when a fabric or other non-metallic cable is implemented, the position of the home or starting position of the cable may be predetermined and the inductive or proximity sensors associated with the drum may be omitted. Alternatively, the home or starting position may be manually set. For example, the user may selectively extend or retract the cable (e.g., by using controls on an app or integrated into the exercise platform) until a home or starting position is reached. The user may then confirm or set the home position using the controls.

The position, speed, and/or acceleration of the user may also be determined using various sensors incorporated into the exercise platform or the dynamic force module itself. For example, in certain implementations, the exercise platform and/or dynamic force module may include one or more of potentiometers, accelerometers, encoders, switches, load cells, strain gauges, pressure pads, and other sensors for determining the position, orientation, speed, acceleration, loading, or other parameters of various components of the exercise platform and, as a result, the user.

Exercise platforms in accordance with the present disclosure may also be communicatively coupleable to a computing device, such as, without limitation, a smartphone, smartwatch, laptop, desktop, tablet, exercise tracker, server, or other such computing devices. Such computing devices may execute or otherwise provide access to an application, web portal, or other software, including those that provide access to databases and other data sources. Such computing devices generally facilitate interaction between the user and the exercise platform by enabling the user to provide commands, settings, and similar input to the exercise platform for controlling the dynamic force module and for the exercise platform to provide information and feedback to the user. For example, in certain implementations, the computing device may include a display that enables a user to select from a variety of workouts or to otherwise change settings of the exercise machine and dynamic force module. During a workout the exercise platform may communicate with the computing device such that the computing device displays, among other things, the current settings of the exercise platform, the user's progress through an exercise or workout, and other information.

During an exercise or broader workout, one or both of the exercise platform and a computing device communicatively coupled to the exercise platform may be adapted to provide feedback to a user. Such feedback may be used, for example, to provide encouragement to the user or to provide guidance on form and technique for performing an exercise. For example, the speed with which the user executes a particular movement may be tracked and various forms of audio, visual, or haptic feedback may be provided the user based on whether and to what degree the user's speed deviates from a predetermined optimal speed or speed range. In certain implementations, the frequency, intensity, or other parameter of the feedback may be varied in response to the user's deviation from an optimal value or range.

In certain implementations, exercise platforms in accordance with this disclosure provide such feedback, at least in part, through a user interface that is presented to the user via the computing device. The user interface generally includes textual, audio, speech, and/or graphical elements for guiding the user through exercises or workouts. For example, the user interface may include animated graphs or other representations for displaying a measured user parameter relative to an optimal value or optimal range for the same parameter. As the user performs a given exercise, a marker or similar representation associated with the user parameter may move to indicate the user parameter, thereby providing the user with feedback regarding the quality with which the user is performing the exercise. The user interface may also indicate, among other things, a user's progress through an exercise or workout, a score or points accumulated by the user based on successful completion of an exercise or exercises, and similar information.

Figure 11:
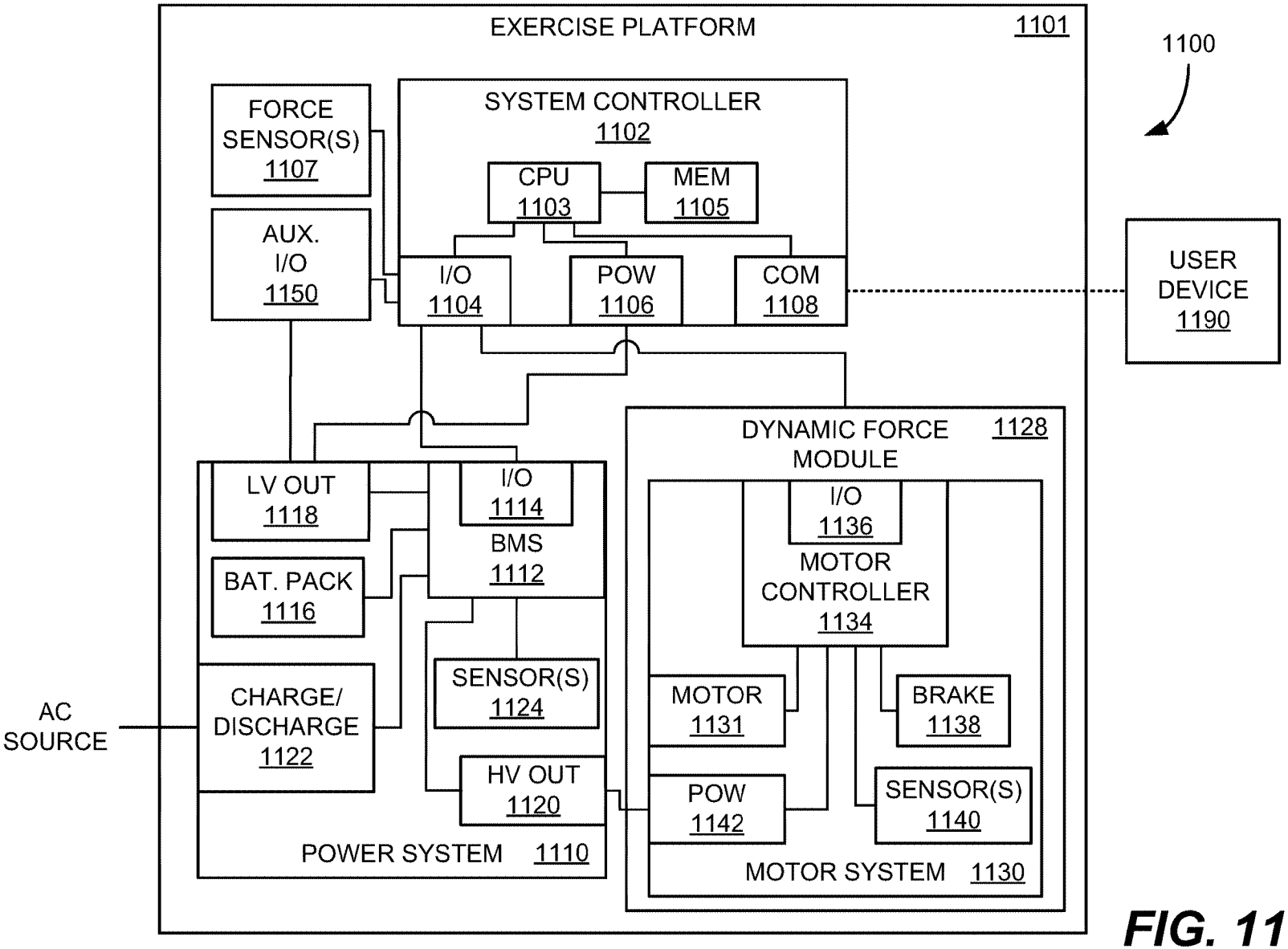
FIG. 11 is a block diagram illustrating a system including an exercise platform according to the present disclosure.

Further aspects of the dynamic force module are now provided in detail with reference to FIG. 11, which is a block diagram illustrating a system 1100 including an exercise platform 1101 within which a dynamic force module 1128 is incorporated. The exercise platform 1101 may generally correspond to the exercise platform 100 of FIGS. 1A-9B. As illustrated, the exercise platform 1101 includes a system controller 1102 for providing primary control and supervision of various components of the exercise platform 1101, including the dynamic force module 1128 and a power system 1110, each of which are communicatively coupled to the system controller 1102. As described below in more detail, the power system 1110 facilitates charging, discharging, and distribution of power for the exercise platform 1101 while the dynamic force module 1128 includes a motor system 1130 that provides control and supervision of a motor 1131. The system controller 1102 is also illustrated as being communicatively coupled to one or more force sensors 1107, for providing readings associated with forces applied to the exercise platform 1101 during performance of an exercise by a user.

The system controller 1102, includes a processor 1103 communicatively coupled to a memory 1105. Although other configurations of the system controller 1102 are possible, in general, the memory 1105 stores data and instructions executable by the processor 1103 to perform functions of the exercise platform 1101. The system controller 1102 may further include each of an input/output (I/O) module 1104, a power module 1106, and a communications module 1108.

During operation, the system controller 1102 may send and receive signals via the I/O module 1104. In particular, the system controller 1102 may receive readings and data from the force sensors 1107, the power system 1110, the dynamic force module 1128 (including the motor system 1130 thereof) and/or other sensors of the system 1100 and provide commands to direct various functions of the exercise platform 1101. For example, the system controller 1102 may provide commands to the motor system 1130 for positioning or otherwise controlling the motor 1131 in response to force readings provided by the force sensors 1107 during execution of an exercise by a user. The motor system 1130 may in turn provide sensor readings corresponding to the position and movement of the motor 1131 to the system controller 1102, thereby providing feedback to the system controller 1102. The system controller 1102 may in turn issue additional commands to components of the exercise platform 1101 based on such feedback.

The I/O module 1104 may also be configured to send to and/or receive data from one or more auxiliary inputs and outputs 1150 of the exercise platform 1101. Such auxiliary I/O 1150 may be used, for example, to provide feedback to the user or to indicate the status of the dynamic force module 1128. Regarding feedback, the auxiliary I/O may include, without limitation, one or more of a speaker, lights/LEDs, a display, a haptic feedback system, a counter, or any similar device that may be used to indicate various information regarding an exercise or workout to a user. Such information may include, without limitation, current force settings of the dynamic force module 1128, progress of the user (e.g., a counter or progress bar), whether the user has performed a particular exercise properly, and the like. The auxiliary I/O 1150 may also be used to indicate the operational status of the dynamic force module 1128. For example, the auxiliary I/O 1150 may include a display or indicator lights for indicating whether the dynamic force module 1128 is currently on and whether the dynamic force module 1128 is functioning properly or in an error state.

In certain implementations, the auxiliary I/O 1150 may also include various sensors and systems for measuring the position of the user and/or other components of the exercise machine 1160 or the dynamic force module 1128. For example, in addition to the force sensors 1107, the auxiliary I/O 1150 may also or alternatively include one or more additional force sensors, such as a strain gauge, incorporated into the exercise platform 1101 or the dynamic force module 1128 or coupled to an element of the exercise platform 1101 to measure the amount of force exerted by a user. Such sensors may be placed, for example, in line with the cable of the exercise platform 1101, at a shaft of the motor 1131, on a pulley associated with the exercise platform 1101, or in a handle coupled to the cable. The auxiliary I/O 1150 may also include a position sensor for measuring the position of the user and/or the position of components of the dynamic force module 1128 or the exercise machine 1160. Positions sensors may include, without limitation, one or more of an encoder, a potentiometer, an accelerometer, and a computer vision system. For example, in certain implementations, a potentiometer or encoder may be mounted internally near the motor 1131 of the dynamic force module 1128 and an accelerometer may be disposed within a handle or grip coupled to the cable. In implementations in which a vision system is used, such a system may include one or more externally mounted image capture devices that provide a partial or full three-dimensional view of the user during execution of an exercise.

The auxiliary I/O 1150 may also include various other sensors incorporated into the exercise platform 1101. For example, in certain implementations, pressure sensors, capacitive pads, mechanical switches, or similar components may be integrated into a surface of the exercise platform 1101 or in a handle coupled to the cable of the exercise platform 1101. If the user subsequently steps off the platform or releases the handles, the exercise platform 1101 may automatically return to a safe state or otherwise modify the reactive force provided by the dynamic force module 1128.

The system controller 1102 may further include a communications module (COM) 1108 to facilitate communication between the exercise platform 1101 and external devices. The communications module 1108 may, for example, enable wired or wireless communication between the exercise platform and one or more user computing devices 1190. Such communication may occur over any known protocol including, without limitation, Bluetooth, WiFi, and ANT/ANT+. Accordingly, the user computing device 1190 may be, without limitation, one or more of a smartphone, a tablet, a laptop, a desktop computer, a smart television, one or more other exercise platforms, a centralized network node, a user-interface display, an Internet of Things (IoT) device, a wearable device (such as a smart watch or exercise tracker), an implanted or similar medical device, or any other similar piece of computing hardware. In certain implementations, multiple exercise platforms may me communicatively coupled by their respective communications modules 1108 to a single computing device (e.g., a class computer) associated with a large display (e.g., a leaderboard display), where the central computing device is configured to update the large display based on user performance or ranking, among other things.

The communications module 1108 may, in certain implementations, be connected to a network, such as the Internet, and enable downloading of various files and instructions for execution by the system controller 1102. For example, in certain implementations, files including force profiles for controlling the exercise platform 1101, exercise routines containing predetermined exercise/force settings, and similar workout information may be downloaded via the communications module 1108 for execution by the exercise platform 1101. Accordingly, a user may search for and locate exercise programs that they would like to perform over the Internet or an application using the user computing device 1190 and cause such programs to be downloaded to and executed by the system controller 1102 of the exercise platform 1101.

In certain implementations, the system controller 1102 may be adapted to automatically download updates to a workout program or exercise in response to user performance or other feedback obtained from the user. In certain implementations, such updating may occur in real-time during the course of an exercise, a set, or a workout. For example, the system controller 1102 may determine that the user is failing or struggling to perform a particular exercise. In response, the system controller 1102 may download and implement an alternative exercise routine or force profile that is more appropriate for the user.

In addition to information regarding particular exercises, the communications module 1108 may also enable downloading of user profile data. Such data may include, among other things, physical characteristics of the user, goals and targets of the user, particular injuries or disabilities the user may be subject to, and any other information that may determine the types, nature, and extent of the exercises for the user. In certain cases, the physical characteristics of the user may be used, at least in part, to automatically configure the exercise platform 1101. For example, in response to receiving user profile data indicating a user's height, body proportions, or similar biometric data, the exercise platform 1101 may automatically adjust the height of the exercise platform 1101 or one or more calibration parameters of the exercise platform 1101.

The power system 1110 includes a battery management system 1112, a battery pack 1116, a low-voltage output (LV OUT) 1118, a high voltage output (HV OUT) 1120, a charge/discharge system 1122, and various power system-related sensors 1124. The battery management system 1112 may generally function as a controller for the power system 1110 and may include a battery I/O module 1114 adapted to facilitate communication between the battery management system 1112 and the system controller 1102. Accordingly, during operation, the battery management system 1112 may exchange data with the system controller 1102 to facilitate control and operation of the power system 1120. In certain implementations, a discharge resistor and permanent AC power supply may be used in place of or to supplement the battery pack 1116.

The charge/discharge system 1122 includes components configured to charge the battery pack 1116 and/or provide for safe discharge of components of the dynamic force module 1128, such as during powering off of the dynamic force module 1128. In certain implementations, for example, the charge/discharge system 1122 may be adapted to be connected to a standard 120 VAC or similar power source and may include a trickle charger or similar device for providing current to and charging the battery pack 1116 while also providing power to the other components of the dynamic force module 1128. The charge/discharge system 1122 may also include a discharge resistor connected to ground to facilitate discharge of dynamic force module components when components of the dynamic force module 1128 or the dynamic force module 1128 as a whole is turned off or otherwise disabled. Alternatively, other actuators (such as the motor or solenoids of the dynamic force module) may be used in place of the discharge resistor to discharge components of the dynamic force module. In certain implementations, the charge/discharge system 112 may allow charging and discharging of the battery pack such that the state of charge of the battery is maintained at a precise value or percentage corresponding to the expected charge or discharge associated with a workout.

The power system-related sensors 1124 may include various sensors adapted to measure properties and provide feedback regarding the power system 1110. Such sensors may include, without limitation, one or more of voltage sensors, current sensors, temperature sensors, and sensors specifically adapted to provide an indication of the available power stored within the battery pack 1116. Such sensors may provide data to facilitate power management by system controller 1102. For example, in certain implementations, operation of the exercise platform 1101 may be dictated, at least in part, by power management concerns. For example, in certain implementations, the exercise platform 1101 may include an onboard energy storage system (such as the battery pack 1116). Such implementations may enable use of the exercise platform 1101 without being directly connected to a wall socket or other power source. Such implementations may also include a system for power regeneration (such as a regenerative braking system or software/circuitry for selectively operating the motor of the dynamic force module as a generator) adapted to produce power in response to exercises performed by a user, thereby reducing power drawn by the exercise platform 1101 and its various components during operation and even recharging the battery pack 1116. Accordingly, the system controller 1102 may execute algorithms for predicting the energy consumed and/or generated by each motion of the user and may control corresponding charging and/or discharging of the energy storage system to an appropriate level for the given activity. To the extent excess energy is produced by the user, the power system 1110 may also be adapted to return such excess power to the grid or a secondary storage system, or to dissipate the excess energy as heat. The excess energy may also be used to power other devices and systems, including, without limitation, computing devices adapted to perform cryptographic hashing or other functions for mining cryptocurrencies. Such functionality allows the energy storage system to be generally smaller and to be prepared for the energy loads produced and/or demanded by user activity.

The motor system 1130 includes the motor 1131, a motor controller 1134, a motor braking system 1138, and various motor-related sensors 1140. The motor controller 1134 may further include an I/O module 1136 adapted to send and/or receive data from the system controller 1102.

During operation, the motor controller 1134 receives command signals from the system controller 1102 and controls operation of the motor 1131 accordingly. Feedback regarding the functioning of the motor 1131 may be provided by motor-related sensors 1140 communicatively coupled to the motor controller 1134. Such sensors may include, without limitation, one or more of encoders, potentiometers, resolvers, temperature sensors, voltage and/or current sensors, tachometers, Hall Effect sensors, torque sensors, strain gauges, and any other sensor that may be used to monitor characteristics of the motor 1131 and its performance. As previously discussed, the dynamic force module 1128 may also include one or more sensors, such as inductive proximity sensors, adapted to measure the amount of cable being spooled and unspooled from a spool of the dynamic force module 1128 coupled to the motor 502. In such implementations, signals from such sensors may also be transmitted to the system controller 1102 to facilitate control and monitoring of the motor 1131.

The motor system 1130 may also include a brake system 1138 for slowing, stopping, and/or locking the motor 1131 during operation. For example, the brake system 1138 may include a brake mechanism and any associated switches for activating the brake mechanism. Although illustrated in FIG. 11 as being incorporated into the motor system 1130 and controlled through the motor controller 1134, the brake system 1138 may also be separate from the motor system 1130 and controlled directly by the system controller 1102 such that the system controller 1102 may operate the brake assembly in the event of a failure of the motor controller 1134 or other aspects of the motor system 1130. Although described herein as including mechanical brake components, the brake system 1138 may be software driven and provide braking force on the motor through, among other things, DC injection braking and dynamic braking.

The motor system 1130 is also illustrated as including a motor power system 1142 coupled to the broader power system 1110. The motor power system 1142 is generally configured to receive power from the dynamic force module power system 1110 and to provide power to both the motor 502 and the motor controller 1134. Accordingly, the motor power system 1142 may include, among other things, one or more of converters, inverters, transformers, filters and similar components for processing and conditioning power received by the motor system 1130. To the extent such components are actively controlled, such control may, in some implementations, be performed by the motor controller 1134.

In at least certain implementations, the motor controller 1134 may be configured to selectively operate the motor system 1130 in a regenerative power mode as a user performs certain exercises or phases of certain exercises. For example, during the concentric phase of an exercise, such as a bicep curl, the user pulls and extends the cable coupled to the motor 1131. As the cable is extended, the motor shaft rotates and, as a result, may be used to generate power. Such power may in turn be sent to and stored in the battery 1161.

It should be understood that the diagram of FIG. 11 is intended to be merely an example system according to the present disclosure and that variations of the foregoing description are contemplated herein. Moreover, the specific arrangement of components illustrated in FIG. 11 is intended to be non-limiting. For example, while illustrated as being separate in FIG. 11, various components of the system controller 1102, power system 1110, and dynamic force module 1128 may occupy a common printed circuit board. As another example, the battery pack 1116 may not have an independent switch but may instead be connected directly to the system controller 1102, which manages its own power state, and switches power to other components (lights, motor controller, etc.). The system controller board may also have its own power supply (e.g., a LV buck converter) which draws from the battery pack 1116.

Figure 12:
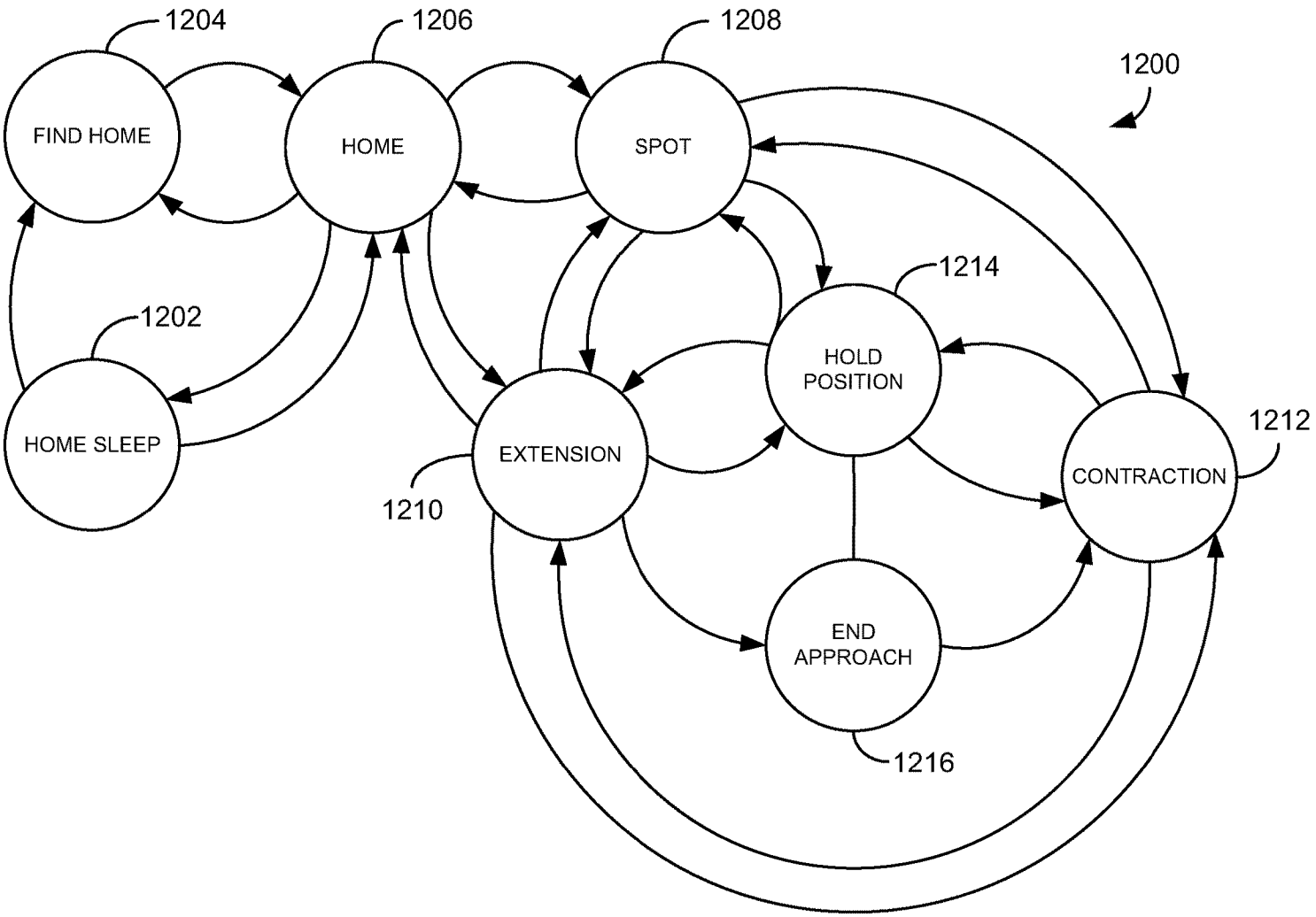
FIG. 12 is a state diagram illustrating operation of an exercise platform in accordance with the present disclosure.

FIG. 12 is a state diagram 1200 illustrating operation of an example exercise platform in accordance with the present disclosure.

The Home Sleep state 1202 generally corresponds to a "sleep" or "off state" of the exercise platform. While in the Home Sleep state, the exercise platform is in an inactivated or resting state until turned on or otherwise directed to wake from the Home Sleep state 1202. Such waking may be conducted in response to various events including, without limitation, a user activating a switch or otherwise issuing a command, a user entering into proximity to the exercise platform, a user gripping or otherwise manipulating a component of the exercise platform, or a user taking any similar action.

In one specific implementation, transitioning from the Home Sleep state 1202 is achieved by the user stepping onto the exercise platform, as detected by the force sensors or a similar switch configured to detect pressure applied to the top surface of the exercise platform. In a similar implementation, transition from the Home Sleep state may instead be achieved by the user tapping on the top surface according to a predetermined pattern. For example, the user may "double-tap" or "triple-tap" a portion of the exercise platform while standing on the exercise platform to wake the exercise platform and transition from the Home Sleep state 1202.

Once activated/woken from the Home Sleep state 1202, the exercise platform enters the Find Home state 1204. While in the Find Home state 1204, the dynamic force module of the exercise platform performs an auto-calibration function in which the dynamic force module determines an absolute home or zero position. In certain implementations, the dynamic force module or exercise platform in which the dynamic force module is incorporated may include limit switches or other positional sensors to assist in determining the home position. For example, the dynamic force module may determine its range extents by actuating in a first direction until a first limit switch is activated and then actuating in an opposite direction until a second limit switch is activated, thereby determining the full range of motion for the dynamic force module. The dynamic force module may then actuate into an intermediate position between the two extents. Alternatively, the dynamic force module may actuate in a first direction until the first limit switch is triggered. The location at which the first limit switch is triggered may then be used as an absolute location from which all subsequent position calculations may be based. Similarly functionality may be provided by proximity sensors configured to measure a location of the cable as it is spooled and unspooled from the spool of the dynamic force module. After executing the auto-calibration function associated with the Find Home state 1204, the exercise platform enters into the Home state 1206 in which the exercise platform waits until an input or signal is received by the exercise platform to transition into various exercise-related states.

The process of placing the dynamic force module in a starting/home position may also be a manual process performed by a user to set a start position for a given exercise or workout. In one example implementation, a user may adjust the positon of the cable via an app running on a smart phone or tablet or by executing predetermined gestures/tapping patterns on the top of the exercise platform. By doing so, a user is able to adjust starting positions and, as a result, where in a given exercises that force is applied by the dynamic force module. Doing so facilitates the user getting into and out of proper position for exercises such as squats, deadlifts, overhead presses, and the like.

The exercise-related states generally correspond to providing a dynamic resistance force during a range of motion associated with an exercise. As illustrated in FIG. 12, for example, the exercise-related states may generally include each of an Extension state 1210 and a Contraction state 1212. The Extension state 1210 and the Contraction state 1212 each generally correspond to halves of an exercise repetition and include application of reactive force by the actuator of the dynamic force module in an appropriate direction. Accordingly, during normal operation, the exercise platform will generally move between the Extension state 1210 and the Contraction state 1212 as a user performs a repetition. For example, if a user were to perform upright cable pulls using the exercise platform, the exercise platform would first be in the Extension state 1210 during pulling or extension of the cable and then, after sufficient extension, would enter the Contraction state 1212 during retraction of the cable. The specific transitions between the Extension state 1210 and the Contraction state 1212 may vary based on the exercise being performed. Nevertheless, in each of the Extension state 1210 and the Contraction state 1212 the actuator of the dynamic force module provides reactive force according to a force profile that dictates reactive force based on, among other things, position, speed, counter force, or other factors. Example force profiles are discussed in more detail below in the context of FIGS. 13-19.

During an exercise, the dynamic force module may also enter into a Hold Position state 1214. The Hold Position state 1214 generally includes the exercise platform holding a force, thereby facilitating isometric exercises in which a user holds a position under load. The Hold Position state 1214 may also be used as an emergency state should an error occur during operation. In some implementations, the Hold Position state 1214 includes applying a mechanical or other braking system to maintain the force applied by the dynamic force module actuator.

Operation of the exercise platform may also include a Spot state 1208 in which the dynamic force module/cable is gently returned to the home position. Transition between the Extension state 1210 or the Contraction state 1212 and the Spot state 1208 may occur in response to the exercise platform detecting that a user is not providing sufficient counter force to complete a repetition. The specific cutoff for determining when spotting functionality is to be initiated may vary by exercise or may be manually adjusted by a user, however, in at least one example implementation, spotting is initiated when a force that is less than about 80% of the force required for the current rep is measured for more than a predetermined time (e.g., 2-3 seconds). So, for example, if a user was performing a squat movement under a load simulating 200 lbs, but was only producing 160 lbs of force as measured via the exercise platform, the dynamic force module may enter the Spot state 1208. In the Spot state 1208, the dynamic force module may lessen the force required to complete the current movement up to and including removing all loading entirely. By doing so, the dynamic force module assists the user in completing the current repetition and/or safely returning to the home position. Further discussion regarding spotting functionality is described below in the context of FIG. 17.

Operation of the exercise platform may also include states corresponding to operational limits of the dynamic force module. For example, as shown in FIG. 12, the exercise platform may enter an End Approach state 1216 when at or near a limit of the dynamic force module's range of motion. When in the End Approach state 1216, the exercise platform may increase the reactive force applied to further movement so as to discourage the dynamic force module from reaching its mechanical limit. In certain implementations, should further extension occur, the exercise platform may transition into the Hold Position state 1214 in which a brake is applied to prevent further extension. In such implementations, the dynamic force module may generally enter the Hold Position state 1214 in response to determining the user has reached an end approach for a given exercise. To do so, the dynamic force module may rely on previously obtained range of motion data for the user including the cable position at the full extent of the range. For example, when executing a new exercise a user may be asked to perform the exercise with no or little loading but with proper form. During such exercises, the exercise platform and/or dynamic force module may determine the amount of cable extension in one or more of a starting position, an ending position, or one or more intermediate positions. Such cable extension values may subsequently be used to determine when the user is at certain points in the exercise and when to enter the Hold Position state 1214.

Exercise platforms in accordance with the present disclosure may function based on what are referred to herein as force profiles. Force profiles are relationships and/or algorithms that dictate or otherwise control the dynamic force module of the exercise platform in response to various sensed parameters as exercises are being performed by a user. In certain implementations, for example, a force profile may dictate the force to be applied by the dynamic force module in response to a position (as measured by a relative extension or retraction of the cable coupled to the dynamic force module) or one or more force measurements obtained from the force sensors of the exercise platform. Accordingly, in certain implementations, the sensed parameter may correspond to a force applied by a user to the exercise platform as measured using force sensors coupled to a top of the exercise platform. In other implementations, however, the sensed parameters may further include, among other things and without limitation, a load on the motor of the dynamic force module, a speed at which the cable is extended or retracted, a position of the user, a distribution of forces on the exercise platform by the user, a direction of force applied by the user, an elapsed time, or any other parameter that may be measured during performance of an exercise.

Figure 13:
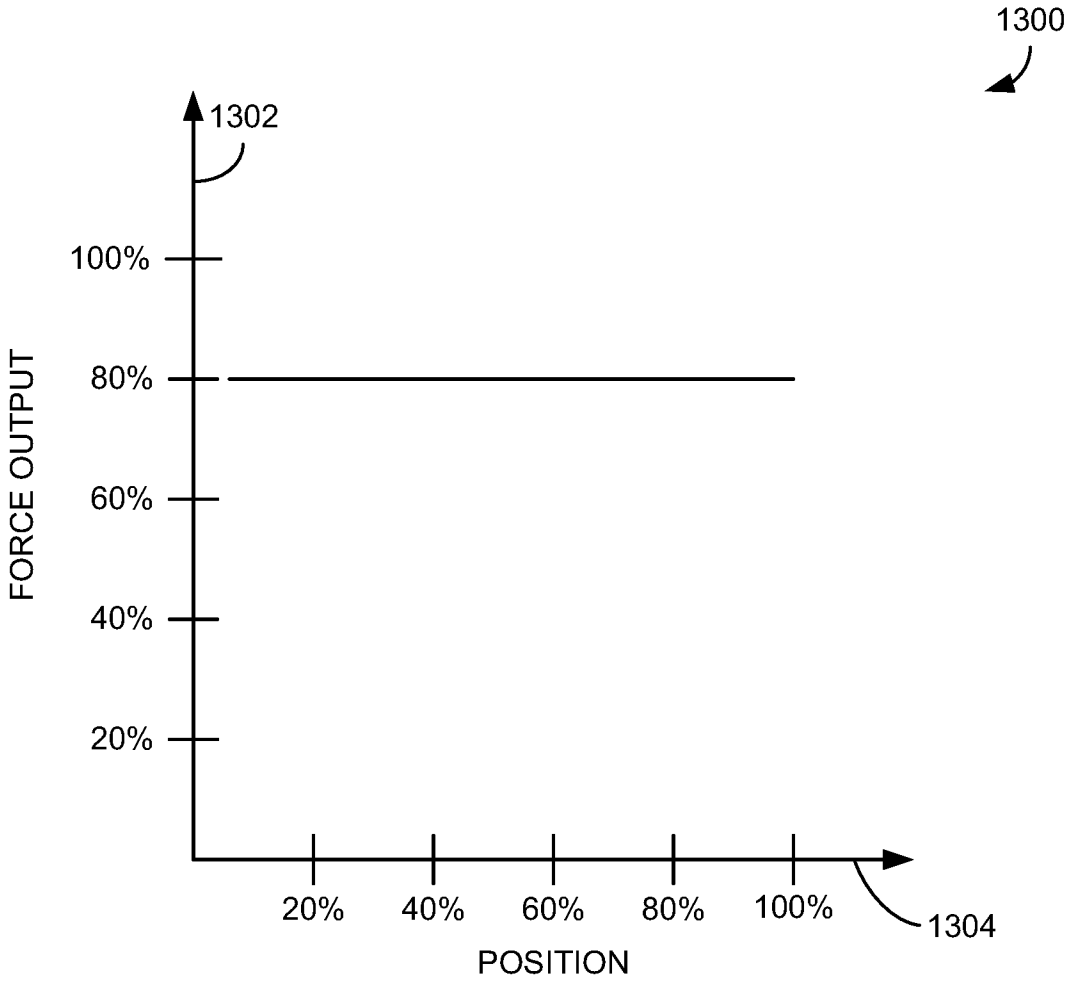
FIG. 13 is a first force profile that may be executed by an exercise platform in accordance with the present disclosure, the first force profile including a constant reactive force.

In certain implementations, a force profile may be executed by the exercise platform that causes the dynamic force module to apply a constant force over a full range of motion associated with an exercise. FIG. 13, for example, is a first force profile 1300 that may be executed by an exercise platform in accordance with this disclosure. As illustrated by the force profile 1300, certain force profiles in accordance with the present disclosure may provide a relationship between the output force of the dynamic force module 1302 and a position 1304. In certain implementations, each of the force output and the position may be expressed as a percentage of a nominal value. For example, the force output may be indicated as a percentage of some maximum force output that may or may not be equal to the maximum force output of the dynamic force module. Similarly, the position may be expressed as a percentage of a predetermined range of the dynamic force module. The range may be equal to the full range of the dynamic force module (e.g., the full range between full retraction and full extension of the dynamic force module) or may correspond to a range of motion associated with a particular exercise. With respect to the latter, the range of motion may be determined, for example, by having the user perform a particular exercise under a nominal load, determining the starting and ending position of the user (e.g., based on the starting and ending extension of the cable), storing the start and end positions in memory and the corresponding positions of the dynamic force module actuator, and setting the range for the exercise based on the dynamic force module actuator positions. Range of motion for any given exercise, e.g., arm curl, squat, standing shoulder press, etc., may be stored and retrieved for use based on whatever user may log into the device. Although the example of the subsequent figures is based on percentages relative to various nominal values, force profiles may also be implemented based on absolute parameter values. Referring back to FIG. 13, the force profile 1300 presented is a relatively simple force profile in which the force output by the dynamic force module is constant. Specifically, the force output of the dynamic force module is approximately 80% of a maximum force for the full range of positions (e.g., a one-rep max) as determined for the particular user.

In a specific example, suppose a user wishes to perform squats. The user may be initially asked to perform a set of a substantially unloaded squat on the exercise platform while holding a bar coupled to a cable of the exercise platform. During performance of this initial set, the exercise platform/dynamic force module may determine what cable extensions correspond to the bottom and top of the squat and, as a result, what cable extensions correspond to the user's range of motion. When the user subsequently performs a squat under load, such as 100 lbs, the exercise platform/dynamic force module will operate to maintain the 100 lbs load through the range of motion. For example, during the concentric (lifting) phase of the squat, the exercise platform/dynamic force module would resist extension of the cable unless force applied by the user (e.g., as measured by load cells of the exercise platform, current draw on the motor, or any other approach described herein) exceeded the selected load of 100 lbs. In certain implementations, the load for an exercise may be selected by the user. In others, the load may be selected based on a workout plan or goals of the user. For example, in one implementation, a user may provide or the exercise platform may measure or estimate a user's one-rep maximum for a given activity and scale the load/force required for the exercise based on the one-rep maximum and number of reps to be performed.

Figure 14:
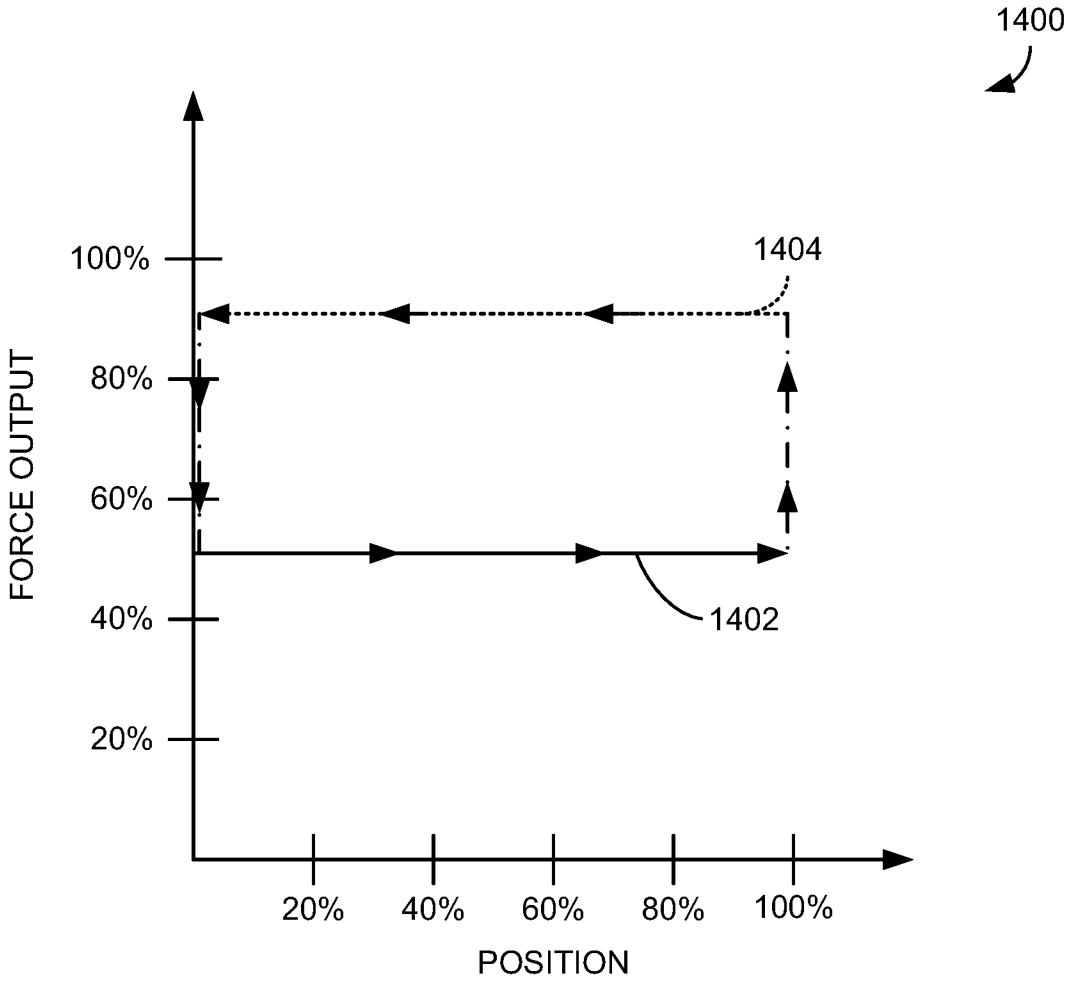
FIG. 14 is a second force profile that may be executed by an exercise platform in accordance with the present disclosure, the second force profile illustrating variable concentric and eccentric reactive forces.

Other force profiles may distinguish between phases of an exercise or movement in different directions and apply different reactive forces to each phase or direction of movement. Such force profiles may be used for, among other things, placing additional emphasis on one of the concentric or eccentric portions of an exercise. FIG. 14, for example, is a second force profile 1400 in which different loading is applied during each of the concentric and eccentric phases of an exercise. Such variation may be used, for example, to implement "eccentric overloading" or similar techniques which are generally unavailable using conventional weights or weight-based exercise machines. In the specific force profile 1400 of FIG. 14, for example, a first force is applied by the dynamic force module during a concentric phase 1402 of an exercise at approximately 50% of a predetermined maximum force. However, during the eccentric phase, the force applied by the dynamic force module is increased to approximately 90% of the maximum force. Accordingly, an overload is applied during the eccentric phase. In other implementations, a similar force profile may be used to emphasize the concentric phase of an exercise over the eccentric phase. For example, the force applied by the dynamic force module may be 90% during the concentric phase but then reduced to 50% during the eccentric phase.

Figure 15:
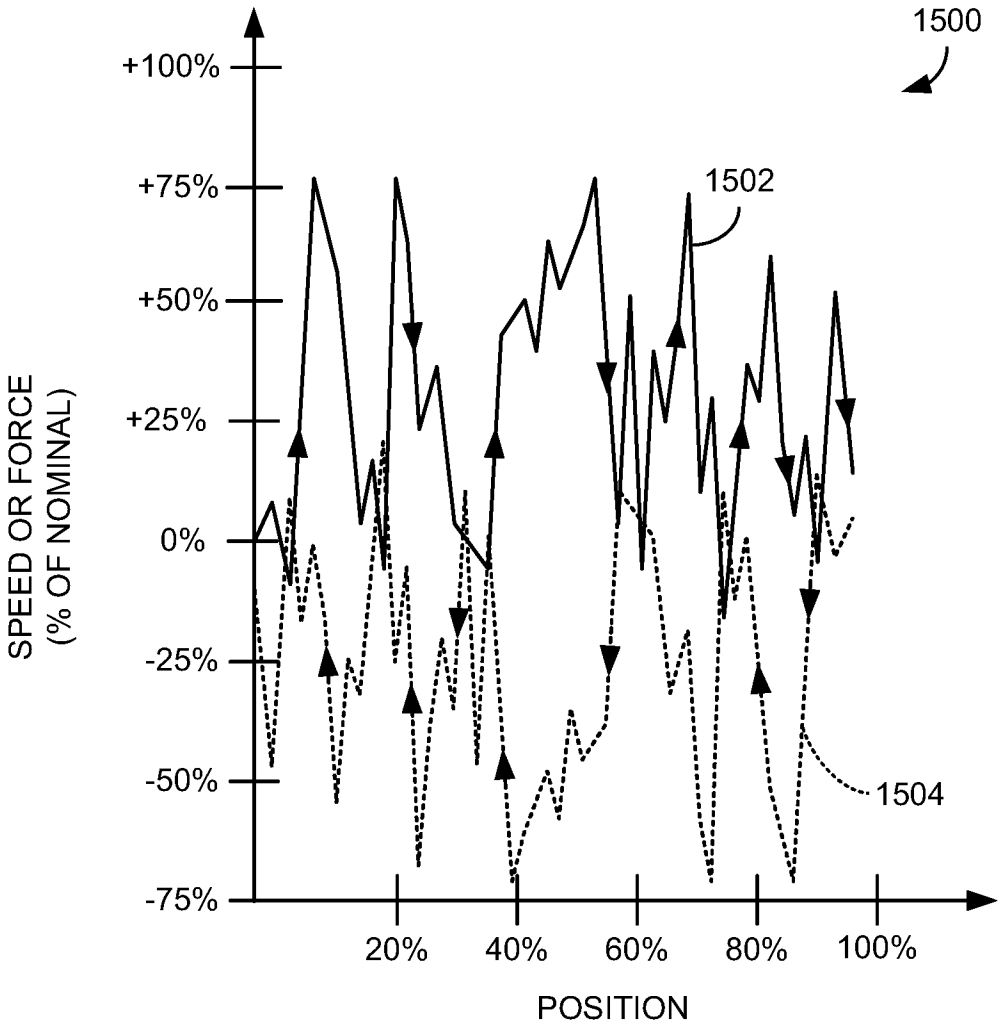
FIG. 15 is a third force profile that may be executed by an exercise platform in accordance with the present disclosure, the third force profile illustrating noise loading.

In still other force profiles, random noise may be applied to some nominal control parameter or value associated with the load. Doing so may decrease the stability of the load provided by the dynamic force module and, as a result, increase the challenge of performing the exercise by the user. More specifically, under such loading, the user must provide stabilization of the load in addition to executing the primary movements of the exercise. Such a force profile is illustrated in FIG. 15. FIG. 15 is a third force profile 1500 including each of a concentric phase 1502 and an eccentric phase 1504. The third force profile 1500 is intended to illustrate a force profile that applies the concepts of speed or force noise loading. During such loading, the speed of the contraction/extension or the force required for contraction/extension is not constant. Rather, some degree of noise is superimposed over a predetermined speed or force, thereby causing random variations over the range of motion associated with a given exercise.

In force noise loading, for example, a noise signal is superimposed over a force set point, thereby creating a scenario in which a user must vary the counterforce he or she provides for stable, consistent motion. Such unpredictable loading effectively "shocks" muscle groups in a way that is difficult to achieve using conventional exercise equipment. During speed noise loading, the speed with which the dynamic force module allows contraction or extension is varied about some nominal speed. For example, a cable speed may be randomly cycled between positive and negative cable speeds of varying degrees. By doing so, a user's muscles are demanded to quickly switch between concentric, eccentric, and isometric modes of operation.

Figure 16:
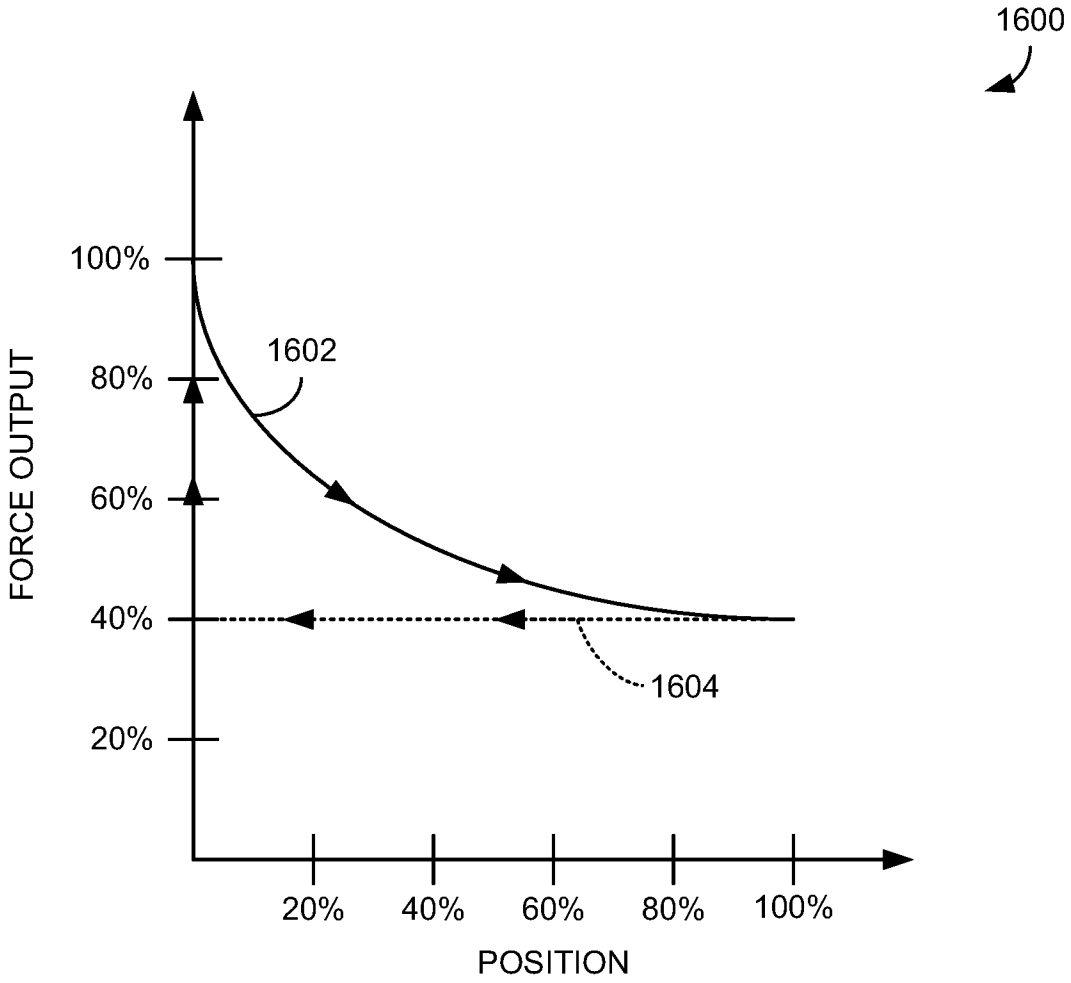
FIG. 16 is a fourth force profile that may be executed by an exercise platform in accordance with the present disclosure, the second force profile illustrating ballistic reactive force.

Force profiles executed by the dynamic force module may also attempt to simulate loads and physics of other exercise machines and equipment. FIG. 16, for example, is a fourth force profile 1600 including each of an extension phase 1602 and a contraction phase 1604. The force profile 1600 illustrates an implementation of ballistic loading or resistance similar to that which would be experienced when using an ergometer/rowing machine. Specifically, during the extension phase 1602, the force applied by the dynamic force module begins at a predetermined maximum value and then reduces exponentially towards a minimum force value at the end of the exercise. During the contraction phase 1604, a constant reduced force is applied to assist the user in returning back to the starting position.

Figure 17:
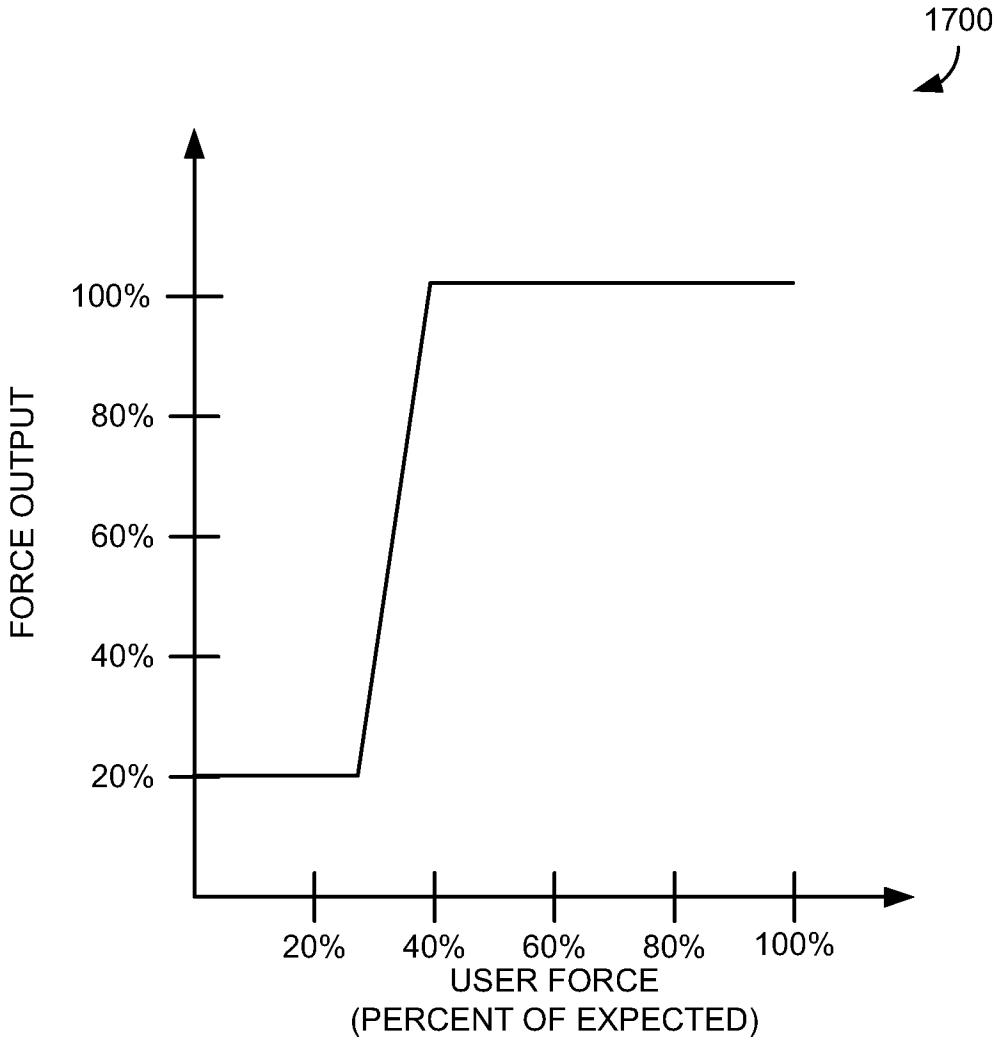
FIG. 17 is a fifth force profile that may be executed by an exercise platform in accordance with the present disclosure, the fifth force profile illustrating a spotting mode of the dynamic force module.

Force profiles and aspects of force profiles may also be implemented for purposes of safety and injury reduction. For example, force profiles executed by a dynamic force module may attempt to identify if a user is unable to execute an exercise at a current load and may reduce or otherwise modify the load to allow the user to safely return to a starting position or otherwise complete the exercise. FIG. 17 is a fifth force profile 1700 illustrating an example of "spotting" or assistance functionality. In general, spotting functionality may be implemented by measuring the force exerted or speed achieved by the user and reducing the force output of the dynamic force module in response to the force exerted or speed achieved by the user falling below a predetermined threshold. For example, in the specific example force profile of FIG. 17, when the user exceeds approximately 40% of an expected force, a predetermined force may be applied by the dynamic force module. However, if the user force falls below 40% and, in particular below 25%, the force output of the dynamic force module is reduced to approximately 20% of the predetermined force. Under this reduced load, the user may then return to the starting position of the exercise. Alternatively, if the user were to release the grip, handle, etc. of the exercise machine in response to becoming fatigued, the reduced load allows safe return of the dynamic force module to the starting position. In either case, a speed limit may also be applied to retraction of the dynamic force module to ensure safe, controlled return to the starting position.

Figure 18:
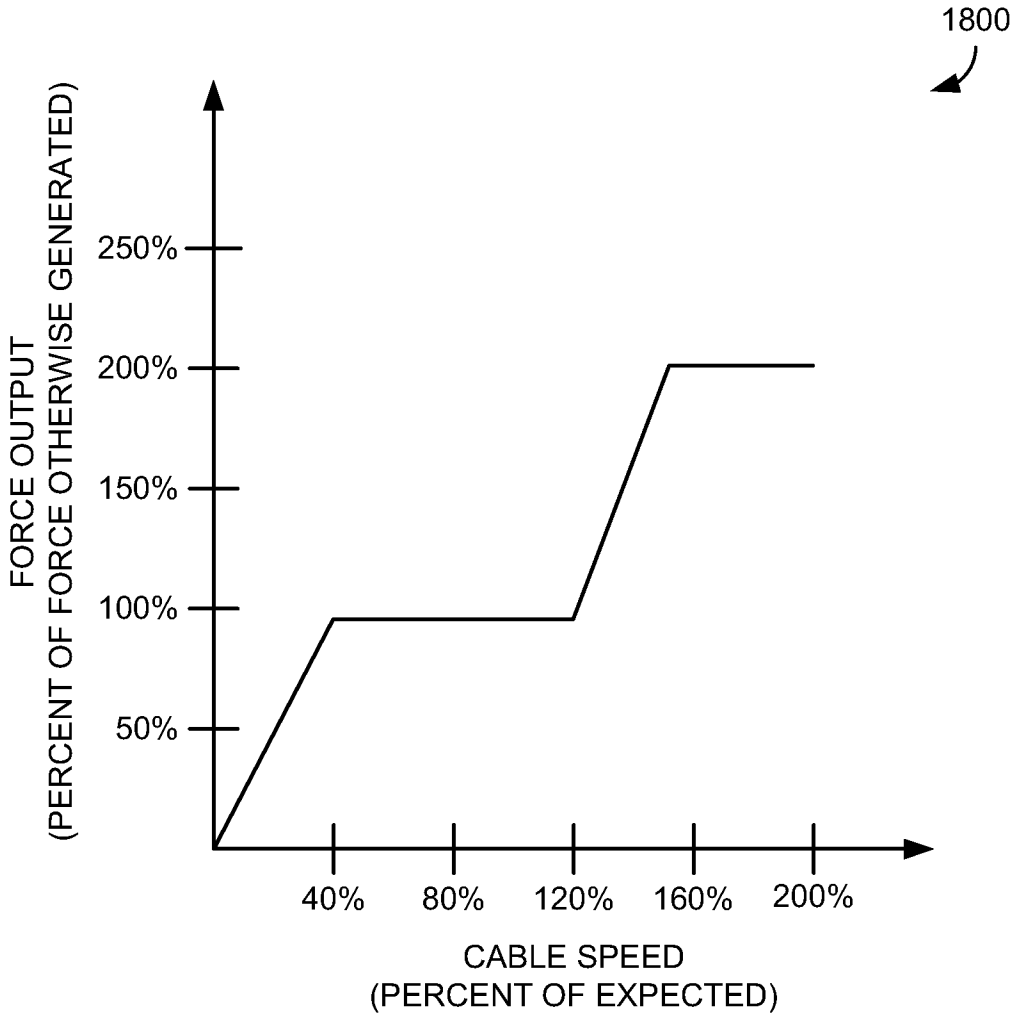
FIG. 18 is a sixth force profile that may be executed by an exercise platform in accordance with the present disclosure, the sixth force profile illustrating constant speed control.

Previously discussed force profiles focused primarily on the dynamic force module providing a force output based on the position of a user and, in particular, the position of the user with respect to a range of motion for an exercise. In other implementations, however, the output of the dynamic force module may be based on other measured parameters associated with an exercise performed by the user including, among other things, the speed or acceleration of the user during performance of the exercise. FIG. 18 is a sixth force profile 1800 illustrating a force profile for implementing speed control in which the force output by the dynamic force module is based on the speed at which the user is moving through an exercise. In the implementation illustrated in FIG. 18, for example, the dynamic force module provides a constant force output while extension or retraction of a cable coupled to the dynamic force module is maintained between 40% and 120% of a predetermined speed. If, however, extension or retraction exceeds 120%, the force output of the dynamic force module is increased proportionately up to double the level of the constant force output in order to encourage the user to slow his or her movement. Similarly, if the extension or retraction falls below 40%, the force output of the dynamic force module may be proportionately decreased to encourage the user to speed up his or her movement. In certain implementations, additional feedback may be provided to the user in the form of a haptic pulse or visual/audio feedback that provides warnings or other indications if the user falls outside of the ideal speed range.

Figure 19:
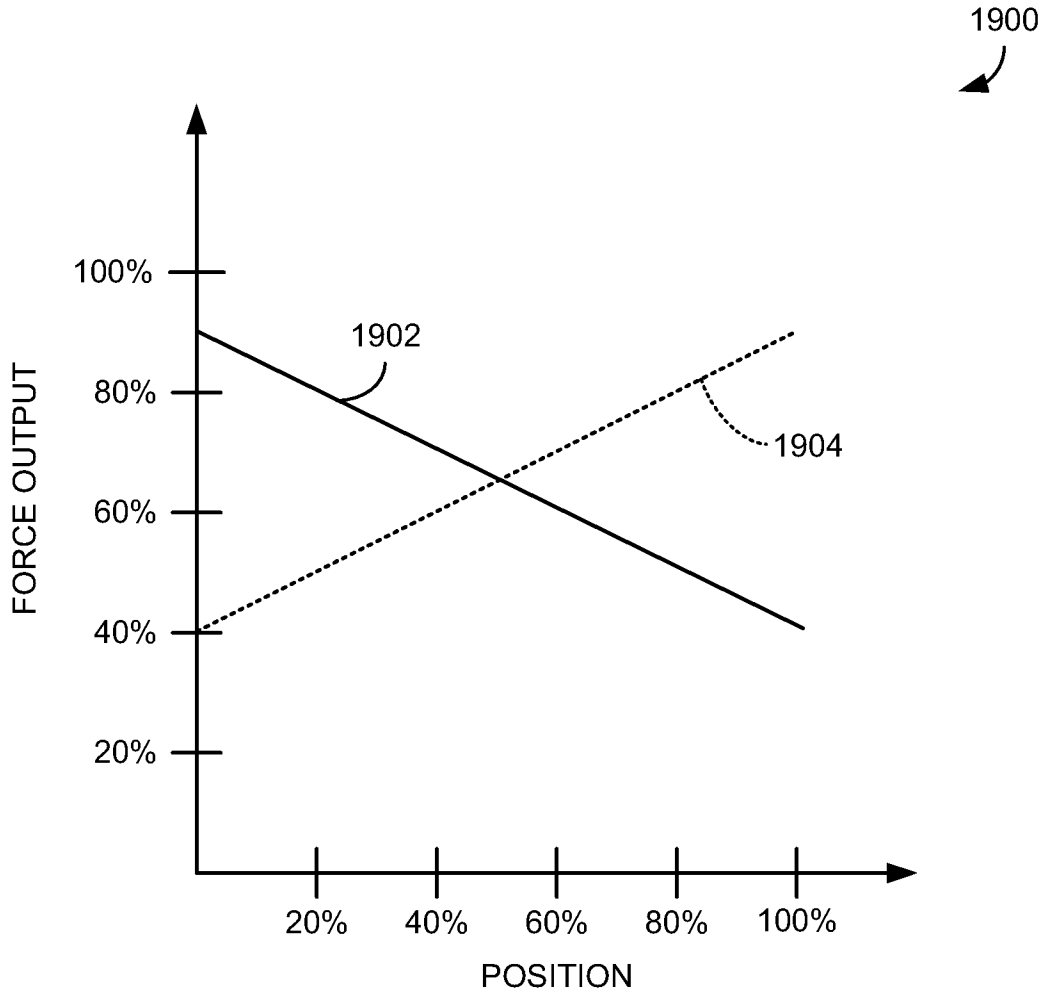
FIG. 19 is a seventh force profile that may be executed by an exercise platform in accordance with the present disclosure including a pair of dynamic force modules, the seventh force profile illustrating imbalanced loading applied by the pair of dynamic force modules.
Figure 21:
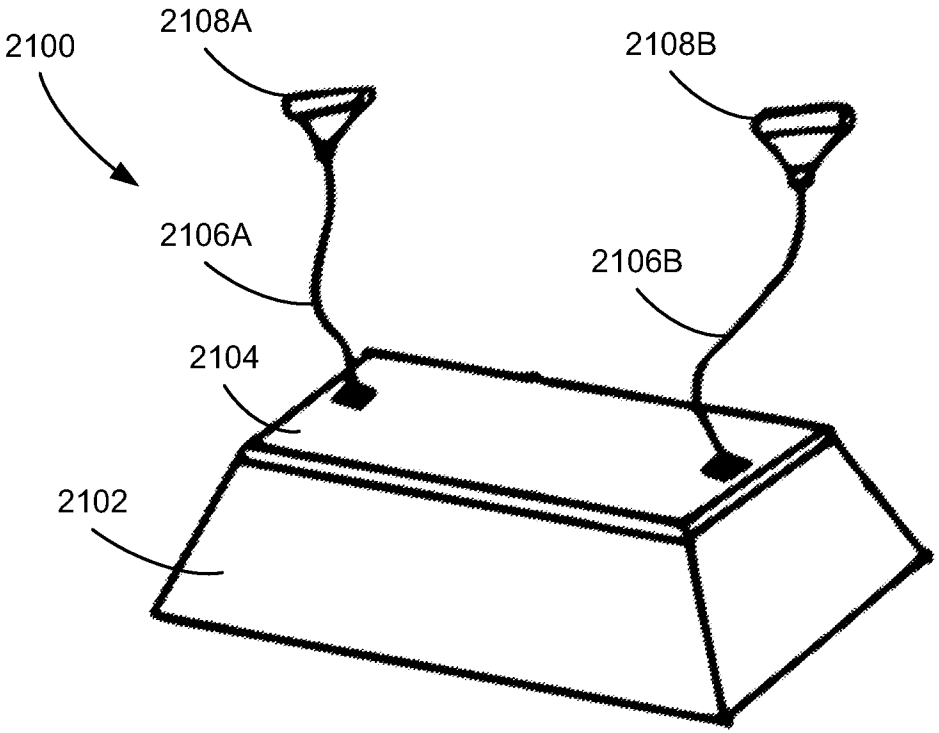
FIG. 21 is a schematic illustration of an exercise platform in accordance with the present disclosure including multiple cables.

In certain implementations, exercise platforms according to the present disclosure may include multiple dynamic force modules, each of which may be independently controllable or tethered together in a master/slave configuration. One such example implementation is illustrated in FIG. 21 and discussed in further detail below. In such implementations, one force profile may govern the operation of each of the dynamic force modules such that the dynamic force modules are substantially synchronized throughout an exercise. In other implementations, however, each dynamic force module may execute a different force profile, thereby causing intentionally imbalanced loading. FIG. 19, for example, is a seventh force profile 1900 that illustrates such a case. Specifically, the force profile 1900 includes a first curve 1902 corresponding to a first dynamic force module and a second curve 1904 corresponding to a second dynamic force module. As illustrated in the force profile 1900, the force applied by the first dynamic force module starts at a high level and gradually decreases towards the end of the exercise while the force applied by the second dynamic force module starts at a low level and gradually increases a maximum at the end of the exercise. So, for example, in an implementation in which the first dynamic force module provides reactive force to a user's right arm while the second dynamic force module provides reactive force to the user's left arm, a dynamic imbalance may be created that shifts loading between the user's arms over the course of an exercise.

The force profiles illustrated in FIGS. 13-19 are intended merely as illustrations of force profiles that may be implemented in conjunction with exercise platforms according to the present disclosure. In general, a force profile dictates the force or speed at which the dynamic force module extends or retracts based on some parameter corresponding to an exercise being performed. Such parameters may include kinematics and dynamics associated with various elements including, without limitation, the user, a handle or similar accessory, a cable or link, or any other measurable aspect of the dynamic force module itself, the exercise platform within the dynamic force module is incorporated, the user, or the environment within which the exercise platform is operated.

In certain implementations, the force profiles may substantially simulate other exercise machines. For example, a dynamic force module may execute a force profile intended to mimic the dynamics of a traditional cable machine including a weight stack under normal gravity. Other force profiles may simulate any of static, sliding, rolling, or rolling friction associated with real-world objects or resistance mechanisms (e.g., pulleys, belts, cables, chains, bands, or similar moving parts of conventional exercise machines). The force profiles may also be based on other real-world models intended to simulate fluid dynamics (such as the dynamics of water when rowing), fans or magnetic resistance elements (such as implemented in stationary bikes and ergometers), pneumatic or hydraulic resistance elements, spring/damper systems, or any other similar systems.

Although force profiles simulating conventional exercise machines and conventional environments are possible, the force profiles implemented by the dynamic force module are not necessary limited to real world analogs. Rather, the underlying models and physics on which a force profile is based may be modified based on the particular needs and goals of a user.

In certain implementations, force profiles may reflect slightly modified versions of terrestrial physics in order to smooth the user's experience. For example, physical weight stacks have inertia such that if an explosive/ballistic movement is conducted using a physical weight stack, the weight stack will continue in an upward motion even if the person performing the exercise has stopped moving a handle, grip, etc. coupled to the weight stack. In cable-based systems, such inertia causes slack in the cable and a subsequent high-tension shock loading event when the weight stack falls under the force of gravity. In contrast, dynamic force modules according to the present disclosure may modify the simulated properties of the cable and/or weight stack to avoid such events. For example, in one implementation, the dynamic force module may simulate an elastic cable during the period when the shock loading event would occur. In another implementation, the dynamic force module may simulate a zero-inertia weight stack such that the slack and subsequent shock experienced when using actual weight stacks are eliminated. In yet another implementation, the dynamic force module may include control algorithms that limit or otherwise control movement of the cable/drum such that the cable does not go slack. In another example, a user may be tasked with catching a simulated object, such as a simulated egg or medicine ball. In the real world, catching an object generally requires the person catching the object to receive the full mass of the object at once. In contrast, the dynamic force module may create a simulated scenario in which the weight of the caught object ramps up from a small nominal value to a full simulated value over a predetermined period of time.

In another example implementation, a force profile may be executed such that the dynamics of the dynamic force module correspond to non-terrestrial gravity. So, for example, the dynamic force module may be used to simulate the gravity of the moon by reducing the resistance to upward acceleration of a simulated load, as experienced by a "floating" dynamic at the end of a vertical movement. Similarly, such resistance may be increased to simulate the gravity of another planet, such as Jupiter.

In yet another example, the physics governing a force profile may reflect movement through a particular substance. Referring to the ergometer/rowing machine example provided in FIG. 16, for example, the rate of which the force output of the dynamic force module decays during the extension phase 1602 may be modified to simulate rowing through different media. For example, one force profile may decrease the rate of decay, thereby simulating a fluid having high viscosity, such as honey or oil. Still other force profiles may increase the rate of decay, thereby simulating fluids having low viscosity, such as various types of alcohols. In still other implementations, the force profile may reflect a non-Newtonian fluid such that the force output by the dynamic force module is inversely proportional to the force output or acceleration applied by the user. Such force profiles may be used, for example, as a method of speed control, similar to the force profiled discussed in the context of FIG. 18.

Force profiles may also be progressive in that they vary over the course of a single repetition, an exercise set, and/or a workout. For example, a force profile may be dynamically adjusted over the course of a workout to correspond to each of a warm-up period (that begins with relatively low reactive force that is gradually increased), a primary exercise period (at a relatively high reactive force), and a cool down period (that begins at a relatively high reactive force that is gradually decreased). Within each of these periods, the dynamic force module could dynamically adjust reactive forces based on feedback corresponding to the user's performance. For example, if the user exhibits consistently high speed and force, the workout may be too easy and the reactive force may be increased. In contrast, if the user exhibits inadequate force output, the workout may be too difficult and the reactive force or other difficulty-related parameter may be decreased. Accordingly, the user's level of effort and/or muscular breakdown may be made to follow a separately defined trajectory. In this way, the dynamic force module could ensure that a user reaches particular thresholds for warming and/or muscular breakdown within a predetermined time or number of sets. In certain implementations, a user may be asked by the system to perform one or more warmup exercises or otherwise perform a particular exercise at a relatively low weight. During the course of the warmup, the system may analyze the user's performance and select an appropriate force profile to use during the main set or sets of the exercise based on the user's performance.

In one implementation, the concept of progressive force profiles may be used to execute "drop sets", which are commonly practiced among advanced weightlifters. In a conventional drop set workout, weight/resistance is reduced every few reps to keep a weightlifter near the point of muscular breakdown. Accordingly, to implement drop sets in the context of dynamic force modules, the reactive force for a given force profile may be dynamically adjusted downward every few reps as deemed appropriate by the system. Notably, conventional drop sets require the weightlifter to have access to a wide range of weights (which are generally only available in discrete increments) and to quickly switch between such weights. In contrast, the dynamic force module includes a near-continuous force range and can make reactive force changes on the fly. Moreover, the dynamic force module is able to provide a wider range of force profiles, including those having varying reactive forces between the eccentric and concentric phases of an exercise.

Various human feedback mechanisms and user interfaces may be implemented in conjunction with exercise platforms according to the present disclosure. In general, the human feedback mechanisms are intended to provide feedback to a user regarding the user's performance of a given exercise. Feedback may take various forms including, without limitation, one or more of audio, visual, and haptic feedback, each of which may vary in intensity based on the degree to which the user deviates from a benchmark or similar value. Such feedback may be provided from the exercise platform itself or may be provided by a computing device in communication with the exercise platform.

Although other types of audio feedback are possible, examples of audio feedback include, without limitation, a buzzer, a beeping sound, one or more tones played in succession, and voice feedback. In certain implementations, the audio feedback may be varied in tone, intensity, or quality based on the degree of feedback provided to the user. With respect to voice-based feedback, the exercise platform may be adapted to play various phrases regarding the degree of deviation by the user and/or that provide specific instructions to the user. For example, if a user is executing a particular movement too quickly, the voice-based feedback may instruct a user to slow down.

Visual feedback may also take various forms. In some example implementations, visual feedback may be provided in the form of one or more lights/LEDs adapted to illuminate based on the user's performance. For example, the exercise platform may include each of a green LED, a yellow LED, and a red LED (or multi-colored LEDs) for indicating whether a user is performing a particular exercise according to target parameters, slightly outside target parameters, or well outside target parameters, respectively. Visual feedback may also make use of a screen or other display for presenting information to the user. A screen may be used, for example, to provide one or more of graphical and textual feedback to the user. In either case, such feedback may include particular instructions to encourage the user to perform an exercise within target parameters. Visual feedback may also be provided in the form of a numerical score or similar metric for measuring the user's performance with proper performance of an exercise earning greater points than improper performance of the exercise.

Haptic feedback may also be provided to the user. For example, the handles, grips, or other elements of the exercise platform may include mechanisms to cause vibration or pulsation. Haptic feedback may also be provided by a separate device, such as a smartphone, smartwatch, fitness tracker, or similar item kept on the user with haptic feedback functionality.

In general, the feedback mechanisms are communicatively coupled to one or more dynamic force modules such that the feedback mechanisms may be used within a control loop for controlling the dynamic force modules and providing feedback to the user. For example, the user interfaces discussed herein may be presented on a display of a computing device that is wirelessly coupled to a dynamic force module of an exercise machine. Similarly, audio and haptic feedback components may also be coupled to one or more dynamic force modules such that the dynamic force module may provide feedback to the user.

Specific example of visual feedback mechanisms for use with exercise platforms according to the present disclosure are discussed in further detail in U.S. patent application Ser. No. 15/884,074, entitled "Systems for Dynamic Resistance Training", which is incorporated by reference herein in its entirety.

Figure 20:
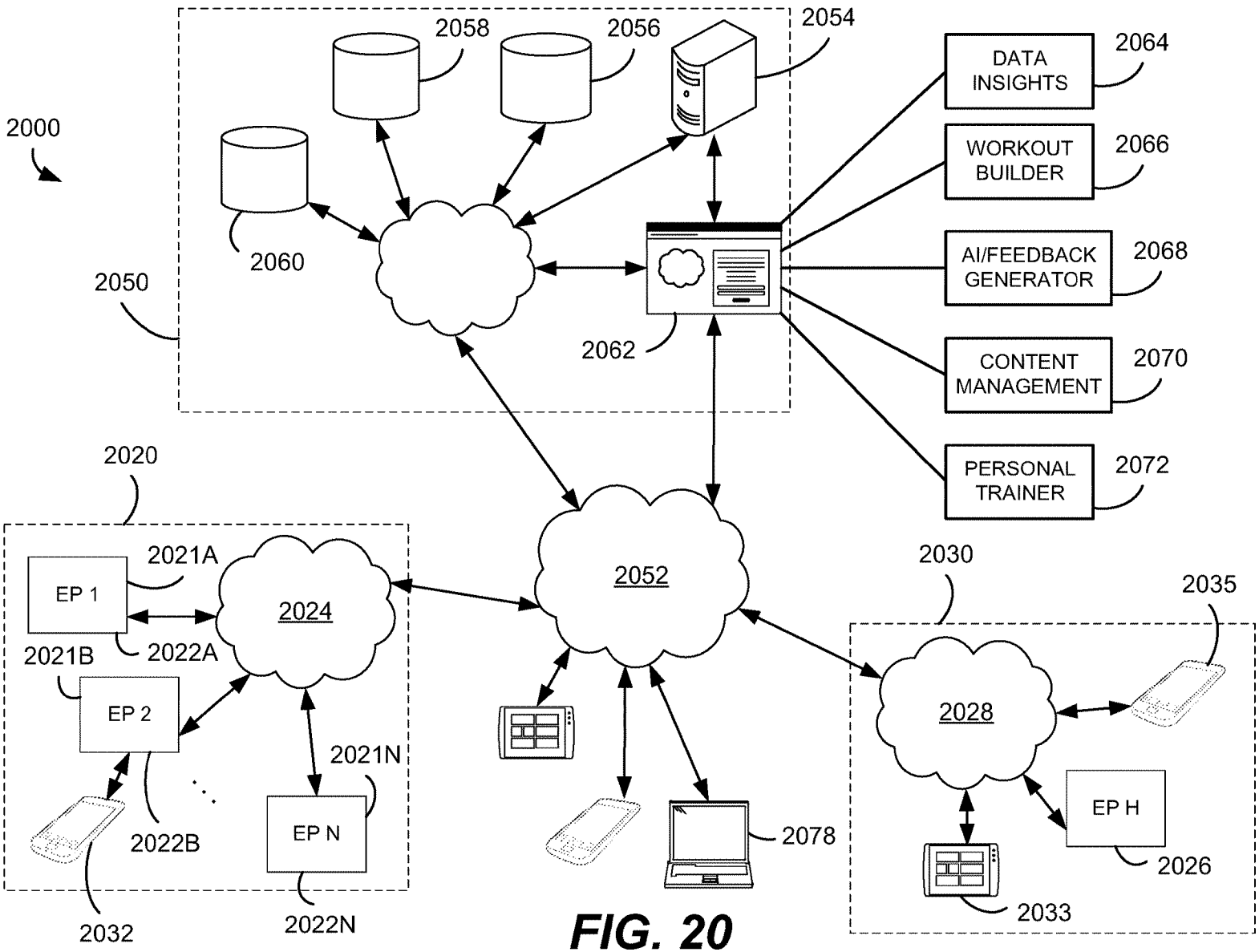
FIG. 20 is an example network environment for operating and managing dynamic force modules.

FIG. 20 is a schematic illustration of an example network environment 2000 intended to illustrate various features of exercise platforms according to the present disclosure. In general, exercise platforms are capable of communicatively coupling to other computing devices either directly or over a network, including over the Internet. Such coupling may be used to facilitate, among other things, configuration of the exercise platforms, control of the exercise platforms, tracking and analysis of user performance, and other interaction between the user and exercise platforms.

The example network environment 2000 includes each of a gym facility 2020 and a home 2030 communicatively coupled to a cloud-based computing platform 2050 over a network 2052, such as the Internet. Each of the gym facility 2020 may include one or more exercise platforms (EP 1-EP N) 2021A-2021N, each of which may in turn include one or more dynamic force modules. Each of the exercise platforms 2021A-2021N may be locally connected to a gym network 2024. Similarly, the home 2030 includes an exercise platform (EM H) 2026 coupled to a home network 2028. Example network topologies that may correspond to the gym network 2024 and the home network 2028 are described in further detail in U.S. patent application Ser. No. 15/884,074.

Each exercise platform within the network environment 2000 may also be communicatively coupled to a computing device, such as a laptop, smartphone, smartwatch, exercise tracker, tablet, or similar device. For example the exercise platform 2022B is illustrated as being in direct communication with a smartphone 2032. Similarly, the home exercise platform 2026 is shown as being communicatively coupled to each of a tablet 2033 and a smartphone 2035 over the home network 2028. During use of the exercise platforms, the respective computing devices may be used to display settings, progress, statistics, and other information to the user while also receiving commands from the user in order to control the exercise machine and/or any corresponding dynamic force modules.

Functionality of the exercise platforms and user features may be supported through a cloud-based computing platform 2050 accessible via a network 2052, such as the Internet. As illustrated in FIG. 20, the cloud-based computing platform 2050 may include a server 2054 or one or more similar computing devices communicatively coupled with various data sources, the server 2054 adapted to write data to the data sources and to retrieve data from the data sources in response to requests received by the server 2054.

The cloud-based computing platform 2050 may further include functionality for logging in and authenticating users. In certain implementations, such authentication may occur as users move between or use different exercise platforms in a particular facility with minimal overhead to the user. For example, as a user moves between the exercise platforms 2021A-2021N of the gym facility, a smartphone or similar computing device of the user may connect with the exercise platforms 2021A-2021N and be authenticated by the cloud-based computing platform 2050. Such dynamic authentication may leverage a biometric sensing modality (such as, without limitation, finger print sensing, facial recognition, force signature, or voice recognition), near field radio beacon, user-linked avatar selected on a display of the computing device or the respective exercise machine, automatic connection and authentication using a short range communication protocol, or an imaging sensor or similar vision system.

In one implementation, the cloud-based computing platform 2050 may include a user information data source 2056 that stores user data. Such user data may include, among other things, personal information about the user, personal preferences of the user, historical exercise data regarding the user, and similar information. Personal information may include, for example, the user's height, weight, and full or partial medical history including various health-related metrics such as, without limitation, the user's historical heart rate, VO2 max, body fat percentage, hormone levels, blood pressure, and similar biometric data. Historical exercise data may include, among other things, previous exercises performed by the user, reactive force or similar parameters used when previously performing exercises, and the quality or effectiveness with which the user performed previous exercises (as measured, for example, by a score, points, or similar system).

In certain implementations, connection and authentication of a user with a particular exercise platform may also initiate an auto-configuration of the exercise platform based on data stored in the user information data source 2056. Such auto configuration may include, without limitation, downloading of any force profiles or settings information to be implemented by the dynamic force profile and automatic reconfiguration of the exercise machine to account for the user's particular physical characteristics or the exercise to be performed by the user. For example, an exercise platform may include one or more secondary actuators for adjusting the height, position, and orientation of components of the exercise platform to account for variations in stature and exercises. Accordingly, in certain implementations, the process of connecting and authenticating a user may further include activating such secondary actuators to automatically adjust the exercise platform to accommodate the particular user. The exercise platform may also include passive components (e.g., threaded feet) that may be manipulated by the user to mechanically reconfigure the exercise platform. In such cases, connecting and authenticating a user may further include presenting the user with a list of adjustments or settings to be applied to the exercise platform to account for the user's physical characteristics and/or the exercise to be performed.

The cloud-based computing platform 2050 may also include an exercise data source 2058 that includes a library of exercises and associated data for executing such exercises using one of the exercise platforms. More specifically, each exercise included in the exercise data source 2058 may include, among other things, a force profile for controlling one or more dynamic force modules of the exercise platform during performance of the exercise, ranges or values for parameters that may be measured during the exercise (speed, position, force, etc.), a mapping describing how such parameters are to be modified for various user types, and similar data related to controlling the dynamic force module and providing user feedback during the exercise. During or after completion of an exercise routine or workout, updated exercise data for a user may be uploaded to the cloud-based computing platform 2050 for storage in the exercise data source 2058.

The cloud-based computing platform 2050 may further include a content data source 2060 that includes multimedia content such as, without limitation, videos, images, audio, text, interactive animations/games, and similar content. Such content may be used to, among other things, provide instruction to a user, to provide feedback to a user, to provide motivation to a user, or to otherwise supplement the user's experience.

In certain implementations, the cloud-based computing platform 2050 may be accessible through a web portal 2062 or through a corresponding application. In the example cloud-based computing platform 2050, the web portal 2062 includes various modules such as a data insights module 2064, a workout builder module 2066, an AI/feedback generator module 2068, a content management module 2070, and a personal trainer module 2072. Notably, the web portal 2062 or similar application may be accessible through the network 2052 (e.g., the Internet) using a computing device that is not communicatively coupled to a dynamic force module, such as the computing devices 2074-2078 shown in FIG. 20.

The data insights module 2064 generally allows a user to access and analyze their personal and historical exercise data. Such analysis may include, for example, comparing personal and performance data to one or more benchmarks, comparing including but not limited to, past performances by the users, predefined fitness goals established for the user, and data and records of other users. The user data insight module 2064 may provide the user's data in a variety of tabular and graphical formats to facilitate analysis by the user.

The workout builder module 2066 enables generation of workout routines. For example, in certain implementations, a user may access the workout builder module 2066 and be presented with a list of exercises selectable to generate a workout routine. As part of the workout builder module 2066, the user may specify various parameters and factors including, without limitation, a resistance/weight/reactive force, a number of repetitions, an exercise duration, a sequence of exercise, a number of sets, a speed profile for repetitions, a force profile for repetitions, rest durations, and other factors and parameters, as applicable. By selecting one or more exercises and their corresponding parameters and order, the user may generate a custom workout routine that may subsequently be used in conjunction with an exercise platform. In certain implementations, routines generated by the workout builder module 2066 may be stored in the cloud-based computing platform 2050 or a data source communicatively coupled thereto and made accessible to users of the system 2000. The workout routines may be made publicly available or otherwise shared with other users of the cloud-based computing platform 2050. For example, individuals, trainers, actors, fitness celebrities, or other users may generate pre-defined workout routines for themselves or others to follow.

In certain implementations, workout routines may be accompanied by instructional information for equipment required for the workout routine. This content may also be created by, or with the assistance of an artificial intelligence or other automated generation algorithm. Moreover, the workout routine may further include details regarding specific gym facilities. For example, while at a gym facility, a workout routine may guide a user along a path or otherwise to each machine included in the workout routine. Such guidance may be provided by one or more of visual or other cues. For example, a map may be displayed on a computing device of the user including a map of the gym facility in which the user is located and corresponding directions between exercise machines. In another example, the exercise platform may include lights, LEDs, or similar display elements that may display particular colors or color sequences based on the workout routine such that the user can readily identify which exercise machines he or she is to use.

The AI/feedback generator module 2068 may include a machine-learning or similar system adapted to provide feedback and recommendations to a user based on, among other things, the user's personal information, and exercise history. For example, the AI/feedback generator module 2068 may analyze the user's personal information and exercise history to identify particular areas of weakness or areas of concern in order to recommend particular exercises or workout routines to the user. The AI/feedback generator may also provide recommendations and/or recommended workout schedules to the user based on goals or desired results identified by the user or a doctor, trainer, or similar professional working with the user. In certain implementations, the AI/feedback generator module 2068 may also be used to recommend exercises and workouts to improve client retention for a particular gym facility. For example, the AI/feedback generator module 2068 may identify exercises based on historical user data that are highly correlated with regular and consistent gym attendance and user motivation. The AI/feedback generator module 2068 may then provide recommendations to a user aimed to encourage high participation by the user and high retention for the gym facility.

A content management module 2070 may also be included for managing and distributing content to users of the system. Such content may include, but is not limited to, audio, video, images, text, instructional information, and interactive modules. The content management module 2070 may enable a user of the system or a facility manager to upload, delete, edit, or otherwise manage content. The content management module 2070 may also facilitate distribution of content. In certain implementations, the content management system may also interact with exercise platforms of the system 2000 to manage content locally stored in the exercise platforms. For example, in some implementations at least some of the content maintained by cloud-based computing platform 2050 may be cached or otherwise stored locally to facilitate ease and speed of access. In such implementations, the content management module 2070 may manage, among other things, distribution of new content, updates and modifications to previously distributed content, and removal of expired content.

The personal trainer module 2072 generally corresponds to a tool that may be available to a personal trainer for monitoring, tracking, and managing information and workouts for clients of the personal trainer. For example, through the personal trainer module 2072, a personal trainer may be able to select exercises and generate workouts for clients, to track progress and participation of clients, and to communicate with clients. The personal trainer module 2072 may also enable a personal trainer to generate or otherwise upload content, such as instructional or motivational content, for distribution to clients.

In certain implementations, the cloud-based computing platform 2050 may be integrated or otherwise in communication with a booking and reservation system associated with one or more gym facilities. In such implementations, the cloud-based computing platform 2050 may also facilitate a user booking or reserving an exercise machine. The cloud-based computing platform 2050 may also be accessible to gym operators to review such booking and reservation information and to track utilization of equipment.

FIGS. 21-25 illustrate alternative implementations of exercise platforms in accordance with the present disclosure. The implementations of FIGS. 21-25 are provided to illustrate extensions and applications of exercise platforms in accordance with the present disclosure and, as a result, are intended only as examples that should not be viewed as limiting.

Referring first to FIG. 21, a schematic illustration of a multi-cable exercise platform 2100 is provided. The exercise platform 2100 generally includes a base 2102 having a top surface 2104 through which multiple cables 2106A, 2106B extend, each of which terminates in a respective handle 2108A, 2108B. In certain implementations, each of the cables 2106A, 2106B are coupled to a common dynamic force module disposed within the base 2102. In such implementations, force and movement between the cables 2106A, 2106B may be substantially equal. In alternative implementations, each cable 2106A, 2106B may be coupled to and controlled by a respective dynamic force module. By doing so, the tension, position, movement speed, and other aspects of the cables 2106A, 2106B may be separately set and modified, thereby increasing the potential range of exercise and dynamic resistance options of the exercise platform 2100.

Figure 22:
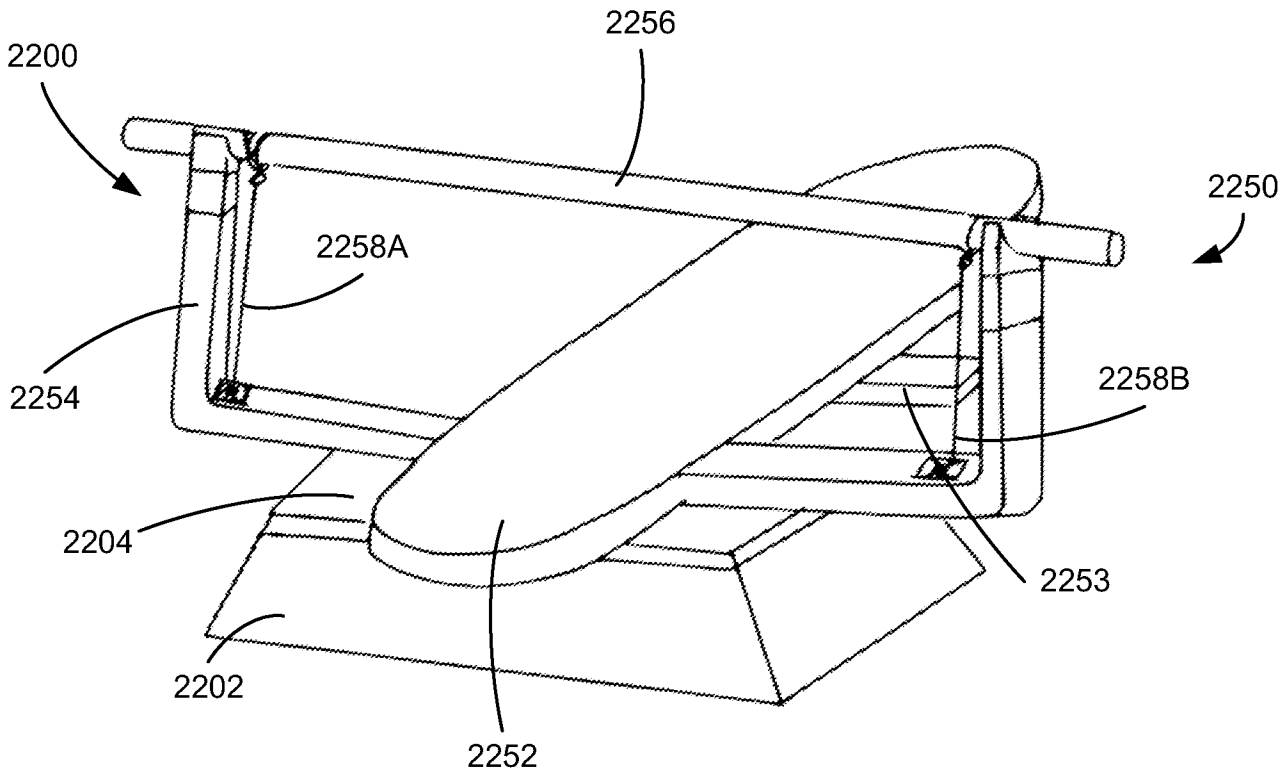
FIG. 22 is a schematic illustration of an exercise platform in accordance with the present disclosure including a top-mounted accessory configured to facilitate bench pressing.

FIG. 22 is a schematic illustration of another exercise platform 2200 including a bench press accessory 2250. More specifically, the exercise platform 2200 generally includes a base 2202 and a top 2204. The bench press accessory 2250 is at least partially disposed on or coupled to the top 2204 and generally includes a bench portion 2252 extending from the top 2204 on which a user may lie. The bench portion 2252 may be further supported by a leg 2253. The bench press accessory 2250 includes a rack portion 2254 extending away and upward from the bench portion 2252. The rack portion 2254 is configured to receive and support a bar 2256 which in turn is connected by cables 2258A, 2258B to one or more dynamic force modules disposed within the base 2202. As illustrated, in at least certain implementations, the cables 2258A, 2258B may be at least partially routed through the rack portion 2254. Accordingly, during exercise a user lies on the bench portion 2252, unracks the bar 2256 and performs a bench press exercise with the dynamic force module(s) of the exercise platform 2200 providing corresponding resistance.

Figure 23:
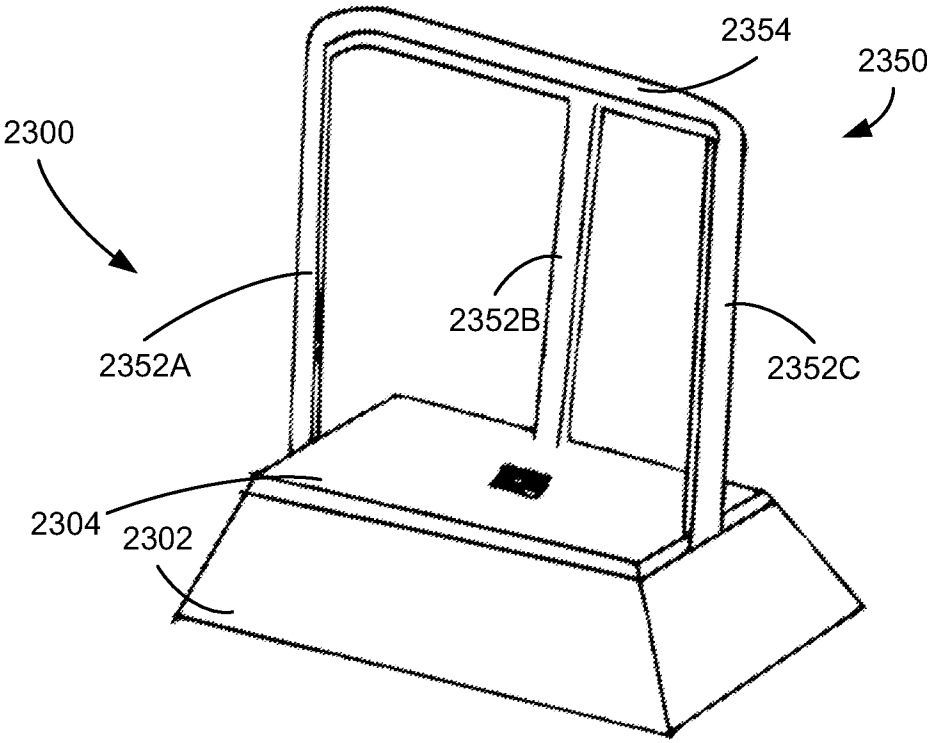
FIG. 23 is a schematic illustration of an exercise platform in accordance with the present disclosure including a rail accessory.

FIG. 23 is a schematic illustration of yet another exercise platform 2300 including a rail accessory 2350. More specifically, the exercise platform 2300 generally includes a base 2302 and a top 2304. The rail accessory 2350 is at least partially disposed on or coupled to the top 2304 and may include one or more upright segments 2352A-C that are coupled to or otherwise support a lateral bar 2354. During exercise a user may stand on the top 2304 and use the rail accessory 2350 to provide additional support and stability.

FIG. 23 further illustrates that while the exercise platform 2300 may be used with a cable (such as the cable 106 shown in FIG. 1A), in at least some applications or for at least some exercises, such a cable may be omitted or unused. In such cases, the user may receive feedback or monitoring based on loading of the exercise platform 2300 despite such loading not being used to control the dynamic force module of the exercise platform.

Figure 24:
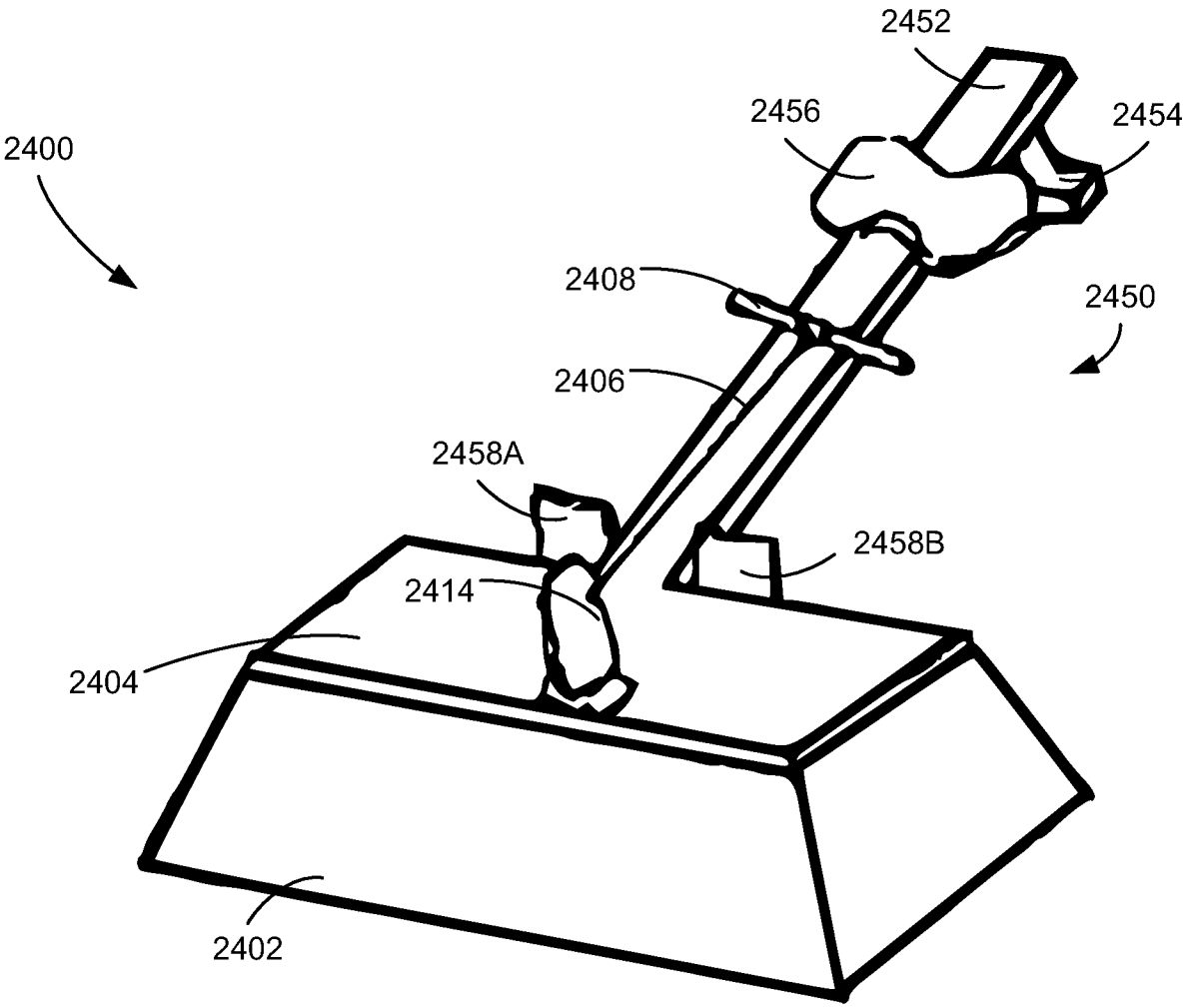
FIG. 24 is a schematic illustration of an exercise platform in accordance with the present disclosure including a rowing accessory.

FIG. 24 is a schematic illustration of still another exercise platform 2400 including a rowing accessory 2450. More specifically, the exercise platform 2400 generally includes a base 2402 and a top 2404. The rowing accessory 2450 is at least partially disposed on or coupled to the top 2404 and includes a rail 2352 supported by a leg 2454 and a seat 2456 movable along the rail 2452. The exercise platform rowing accessory further includes a pair of footrests 2458A, 2458B that may be coupled to a sidewall 2414 of the exercise platform 2400. However, in alternative implementations, the footrests 2458A, 2458B may be omitted with the sidewall acting as a footrest. The exercise platform 2400 further includes a cable 2406 coupled to a rowing handle 2408. As illustrated, the rowing accessory 2450 further includes a pulley 2460 disposed on the top 2404 of the exercise platform 2400 to route the cable 2406; however, in other implementations, the pulley 2460 may be omitted with routing of the cable 2406 handles instead by a fairlead or similar component disposed on or integrated into the top 2504 of the exercise platform 2400.

During operation, a dynamic force module disposed within the exercise platform alternately resists extension of the cable 2406 and retracts the cable 2406 to simulate rowing. In at least certain implementations, load sensors integrated into various components of the exercise platform 2400 to measure forces applied by a user for use in controlling the dynamic force module of the exercise platform 2400, provide feedback to the user, and the like. For example and without limitation, such load sensors may be disposed in or arranged to measure forces at the footrests 2458A, 2458B or integrated into the sidewall 2414 or base 2402 of the exercise platform 2400.

Figure 25:
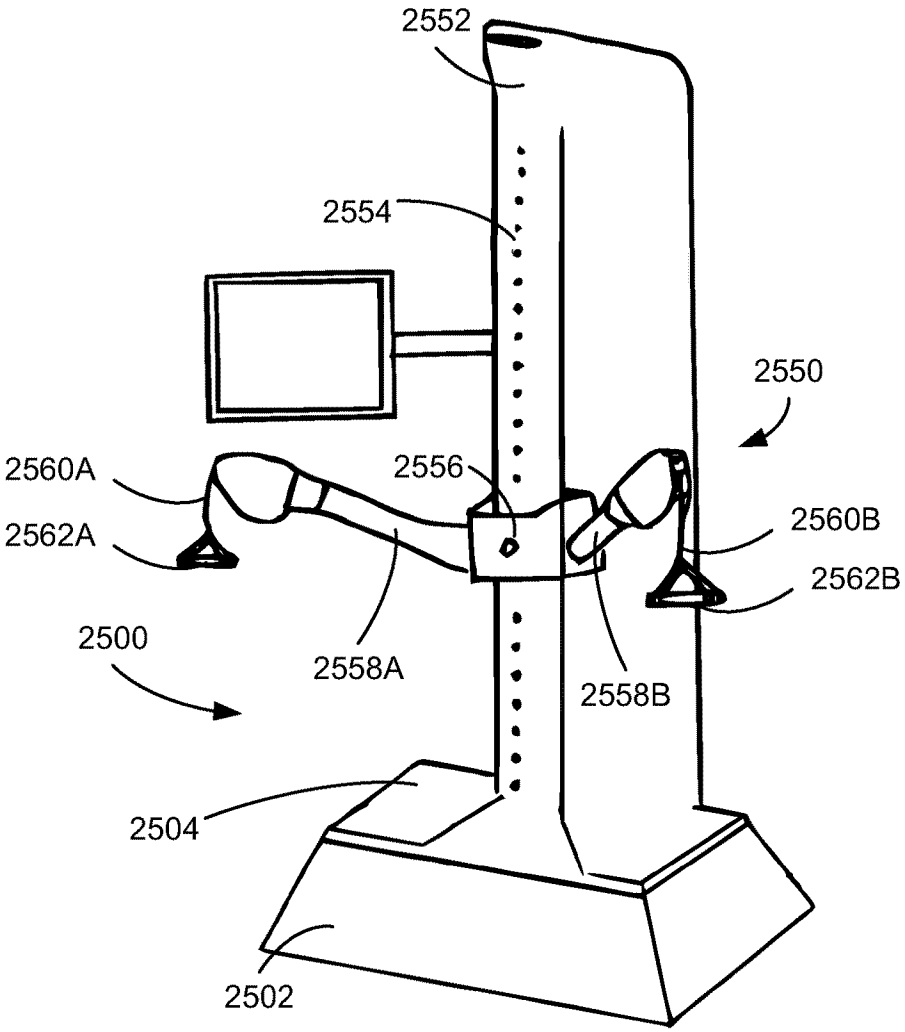
FIG. 25 is a schematic illustration of an exercise platform in accordance with the present disclosure incorporated into a tower-style cable machine.

FIG. 25 is a schematic illustration of another exercise platform 2500 including a tower accessory 2550. More specifically, the exercise platform 2500 generally includes a base 2502 and a top 2504. The tower accessory 2550 is disposed on or coupled to the top 2504. Although other configurations in accordance with the present disclosure are possible, the tower accessory 2550 of FIG. 25 includes a tower body 2552 having a rail 2554 along which an adjustable arm assembly 2556 may be moved. The adjustable arm assembly 2556 includes a pair of adjustable arms 2558A, 2558B, each of which includes respective cables 2560A, 2560B, which terminate in handles 2562A, 2562B. In certain implementations, each cable 2560A, 2560B is coupled to a respective dynamic force module disposed within the base 2502. The exercise platform 2500 further includes an integrated display/computing device 2564

Figure 26:
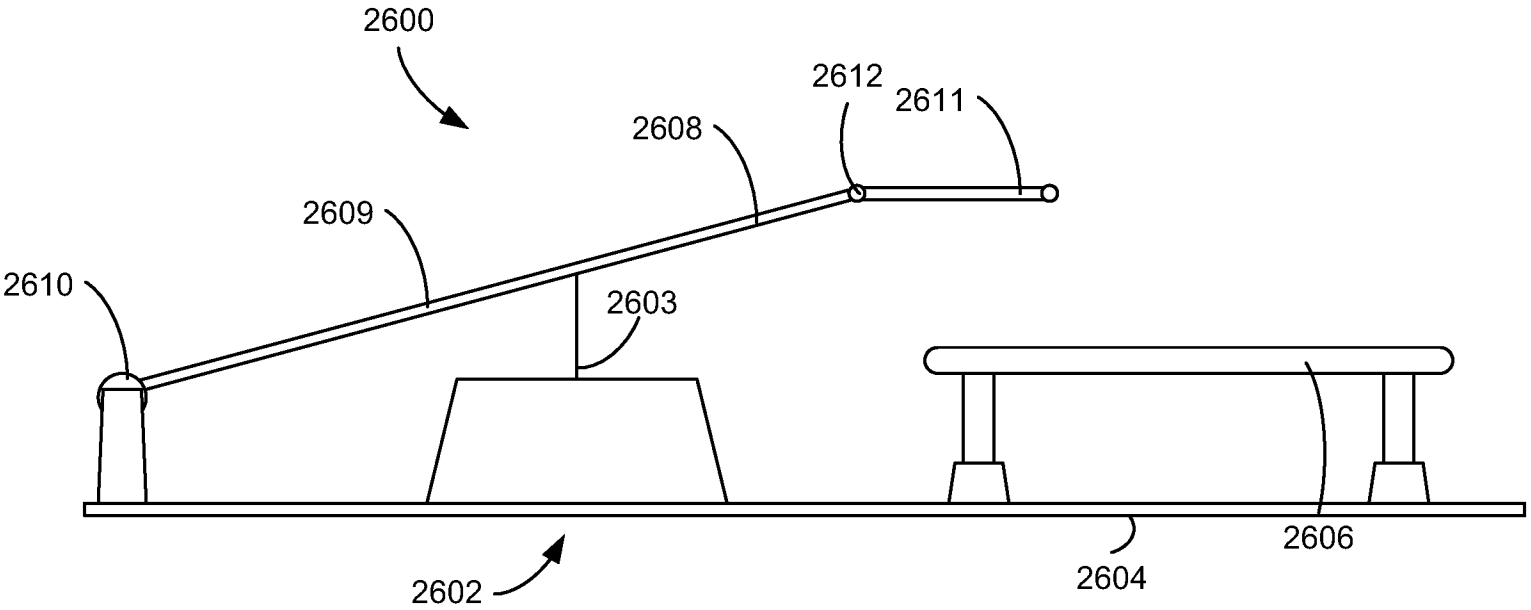
FIG. 26 is a schematic illustration of a first pressing system including an exercise platform according to the present disclosure.

FIG. 26 is a schematic illustration of a pressing system 2600 including an exercise platform 2602 in accordance with the present disclosure. The pressing system 2600 includes a base or plate 2604 to which the exercise platform 2602 may be coupled or on which the exercise platform 2602 may be disposed. The pressing system 2600 further includes an adjustable bench 2606 and a bar 2608. A first portion 2609 of the bar 2608 is coupled to the base 2604 (or to the ground) by a hinged or rotatable joint 2610 and also to a cable 2603 of the exercise platform 2602. The cable 2603 is in turn connected to a dynamic force module disposed within the exercise platform 2602. A second portion 2611 of the bar 2608 may in turn be coupled to the first portion 2609 of the bar 2608 by a swivel joint or similar coupling 2612. Accordingly, to perform various exercises, the user may sit or lie on the bench 2606 and apply upward force on the second portion 2611 of the bar 2608 against tension on the cable 2603 provided by the dynamic force module of the exercise platform 2602. Example exercises that may be performed using the pressing system 2600 of FIG. 26 include, without limitation, flat, inclined, or declined bench presses and military or shoulder presses.

Figure 27:
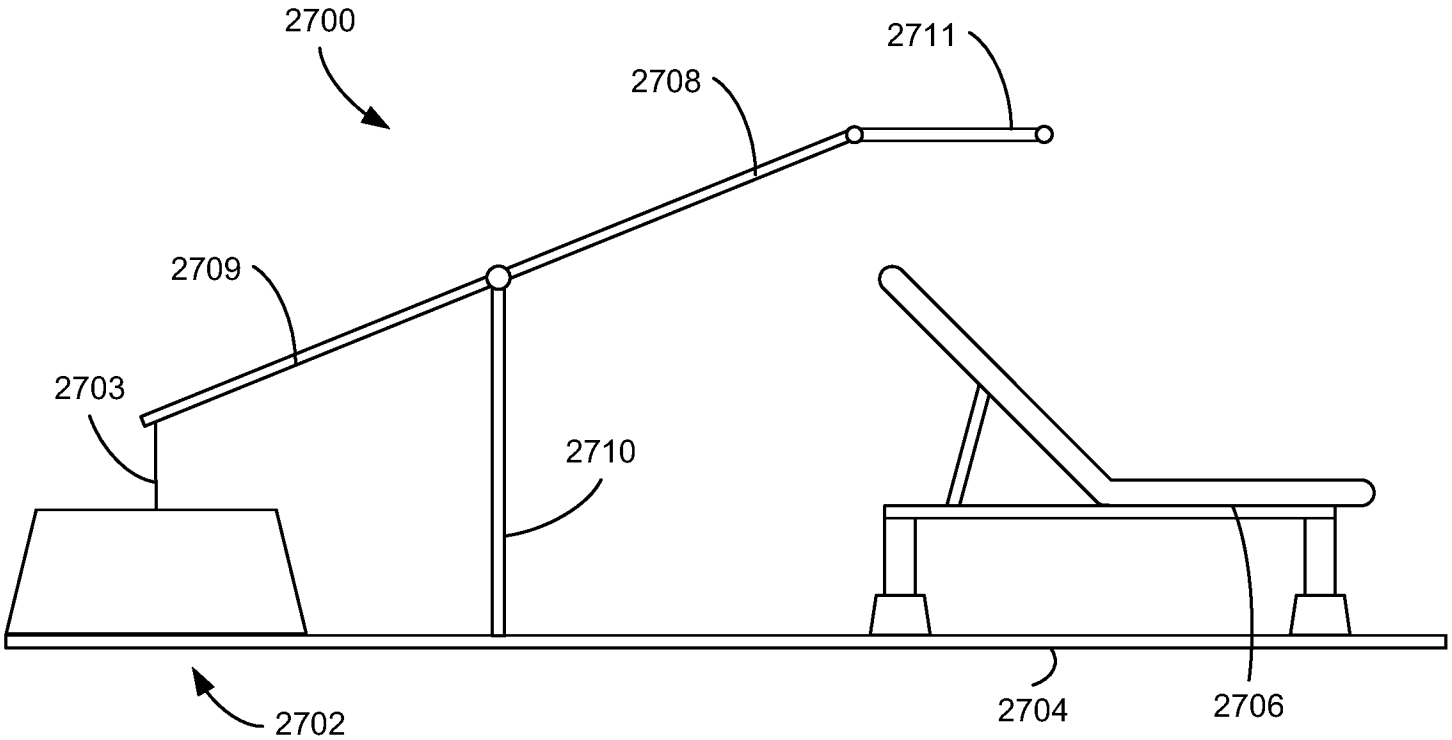
FIG. 27 is a schematic illustration of a second pressing system including an exercise platform according to the present disclosure.

FIG. 27 is a pulling system 2700 that also includes an exercise platform 2702 in accordance with the present disclosure. The pulling system 2700 includes a base or plate 2704 to which the exercise platform 2702 may be coupled or on which the exercise platform 2702 may be disposed. The pulling system 2700 further includes an adjustable bench 2706, a bar 2708, and a pivot pole 2710 to which a first portion 2709 of the bar 2708 is rotatably coupled. An end 2720 of the bar 2708 is also coupled to a cable 2703 of the exercise platform 2702, the cable 2703 in turn being connected to a dynamic force module disposed within the exercise platform 2702. A second portion 2711 of the bar 2708 may in turn be coupled to the first portion 2709 of the bar 2708 by a swivel joint or similar coupling 2712. Accordingly, similar to the previous implementation, to perform various exercises, the user may sit or lie on the bench 2706 and apply downward force on the second portion 2711 of the bar 2708 against tension on the cable 2703 provided by the dynamic force module of the exercise platform 2702. Example exercises that may be performed using the pulling system 2700 of FIG. 27 include, without limitation, lat pulldowns and inverted rows.

Figure 28:
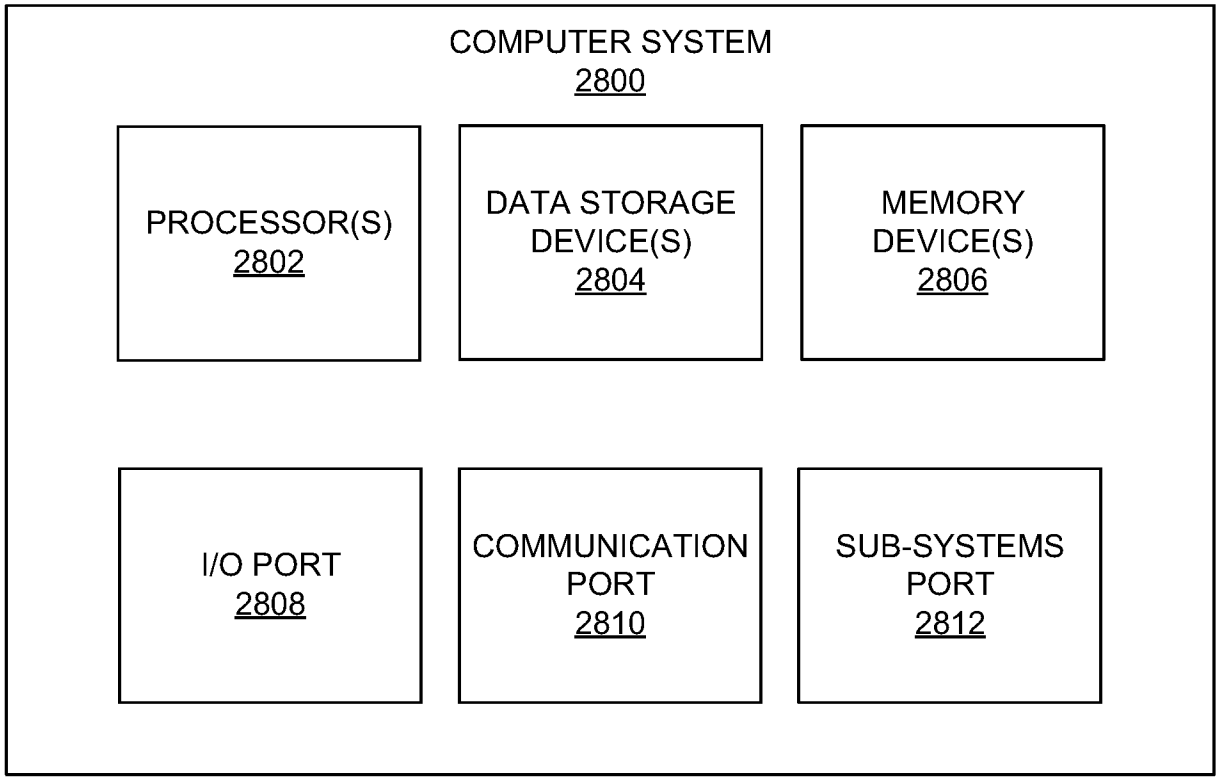
FIG. 28 is a block diagram of an example computing system that may be implemented in conjunction with exercise platforms according to the present disclosure.

Referring to FIG. 28, a block diagram illustrating an example computing system 2800 having one or more computing units that may implement various systems, processes, and methods discussed herein is provided. For example, the example computing system 2800 may correspond to, among other things, one or more of the system controller of an exercise platform in accordance with the present disclosure, a user computing device in communication with an exercise platform, or any similar computing device included in a system incorporating exercise platforms, such as the system 2000 of FIG. 20. It will be appreciated that specific implementations of these devices may be of differing possible specific computing architectures not all of which are specifically discussed herein but will be understood by those of ordinary skill in the art.

The computing system 2800 may be a computing system capable of executing a computer program product to execute a computer process. Data and program files may be input to computing system 2800, which reads the files and executes the programs therein. Some of the elements of the computing system 2800 are shown in FIG. 28, including one or more hardware processors 2802, one or more data storage devices 2804, one or more memory devices 2806, and/or one or more ports 2808-2812. Additionally, other elements that will be recognized by those skilled in the art may be included in the computing system 2800 but are not explicitly depicted in FIG. 28 or discussed further herein. Various elements of the computing system 2800 may communicate with one another by way of one or more communication buses, point-to-point communication paths, or other communication means not explicitly depicted in FIG. 28.

The processor 2802 may include, for example, a central processing unit (CPU), a microprocessor, a microcontroller, a digital signal processor (DSP), and/or one or more internal levels of cache. There may be one or more processors 2802, such that the processor 2802 comprises a single central-processing unit, or a plurality of processing units capable of executing instructions and performing operations in parallel with each other, commonly referred to as a parallel processing environment.

The computing system 2800 may be a conventional computer, a distributed computer, or any other type of computer, such as one or more external computers made available via a cloud computing architecture. The presently described technology is optionally implemented in software stored on data storage device(s) 2804, stored on memory device(s) 2806, and/or communicated via one or more of the ports 2808-2812, thereby transforming the computing system 2800 in FIG. 28 to a special purpose machine for implementing the operations described herein. Examples of the computing system 2800 include personal computers, terminals, workstations, mobile phones, tablets, laptops, personal computers, multimedia consoles, gaming consoles, set top boxes, and the like.

One or more data storage devices 2804 may include any non-volatile data storage device capable of storing data generated or employed within the computing system 2800, such as computer executable instructions for performing a computer process, which may include instructions of both application programs and an operating system (OS) that manages the various components of the computing system 2800. Data storage devices 2804 may include, without limitation, magnetic disk drives, optical disk drives, solid state drives (SSDs), flash drives, and the like. Data storage devices 2804 may include removable data storage media, non-removable data storage media, and/or external storage devices made available via a wired or wireless network architecture with such computer program products, including one or more database management products, web server products, application server products, and/or other additional software components. Examples of removable data storage media include Compact Disc Read-Only Memory (CD-ROM), Digital Versatile Disc Read-Only Memory (DVD-ROM), magneto-optical disks, flash drives, and the like. Examples of non-removable data storage media include internal magnetic hard disks, SSDs, and the like. One or more memory devices 2806 may include volatile memory (e.g., dynamic random access memory (DRAM), static random access memory (SRAM), etc.) and/or non-volatile memory (e.g., read-only memory (ROM), flash memory, etc.).

Computer program products containing mechanisms to effectuate the systems and methods in accordance with the presently described technology may reside in the data storage devices 2804 and/or the memory devices 2806, which may be referred to as machine-readable media. It will be appreciated that machine-readable media may include any tangible non-transitory medium that is capable of storing or encoding instructions to perform any one or more of the operations of the present disclosure for execution by a machine or that is capable of storing or encoding data structures and/or modules utilized by or associated with such instructions. Machine-readable media may include a single medium or multiple media (e.g., a centralized or distributed database, and/or associated caches and servers) that store the one or more executable instructions or data structures.

In some implementations, the computing system 2800 includes one or more ports, such as an input/output (I/O) port 2808, a communication port 2810, and a sub-systems port 2812, for communicating with other computing, network, or similar devices. It will be appreciated that the ports 2808-2812 may be combined or separate and that more or fewer ports may be included in the computing system 2800.

The I/O port 2808 may be connected to an I/O device, or other device, by which information is input to or output from the computing system 2800. Such I/O devices may include, without limitation, one or more input devices, output devices, and/or environment transducer devices.

In one implementation, the input devices convert a human-generated signal, such as, human voice, physical movement, physical touch or pressure, and/or the like, into electrical signals as input data into the computing system 2800 via the I/O port 2808. Similarly, the output devices may convert electrical signals received from the computing system 2800 via the I/O port 2808 into signals that may be sensed as output by a human, such as sound, light, and/or touch. The input device may be an alphanumeric input device, including alphanumeric and other keys for communicating information and/or command selections to the processor 2802 via the I/O port 2808. The input device may be another type of user input device including, but not limited to: direction and selection control devices, such as a mouse, a trackball, cursor direction keys, a joystick, and/or a wheel; one or more sensors, such as a camera, a microphone, a positional sensor, an orientation sensor, a gravitational sensor, an inertial sensor, and/or an accelerometer; and/or a touch-sensitive display screen ("touchscreen"). The output devices may include, without limitation, a display, a touchscreen, a speaker, a tactile and/or haptic output device, and/or the like. In some implementations, the input device and the output device may be the same device, for example, in the case of a touchscreen.

The environment transducer devices convert one form of energy or signal into another for input into or output from the computing system 2800 via the I/O port 2808. For example, an electrical signal generated within the computing system 2800 may be converted to another type of signal, and/or vice-versa. In one implementation, the environment transducer devices sense characteristics or aspects of an environment local to or remote from the computing system 2800, such as, light, sound, temperature, pressure, magnetic field, electric field, chemical properties, physical movement, orientation, acceleration, gravity, and/or the like. Further, the environment transducer devices may generate signals to impose some effect on the environment either local to or remote from the example the computing system 2800, such as, physical movement of some object (e.g., a mechanical actuator), heating or cooling of a substance, adding a chemical substance, and/or the like.

In one implementation, a communication port 2810 is connected to a network by way of which the computing system 2800 may receive network data useful in executing the methods and systems set out herein as well as transmitting information and network configuration changes determined thereby. Stated differently, the communication port 2810 connects the computing system 2800 to one or more communication interface devices configured to transmit and/or receive information between the computing system 2800 and other devices by way of one or more wired or wireless communication networks or connections. Examples of such networks or connections include, without limitation, Universal Serial Bus (USB), Ethernet, WiFi, Bluetooth®, Near Field Communication (NFC), Long-Term Evolution (LTE), and so on. One or more such communication interface devices may be utilized via communication port 2810 to communicate one or more other machines, either directly over a point-to-point communication path, over a wide area network (WAN) (e.g., the Internet), over a local area network (LAN), over a cellular (e.g., third generation (3G) or fourth generation (4G)) network, or over another communication means. Further, the communication port 2810 may communicate with an antenna for electromagnetic signal transmission and/or reception.

The computing system 2800 may include a sub-systems port 2812 for communicating with one or more sub-systems, to control an operation of the one or more sub-systems, and to exchange information between the computing system 2800 and the one or more sub-systems. Examples of such sub-systems include, without limitation, imaging systems, radar, lidar, motor controllers and systems, battery controllers, fuel cell or other energy storage systems or controls, light systems, navigation systems, environment controls, entertainment systems, and the like.

The system set forth in FIG. 28 is but one possible example of a computer system that may employ or be configured in accordance with aspects of the present disclosure. It will be appreciated that other non-transitory tangible computer-readable storage media storing computer-executable instructions for implementing the presently disclosed technology on a computing system may be utilized.

Although various representative embodiments have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member, or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a base;

a top supported by the base and defining an aperture;

a motor assembly including a motor disposed under the top within the base and a cable coupled to the motor, the cable extendable through the aperture, wherein the motor is cantilevered within the base, wherein the base has a larger area than and is parallel to the top, and wherein the base includes a pair of sidewalls opposite each other and respectively extending at a same angle between a lower portion of the base and the top.

2. The exercise device of claim 1, wherein the motor assembly includes a spool coupled to the motor and the cable is wrapped about the spool.

3. The exercise device of claim 1, wherein the motor assembly includes a spool coupled to the motor and the cable is wrapped about the spool, and wherein the spool is vertically aligned with the aperture.

4. The exercise device of claim 1, further comprising an internal support structure within the base, wherein the internal support structure includes a web extending across an internal volume of the base.

5. The exercise device of claim 1, further comprising an internal support structure within the base, wherein the internal support structure includes a web extending across an internal volume of the base, and wherein the motor assembly is coupled to and cantilevered off of the web.

6. The exercise device of claim 1, further comprising an internal support structure within the base and a support bracket, wherein the internal support structure includes a web extending across an internal volume of the base, wherein the support bracket is coupled to the web, and wherein the motor assembly is coupled to and cantilevered off of the support bracket.

7. The exercise device of claim 1, further comprising a fairlead disposed within the aperture, wherein the cable is further extendable through the fairlead.

8. The exercise device of claim 1, wherein the aperture is positioned in a center of the top.

9. The exercise device of claim 1, wherein the same angle is from and including about 45 degrees to and including about 80 degrees relative to the lower portion.

10. An exercise device comprising:

a base including a lower portion and sidewalls extending upward from the lower portion;

a top supported by the base parallel to the lower portion such that the sidewalls extend between the lower portion and the top, wherein the base, the top, and the sidewalls enclose an inner volume and the top includes an aperture in communication with the inner volume;

a motor assembly disposed within the inner volume, the motor assembly including a motor and a cable coupled to the motor, the cable extendable through the aperture, wherein the base has a larger area than the top, and wherein two of the sidewalls are opposite each other and extend at a same angle between the lower portion and the top.

11. The exercise device of claim 10, wherein the same angle is from and including about 45 degrees to and including about 80 degrees relative to the lower portion.

12. The exercise device of claim 10, wherein the aperture is positioned in a center of the top.

13. The exercise device of claim 10, wherein the motor assembly is cantilevered within the inner volume.

14. The exercise device of claim 10, wherein the motor assembly further includes a spool coupled to the motor and aligned with the aperture, and wherein the cable is wrapped about the spool.

15. The exercise device of claim 10, further comprising an internal support structure, wherein the internal support structure includes a web extending across the inner volume.

16. The exercise device of claim 10, further comprising an internal support structure, wherein the internal support structure includes a web extending across the inner volume and the motor is coupled to and cantilevered off of a support bracket coupled to the web.

17. An exercise device comprising:

a base;

a top supported by the base and defining an aperture;

a motor assembly including a motor disposed under the top within the base, a spool coupled to the motor, and a cable coupled to the spool and wound about the spool, the cable extendable through the aperture, wherein the spool is aligned with the aperture such that the cable is routed directly from the spool through the aperture, wherein the base has a larger area than and is parallel to the top, and wherein the base includes a pair of sidewalls opposite each other and respectively extending at a same angle between a lower portion of the base and the top.

18. The exercise device of claim 17, further comprising an internal support structure, wherein the internal support structure includes a web extending across an inner volume of the base and the motor is coupled to and cantilevered off of the web.

19. The exercise device of claim 17, further comprising an omnidirectional fairlead disposed within the aperture, wherein the cable is further extendable through the omnidirectional fairlead.

20. The exercise device of claim 17, wherein the aperture is positioned in a center of the top.

* * * * *